US010926276B2

(12) United States Patent
McDonnell et al.

(10) Patent No.: US 10,926,276 B2
(45) **Date of Patent: *Feb. 23, 2021**

(54) DUAL SPRAYER AND FOAM SPRAYER ATTACHMENT

(71) Applicants: Joseph A. McDonnell, Miramar, FL (US); Christopher Deherrera, Chicago, IL (US)

(72) Inventors: Joseph A. McDonnell, Miramar, FL (US); Christopher Deherrera, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/974,246

(22) Filed: May 8, 2018

(65) Prior Publication Data

US 2018/0250694 A1 Sep. 6, 2018

Related U.S. Application Data

(63) Continuation-in-part of application No. 15/374,219, filed on Dec. 9, 2016, now Pat. No. 10,272,457.
(Continued)

(51) Int. Cl.
*B05B 7/00* (2006.01)
*B05B 11/00* (2006.01)
(Continued)

(52) U.S. Cl.
CPC ..... *B05B 7/005* (2013.01); *B05B 7/2443* (2013.01); *B05B 7/2472* (2013.01);
(Continued)

(58) Field of Classification Search
CPC ..... B05B 7/005; B05B 11/0005; B05B 15/40; B05B 15/63; B05B 7/2443; B05B 7/2472; B05B 12/1409
(Continued)

(56) References Cited

U.S. PATENT DOCUMENTS 1,515,768 A * 11/1924 Damon ..... B67D 1/0083 99/323.2
2,719,704 A 10/1955 Shanklin et al.
(Continued)

FOREIGN PATENT DOCUMENTS

DE 202011051147 U1 10/2011
GB 2004561 A 4/1979

OTHER PUBLICATIONS

Notice of Allowance dated Dec. 19, 2018 in related U.S. Appl. No. 15/374,219.

(Continued)

*Primary Examiner* — Qingzhang Zhou
*Assistant Examiner* — Joel Zhou
(74) *Attorney, Agent, or Firm* — Harness, Dickey & Pierce, P.L.C.

(57) ABSTRACT

The sprayer includes a sprayer housing defining a chamber, and a cylinder within the chamber. The cylinder defines more than one discharge tube positioned in a longitudinal direction within the sprayer housing, the cylinder being selectively rotatable within the chamber. More than one suction tube extends from a lower portion of the sprayer housing. The more than one suction tube is in selective fluid communication with the more than one discharge tube of the cylinder, as the cylinder is rotated within the chamber. The foam sprayer attachment includes a major body defining a discharge channel and a screen traversing the discharge channel. The major body includes a base with a connecting structure that is a raised lip or a cut-out area that conforms the base to a raised ridge on a discharge connection of the sprayer. The connecting structure includes a pair of non-raised lips bracketing each connecting structure.

19 Claims, 45 Drawing Sheets

Related U.S. Application Data

(60) Provisional application No. 62/285,002, filed on Dec. 9, 2015.

(51) Int. Cl.

| | |
|---|---|
| ***B05B 7/24*** | (2006.01) |
| ***B05B 12/14*** | (2006.01) |
| ***B05B 15/40*** | (2018.01) |
| ***B05B 15/63*** | (2018.01) |

(52) U.S. Cl.
CPC ..... *B05B 11/0005* (2013.01); *B05B 12/1409* (2013.01); *B05B 15/40* (2018.02); *B05B 15/63* (2018.02)

(58) Field of Classification Search
USPC ..... 251/309–311
See application file for complete search history.

(56) References Cited

U.S. PATENT DOCUMENTS

| | | | | |
|---|---|---|---|---|
| 3,291,395 | A | 12/1966 | Sharp | |
| D222,255 | S | 10/1971 | Schmedes et al. | |
| 3,964,689 | A | 6/1976 | Horvath, Jr. | |
| D286,066 | S | 10/1986 | Goessling et al. | |
| 5,100,059 | A | 3/1992 | Englhard et al. | |
| 5,213,265 | A | 5/1993 | Englhard et al. | |
| D339,407 | S | 9/1993 | Miseta | |
| D339,408 | S | 9/1993 | Dutcher | |
| D358,865 | S | 5/1995 | Englhard et al. | |
| 5,544,810 | A | 8/1996 | Horvath, Jr. et al. | |
| 5,609,299 | A | 3/1997 | Foster et al. | |
| 5,887,761 | A | 3/1999 | Foster et al. | |
| D441,832 | S | 5/2001 | DiMatteo | |
| 6,283,385 | B1 * | 9/2001 | Beaver | B05B 7/2443 239/10 |
| 6,345,773 | B1 | 2/2002 | Shanklin et al. | |
| 6,378,785 | B1 | 4/2002 | Dodd | |
| 6,425,534 | B2 | 7/2002 | Ketcham et al. | |
| 6,471,141 | B2 | 10/2002 | Smith et al. | |
| D474,265 | S | 5/2003 | Love et al. | |
| 6,604,546 | B1 | 8/2003 | Gilmore | |
| D480,124 | S | 9/2003 | Hubmann et al. | |
| 6,619,318 | B2 | 9/2003 | Dalhart et al. | |
| 6,772,966 | B2 | 8/2004 | Foster et al. | |
| D498,289 | S | 11/2004 | Chen | |
| D519,602 | S | 4/2006 | Dodd | |
| 7,063,277 | B2 | 6/2006 | Englhard et al. | |
| D532,862 | S | 11/2006 | Chung | |
| D533,918 | S | 12/2006 | Dodd | |
| 7,188,786 | B2 | 3/2007 | Dodd | |
| 7,237,728 | B1 | 7/2007 | Laible | |
| 7,281,673 | B2 * | 10/2007 | Burnworth | B05B 1/1636 239/392 |
| 7,328,857 | B2 | 2/2008 | Englhard et al. | |
| 7,407,117 | B2 | 8/2008 | Dodd | |
| 7,513,442 | B2 | 4/2009 | Dodd | |
| 7,631,819 | B2 | 12/2009 | Shanklin et al. | |
| 7,661,604 | B1 | 2/2010 | MacLean-Blevins | |
| D615,614 | S | 5/2010 | Tullney et al. | |
| 7,866,626 | B1 | 1/2011 | MacLean-Blevins | |
| D675,713 | S | 2/2013 | Christensen | |
| D709,988 | S | 7/2014 | Ford | |
| D742,999 | S | 11/2015 | Moya et al. | |
| 2002/0079381 | A1 * | 6/2002 | Smith | B05B 7/2443 239/310 |
| 2004/0118944 | A1 | 6/2004 | Amaduzzi et al. | |
| 2004/0140372 | A1 | 7/2004 | Englhard et al. | |
| 2004/0140373 | A1 | 7/2004 | Joseph et al. | |
| 2005/0183719 | A1 * | 8/2005 | Wuttke | A61M 15/0065 128/200.16 |
| 2006/0091237 | A1 | 5/2006 | Dodd | |
| 2006/0255180 | A1 | 11/2006 | Englhard et al. | |
| 2011/0240763 | A1 | 10/2011 | Svendsen et al. | |

OTHER PUBLICATIONS

U.S. Appl. No. 15/374,219, filed Dec. 9, 2016.
U.S. Appl. No. 29/646,925, filed May 8, 2018.
"Off Bug Control," http://www.off.com/en-US/Products/Pages/OFF-Backvard.aspx(Accessed Dec. 10, 2015).
"32oz Hose-End Sprayer Krud Kutter " https://www.fastenal.com/products/details/0611414 (Accessed Dec. 10, 2015).
"Hose End Sprayer," http://sell.pakuya.com/product-info/191085/hose-end-sprayer.html (Accessed Dec. 10, 2015).
"Liquid Hose End Sprayer," http://guiyo.en.alibaba.com/product/1793257365-221616123/Liquid_Hose_End_Sprayer.html(Accessed Dec. 10, 2015).
"Fertilizing Feeder Hose End," https://www.chapinmfg.com/products/product:g405-fertilizing-feeder-hose-end (Accessed Dec. 10, 2015).
"Wet and Dry Hose End Sprayer," http://www.hardwarestore.com/wet-and-dry-hose-end-sprayer-628748.aspx (Accessed Dec. 10, 2015).
"32 oz Super Concentrated Non-Refillable Roof and Exterior Surface Cleaner with Hose Sprayer," http://www.homedepot.com/p/Spray-Forget-32-oz-Super-Concentrated-Non-Refillable-Roof-and-Exterior-Surface-Cleaner-with-Hose-Sprayer-2-Pack-SFSRC-2Q/20208617?AID=10368321&PID=3348536&SID=popshops&cm_mmc=CJ- -3348536- - 10368321&cj=true (Accessed Dec. 15, 2015).
"E-Z House Wash Hose End 56 oz.," http://www.homearmor.com/product/e-z-wash-hose-end (Accessed Jan. 2016).
"Liquid-Plumr Clorox 17 oz.," http://www.harwareandtools.com/clorox-00216-liquid-plumr-17-ounce-foam-udjb-5169.html (Accessed Dec. 10, 2015).
"Resolve Oxi-Action Dual Power Pre-Treat Laudry Stain Remover," http:/rbnainfo.com/productpro/ProductSearch.do?brandID=28&productLineID=502&searchType=PL&template=1 (Accessed Dec. 10, 2015).
"Dual Chamber Sprayer Matrix ASR," http://www.jondon.com/dual-chamber-sprayer-for-matrix-asr.html (Accessed Dec. 10, 2015).
"Red Relief Stain Magic Dual Chamber Trigger Sprayer," http://www.proschoice.com/html/red_r_ dual_chamber.html (Accessed Dec. 10, 2015).
"Liquid-Plumbr Foaming Clog Fighter," https://www.liquidplumr.com/products/foaming-clog-fighter (Accessed Dec. 10, 2015).

* cited by examiner

SECTION A-A

DUAL SPRAYER AND FOAM SPRAYER ATTACHMENT

PRIORITY STATEMENT

This application is a continuation-in-part application of U.S. application Ser. No. 15/374,219 filed Dec. 9, 2016, which claims priority under 35 U.S.C. § 119(e) to provisional U.S. Application Ser. No. 62/285,002 filed on Dec. 9, 2015, the entire contents of each of which is incorporated herein by reference.

BACKGROUND OF THE INVENTION

Field

Example embodiments relate generally to a sprayer that is configured to selectively discharge two different fluids from the bottle and a foam sprayer attachment that connects to the sprayer.

Related Art

A sprayer may be used to discharge a fluid, such as a chemical, from a bottle. The sprayer may use a vacuum force to draw the fluid from the bottle, where this vacuum force may be created by a working fluid flowing through the sprayer, such that the sprayer may operate as an injector. The sprayer may therefore discharge a mixture of the working fluid and the fluid from the bottle.

SUMMARY OF INVENTION

At least one example embodiment relates to a sprayer.

In one embodiment, the sprayer includes a sprayer housing defining a chamber; a cylinder within the chamber, the cylinder defining more than one discharge tube positioned in a longitudinal direction within the sprayer housing, the cylinder being selectively rotatable within the chamber; and more than one suction tube extending from a lower portion of the sprayer housing, the more than one suction tube being in selective fluid communication with the more than one discharge tube of the cylinder as the cylinder is rotated within the chamber.

In one embodiment, the sprayer further includes more than one suction housing within the cylinder, each suction housing including, one of the more than one discharge tubes, and one suction channel intersecting the respective one discharge tube of the suction housing, each suction channel being in selective fluid communication with one of the more than one suction tubes, the sprayer housing defining an inlet, and a central passage in fluid communication with the inlet, each of the more than one discharge tubes being configured to be individually and selectively aligned to be in fluid communication with the central passage as the cylinder is rotated within the chamber.

In one embodiment, the sprayer further includes a screw penetrating a back-wall of the cylinder and a back-wall of the chamber, the screw being configured to retain the cylinder within the chamber during an operational use of the sprayer.

In one embodiment, the back-wall of the chamber defines a first cylindrical extension, the back-wall of the cylinder defines a second cylindrical extension, the first cylindrical extension being insertable into the second cylindrical extension, the screw penetrates the first and second cylindrical extensions, the screw being configured to remain in a stationary position as the cylinder is rotated within the chamber.

In one embodiment, the more than one discharge tube includes a first discharge tube, a second discharge tube, and a third discharge tube, the more than one suction housing includes, a first suction housing including the first discharge tube in fluid communication with a first suction channel, the first suction channel being in selective fluid communication with a first suction tube, of the more than one suction tubes, and a second suction housing including the second discharge tube in fluid communication with a second suction channel, the second suction channel being in selective fluid communication with a second suction tube, of the more than one suction tubes, the third discharge tube not including a suction housing.

In one embodiment, each suction housing further defines at least one air return vent located adjacent to the respective suction channels of each suction housing, each of the at least one air return vents being in fluid communication with an air inlet that penetrates an end of each suction housing, each of the at least one air return vents being in selective fluid communication with a respective air port positioned adjacent to the suction tubes on the lower portion of the sprayer housing.

In one embodiment, the first suction channel is about perpendicular to the first discharge tube, the second suction channel is about perpendicular to the second discharge tube, a longitudinal length of the central passage is about parallel to the longitudinal direction of the discharge tubes within the sprayer housing.

In one embodiment, the sprayer includes multiple operational modes depending on the rotation of the cylinder within the chamber, the multiple operational modes including, a first mode where the first discharge tube is aligned with the central passage and is in fluid communication with the first suction tube, in order to allow the sprayer to accept a pressurized working fluid to enter the inlet of the sprayer housing and pass through the first discharge tube to also draw a first liquid fluid into the first discharge tube from the first suction tube, and a second mode where the second discharge tube is aligned with the central passage and is in fluid communication with the second suction tube, in order to allow the sprayer to accept the pressurized working fluid to enter the inlet of the sprayer housing and pass through the second discharge tube to also draw a second liquid fluid into the second discharge tube from the second suction tube.

In one embodiment, the multiple operational modes further include, a third mode where the third discharge tube is aligned with the central passage, in order to allow the sprayer to accept the pressurized working fluid to enter the inlet of the sprayer housing and pass through the third discharge tube so that the pressurized working fluid may be discharged from the sprayer without being mixed with another liquid fluid, and a fourth mode that does not allow any fluid to travel through the sprayer.

In one embodiment, the sprayer further includes a rotatable dial on an end of the cylinder, an end of the rotatable dial extending from the chamber of the sprayer housing, the dial being capable of manual manipulation to cause the cylinder to rotate within the chamber; and indicia on an outer surface of the dial, the indicia indicating which one of the multiple operational modes the sprayer is in.

In one embodiment, the sprayer further includes a multi-chamber bottle connected to the lower portion of the sprayer housing, each of the more than one suction tubes extending into one respective chamber of the multi-chamber bottle, a number of chambers of the multi-chamber bottle equaling a number of suction housings within the cylinder of the sprayer.

In one embodiment, the sprayer further includes a dual-chamber bottle connected to the lower portion of the sprayer housing, the first suction tube extending into a first chamber of the dual-chamber bottle and the second suction tube extending into the second chamber of the dual-chamber bottle.

In one embodiment, the sprayer further includes a female connector on the lower portion of the sprayer housing, the female connector including a connector housing that is freely rotatable relative to the sprayer housing, an inner surface of the connector housing defining threads; and at least two vertical extensions extending away from the sprayer housing, the vertical extensions being configured to insert into cut-out portions of a male connector of a bottle that is attachable to the sprayer, the vertical extensions being configured to align the male connector with the female connector as the sprayer is being attached to the bottle.

In one embodiment, the vertical extensions include side-walls that are flared-outward relative to an imaginary centerline running through a longitudinal length of the connector housing.

In one embodiment, the sprayer further includes a suction tube housing joining the more than one suction tube to the lower portion of the sprayer housing, the suction tube housing including a cylindrical suction tube housing for each of the suction tubes, each cylindrical suction tube housing including an air return port configured to allow air to enter the bottle to replace a volume of fluid that is discharged from the bottle during operational use of the sprayer.

In one embodiment, a distal end of the inner surface of the connector housing further defines ratchet spurs configured to interlock with locking spurs on the male connector of the bottle to fully lock the sprayer onto the bottle.

In one embodiment, the sprayer further includes a rotatable dial on an end of the cylinder, an end of the rotatable dial extending from the chamber of the sprayer housing; and a foam sprayer attachment defining a discharge channel, the foam sprayer attachment including, a screen traversing the discharge channel, and a base configured to connect to an end of the rotatable dial so that the discharge channel is in fluid communication with the more than one discharge tubes.

In one embodiment, an outer surface of the rotatable dial defines at least one first raised ridge running longitudinally along the rotatable dial, and the base of the foam sprayer attachment includes at least one of a raised lip and a cut-out area that conforms an inner surface of the base to the raised ridge.

In one embodiment, the outer surface of the rotatable dial includes a tab, the tab having a distal end, and the at least one raised lip or cutout area includes a first raised lip with a notch that is conformed to the distal end of the tab.

In one embodiment, the foam sprayer attachment further includes, a discharge barrel on a distal end of the foam sprayer attachment, and an inner extension on a proximal end of the foam sprayer attachment, the inner extension extending from an inner surface of the base, a distal end of the inner extension being configured to contact an inner/annular vertical surface on an inner surface of the rotatable dial to form a liquid-tight seal between the inner extension and the rotatable dial.

At least another example embodiment is directed toward a sprayer.

In one embodiment, the sprayer includes a sprayer housing defining a chamber; a cylinder within the chamber, the cylinder defining more than one discharge tube positioned in a longitudinal direction within the sprayer housing, the cylinder being selectively rotatable within the chamber; a female connector on a lower portion of the sprayer housing, the female connector including a connector housing that is freely rotatable relative to the sprayer housing, an inner surface of the connector housing defining threads; and at least two vertical extensions extending away from the sprayer housing, the vertical extensions being configured to insert into cut-out portions of a male connector of a bottle that is attachable to the sprayer, the vertical extensions being configured to align the male connector with the female connector as the sprayer is being attached to the bottle.

In one embodiment, the sprayer further includes a suction tube housing joining the more than one suction tube to the lower portion of the sprayer housing, the suction tube housing including a cylindrical suction tube housing for each of the suction tubes, each cylindrical suction tube housing including an air return port configured to allow air to enter the bottle to replace a volume of fluid that is discharged from the bottle during operational use of the sprayer, wherein a distal end of the inner surface of the connector housing further defines ratchet spurs configured to interlock with locking spurs on the male connector of the bottle to fully lock the sprayer onto the bottle.

In one embodiment, the sprayer further includes more than one suction tube extending from a lower portion of the sprayer housing, the more than one suction tube being in selective fluid communication with the more than one discharge tube of the cylinder as the cylinder is rotated within the chamber; and more than one suction housing within the cylinder, each suction housing including, one of the more than one discharge tubes, and one suction channel intersecting a respective one discharge tube of the suction housing, each suction channel being in selective fluid communication with one of the more than one suction tubes, the sprayer housing defining an inlet, and a central passage in fluid communication with the inlet, each of the more than one discharge tubes being configured to be individually and selectively aligned to be in fluid communication with the central passage as the cylinder is rotated within the chamber.

In one embodiment, the sprayer further includes a screw penetrating a back-wall of the cylinder and a back-wall of the chamber, the screw being configured to retain the cylinder within the chamber during an operational use of the sprayer.

At least another example embodiment is directed toward a foam sprayer attachment.

In one embodiment, the foam sprayer attachment includes a major body defining a discharge channel; and a screen traversing the discharge channel, the major body including, a base with at least one first connecting structure on a first side of the base, the at least one first connecting structure being at least one raised lip or cut-out area configured to conform the first side of the base to at least one raised ridge on a discharge connection of a sprayer, wherein each of the at least one first connecting structure further includes a pair of non-raised lips on sides of the at least one first connecting structure.

In one embodiment, the non-raised lips conform the first side of the base to an outer surface of the discharge connection of the sprayer, the major body of the foam sprayer attachment further including a discharge barrel connected to a second side of the base, and an inner extension on the first side of the base, a distal end of the inner extension being configured to contact and form a liquid-tight seal with an inner/annular vertical surface on an inner surface of the discharge connection.

In one embodiment, the base defines an air hole configured to relieve pressure between the first side of the base and an interior of the discharge connection if the foam sprayer attachment is connected to the sprayer.

In one embodiment, the at least one first connecting structure includes, the at least one raised lip, each of the at least one raised lip includes a pair of teeth on sides of the raised lip, and the at least one cut-out area, wherein at least one first raised lip, of the at least one raised lip, defines a notch configured to accept a tab on the discharge connection of the sprayer in order to allow the foam sprayer attachment and the discharge connection to rotate together if the foam sprayer attachment is connected to the sprayer.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
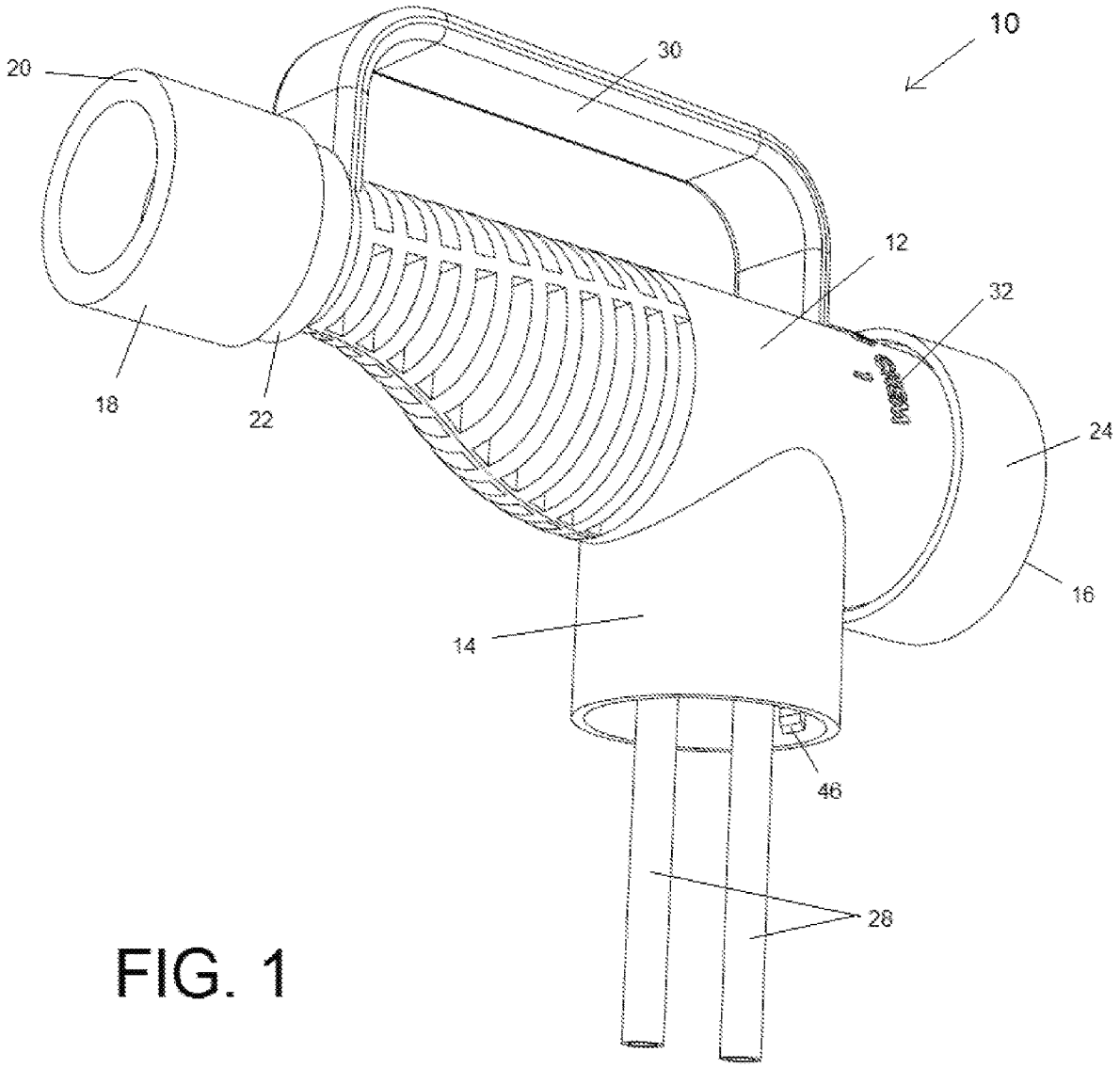
FIG. 1 is an illustration of a perspective view of a dual sprayer, in accordance with an example embodiment.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 1 is an illustration of a perspective view of a dual sprayer 10, in accordance with an example embodiment. The dual sprayer 10 may be used to discharge more than one fluid and/or chemical, along with a working fluid (such as water). The sprayer 10 may include a major housing 12 with a water inlet end 22 and a sprayer outlet end 16. The water inlet end 22 may include an adapter 18 that may, for instance, be a quick-connect adapter, or another well-known adapter that allows a water source to be connected to the water inlet end 22. Specifically, the water inlet end 22 may have an interface 20 that connects to a garden hose (not shown), or another fluid source, allowing the end 22 to accept a pressurized working fluid that may travel through the housing 12 in order to be discharged at the sprayer outlet 16.

Figure 3:
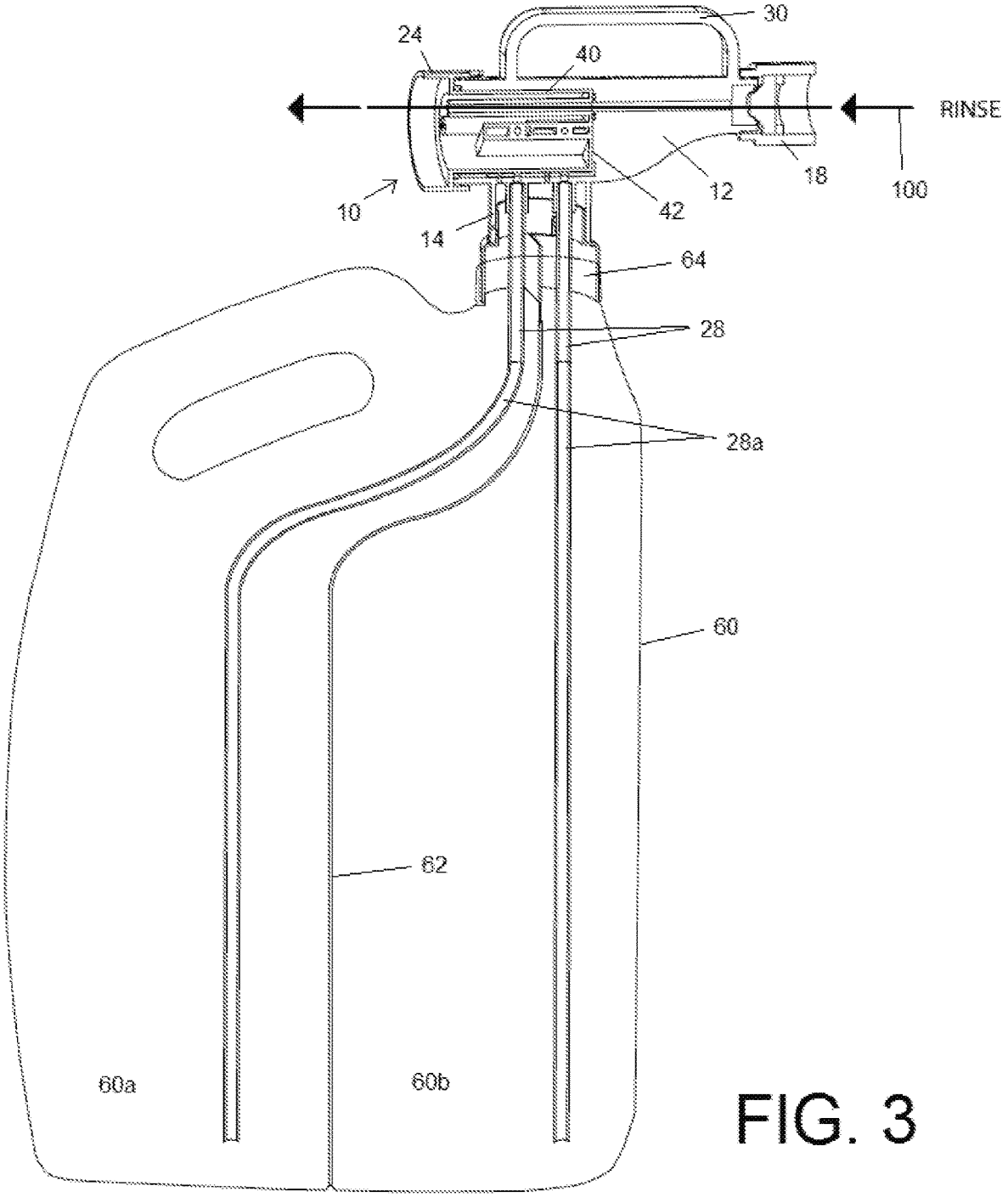
FIG. 3 is an illustration of a cross-sectional side-view of a dual sprayer connected to a dual chamber bottle, in accordance with an example embodiment.

The sprayer 10 may also include a connector 14 that may attach to a bottle 60 (see FIG. 3). The bottle 60 may, for instance, be a dual chamber bottle that may include two or more separated chambers that may each hold a fluid and/or chemical. More than one suction tube 28 may extend from within the connector 14, where a distal end of each of the suction tubes 28 may be positioned within one of the chambers of the bottle 60 (as shown in FIG. 3) in order to allow the sprayer 10 to draw fluid from the bottle 60. One or more physical stops 46 on the connector 14 may be included within an inner surface of the connector 14 in order to attach the sprayer 10 to the bottle 60 (as described in greater detail, herein).

Figure 2:
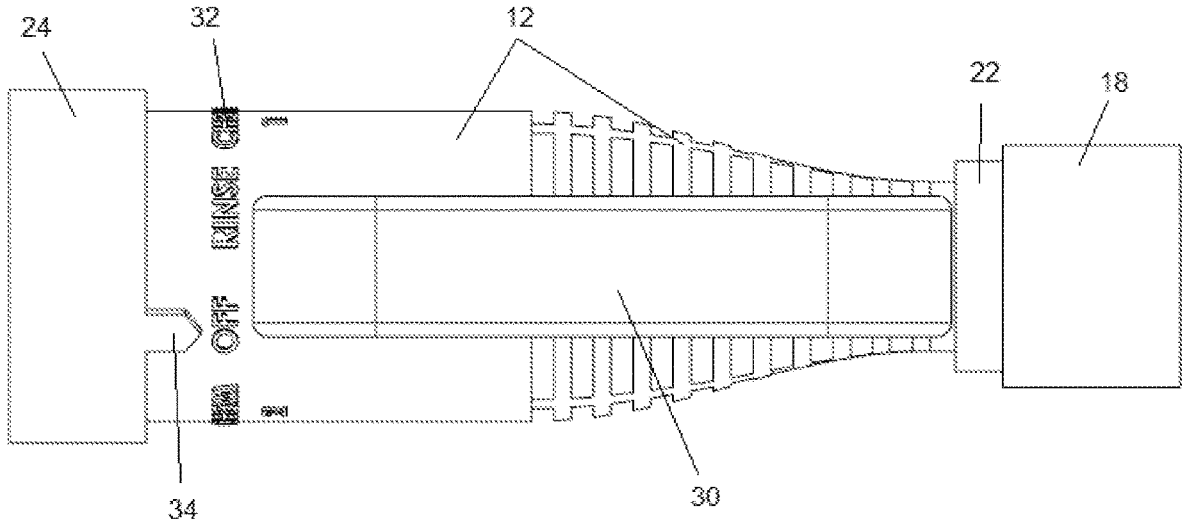
FIG. 2 is an illustration of an overhead view of a dual sprayer, in accordance with an example embodiment.

The sprayer 10 may include a rotating dial 24 that allow the sprayer 10 to be transitioned into different "modes," as described in more detail in FIG. 2. Indicia 32 may be included on the housing 12 in order to signify which mode the sprayer 10 is in. The sprayer may include a handle 30 in order to facilitate easy transport and use of the sprayer 30, especially in the event that the sprayer 10 is attached to a bottle that may be relatively heavy.

FIG. 2 is an illustration of an overhead view of the dual sprayer 10 of FIG. 1, in accordance with an example embodiment. The rotating dial 24 may include a marker 34 that may be used to indicate which "mode" the sprayer 10 is in. The sprayer 10 may include, for instance, four or more modes (indicated by indicia 32), where these modes may be: 1. Off (where the sprayer 10 does not discharge any fluid), 2. A rinse mode (that only discharges the working fluid, which may for instance be water), 3. A "chem 1" mode (where the sprayer 10 may discharge a mixture of the working fluid and a fluid and/or chemical from chamber "A" **60*a* of bottle 60, as shown in FIGS. 3), and 4. A "chem 2" mode (where the sprayer 10 may discharge a mixture of the working fluid and another fluid and/or chemical from chamber "B" 60*b* of bottle 60, as shown in FIG. 3). These different modes are described in conjunction with the specific structural components of the sprayer 10**, in greater detail below.

FIG. 3 is an illustration of a cross-sectional side-view of the dual sprayer 10 connected to a dual chamber bottle 60, in accordance with an example embodiment. In FIG. 3, the sprayer 10 is shown in a rinse mode, where only the working fluid 100 is capable of flowing through the sprayer (where the rinse mode is shown in even better detail in conjunction with the discussion of FIG. 14). The sprayer 10 may include a rotatable cylinder 40 that may rotate within a socket (cavity) 42 of the housing 12 of the sprayer 10. The cylinder 40 may be connected to the rotating dial 24 in order to allow the sprayer 10 to change modes.

The connector 14 of the sprayer 10 may be a female connector that may be capable of attaching to a male connector 64 of the bottle 60 (as described in more detail herein). Extension tubes 28*a* may be connected to the ends of the suctions tubes 28 in order to allow the sprayer 10 to take suction toward a bottom of the bottle 60. While the bottle 60 may include a single divider 62 separating the bottle into two chambers (chamber "A" 60*a* and chamber "B" 60*b*), it should be understood that the bottle 60 may also include more than two chambers.

Figure 4:
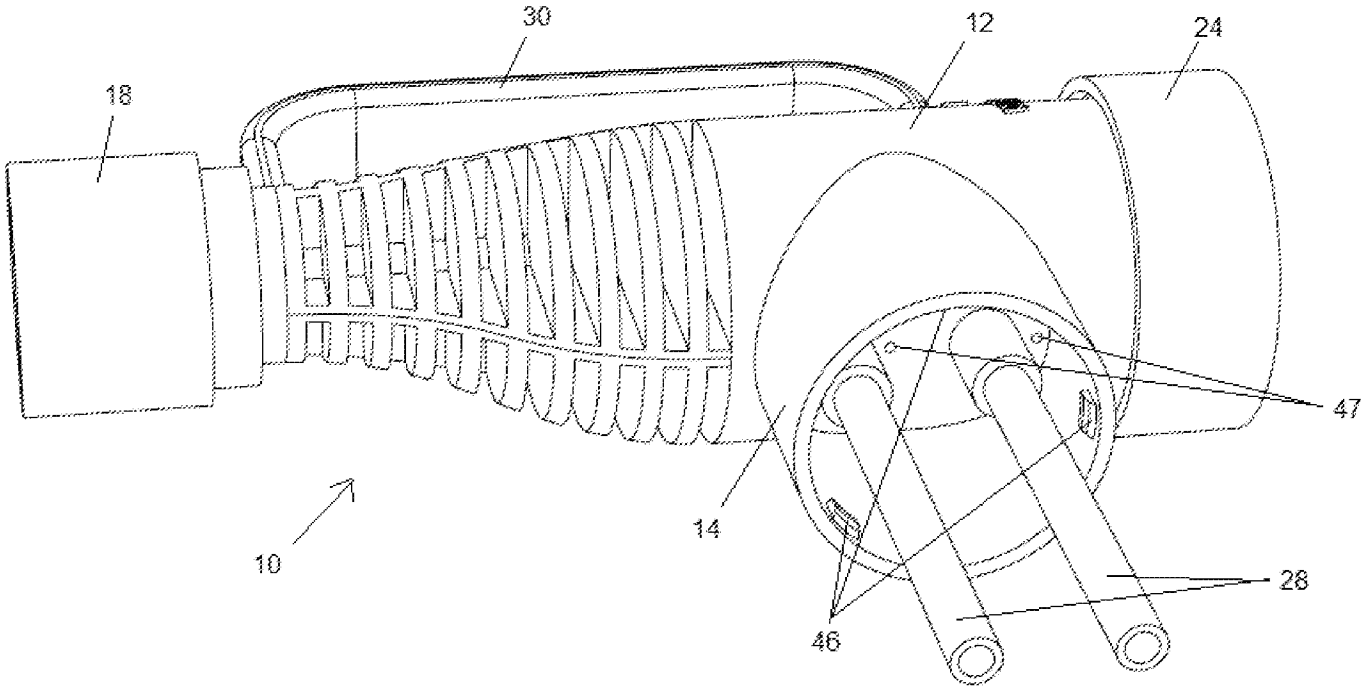
FIG. 4 is an illustration of a perspective view, from a bottom view, of a dual sprayer, in accordance with an example embodiment.

FIG. 4 is an illustration of a perspective view, from a bottom view, of the dual sprayer 10, in accordance with an example embodiment. The connector 14 may include, for instance, three physical stops 46 that may be spaced equidistantly around the inner surface of the connector 14. The physical stops may be beveled, from the standpoint that the stops 46 may be raised, but the stops may become tapered at an end that approaches a distal end of the connector 14.

Figure 6:
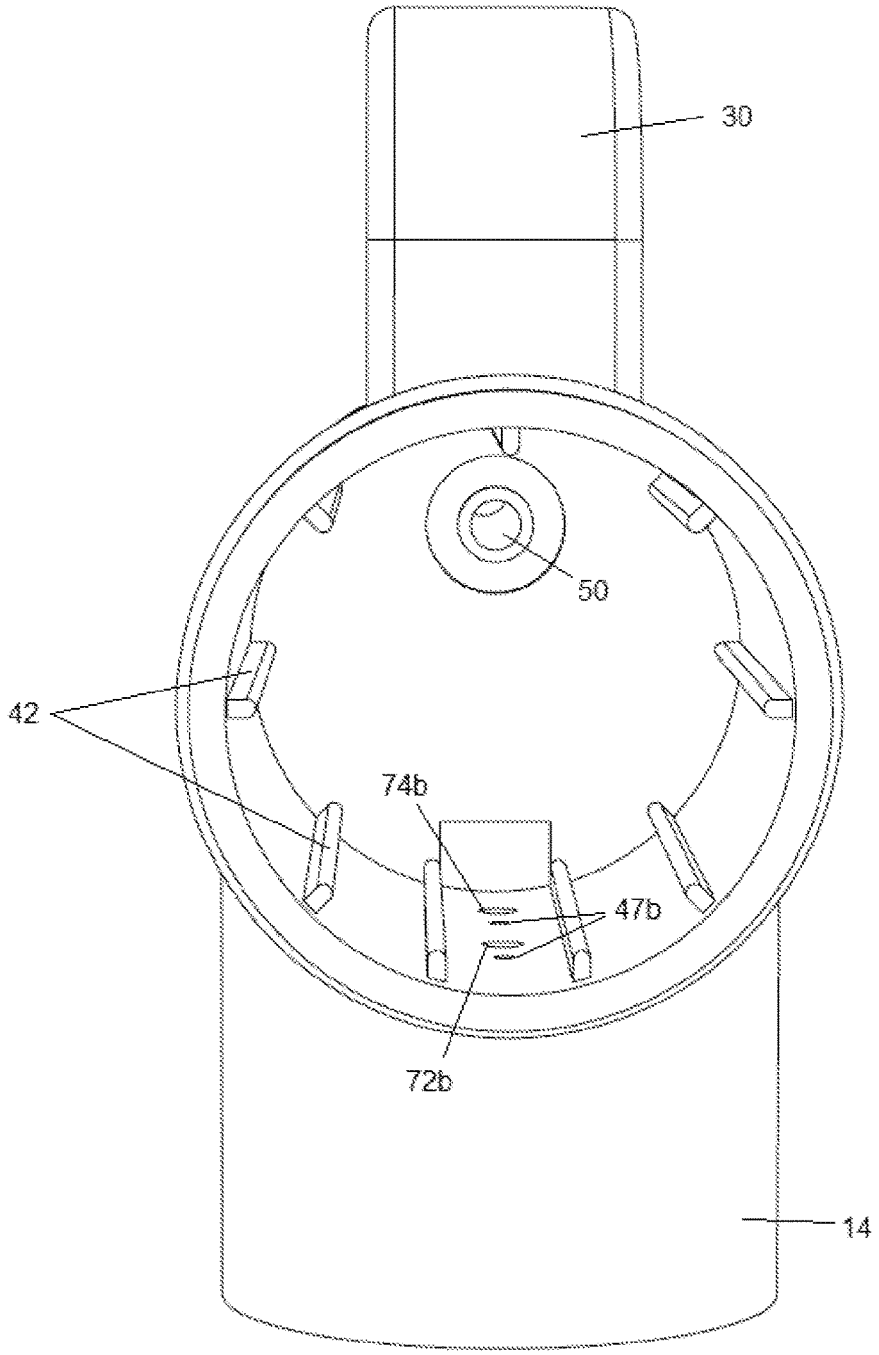
FIG. 6 is an illustration of internals of a main housing of a dual sprayer, in accordance with an example embodiment.

A bottom surface of the housing 12, that may be above a location of the connector 14, may include one or more air return ports 47 that may be in fluid communication with one or more air ports 47*b* shown in FIG. 6. The air return ports 47 may allow air to enter the bottle 60 as fluid is displaced from the bottle 60 while the sprayer 10 is in functional use.

Figure 5A:
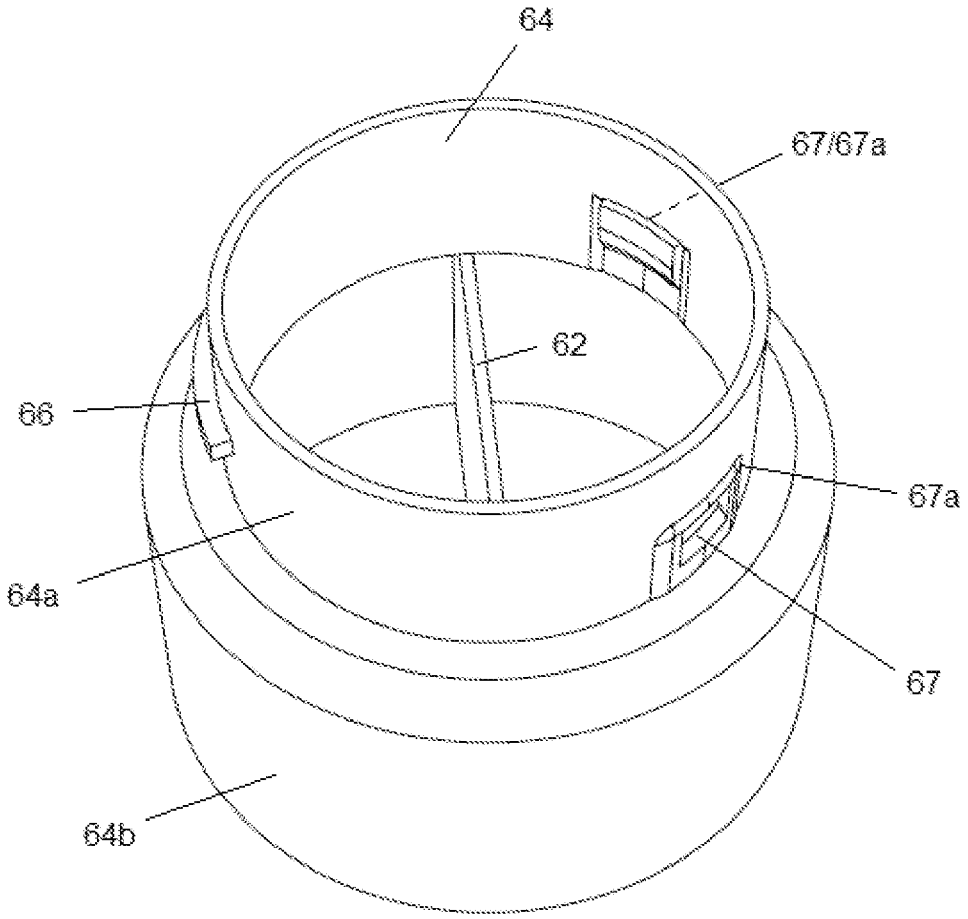
FIG. 5A is an illustration of a male connector at the top of a dual chamber bottle, in accordance with an example embodiment.

FIG. 5A is an illustration of a male connector 64 at the top of a neck 64*b* of a bottle 60, such as a dual chamber bottle, in accordance with an example embodiment. The male connector 64 may include two or more depressions 67 that may mate with the beveled stops 46 of the connector 14 of the sprayer 10. The depressions 67 may include a raised-frame 67*a* capable of retaining the stops 46 with the depressions 67.

The male connector 64 may also include a rib 66 positioned along a portion of an outer circumference of the connector 64. The rib 66 may be positioned to allow one of the physical stops 46 of the connector 14 of the sprayer 10 to slide under the rib 66, and be retained by the rib 66 (also see the position of the rib in FIG. 5B), thereby providing at least three points-of-contact to lock the sprayer connector 14 onto the male connector 64 of the bottle 60. The rib 66 may have a limited length (discussed below with regard to FIG. 5B) in order to allow a physical stop 46 to slide down along an outer surface 64*a* of the bottle connector 64, and then slide under the rib 66 (and be retained under the rib 66 to impede the connector 14 of the sprayer 10 from separating from the bottle 60), such that the connector 14 of the sprayer 10 may only need to be rotated within a limited range of rotation in order to lock the sprayer 10 onto the bottle 60. In particular, the rib 66 may have a limited length in order to require that the connector 14 of the sprayer 10 may only need to rotate about 30 degrees, or less, as the connector 14 of the sprayer 10 is pressed down onto the connector 64 of the bottle 60 and rotated into a locked position. This limited required angular rotation of the connector 14 on the male connector 64 of the bottle 60 ensures that the suction tubes 28 may be retained on the bottom of the sprayer 10 without being damaged or broken (as a greater required degree of rotation between the connector 14 of the sprayer 10 and the male connector 64 of the bottle 60 may cause the suction tubes 28 to contact the divider 62 and may cause damage to the suction tubes 28).

Figure 5B:
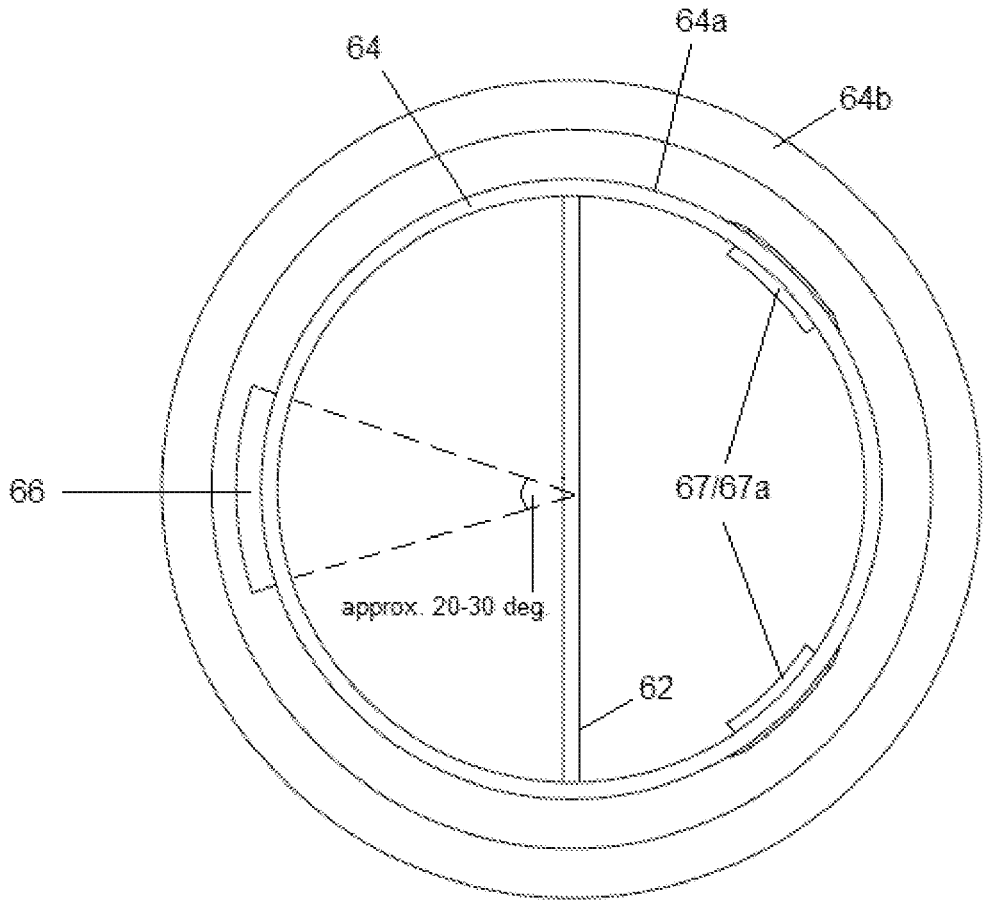
FIG. 5B is an illustration of an overhead view of a male connector at the top of a dual chamber bottle, in accordance with an example embodiment.

FIG. 5B is an illustration of an overhead view of the male connector 64 at the top of 60 dual chamber bottle, in accordance with an example embodiment. Notice that FIG. 5B depicts a relative length of rib 66. In particular, the rib 66 may be positioned to exist along about 20 to 30 degrees of the outer circumference of the male connector 64 (i.e., the rib 66 may extend about 0.35 radians to 0.52 radians along the outer circumference of connector 64), in order to limit the required angle of rotation that may be necessary to slip one of the physical stops 46 of the connector 14 of the sprayer 10 under the rib 66 and rotate the connector 14 about 30 degrees or less in order to seat the other physical stops 46 within the depressions 67 and frame 67*a* of the male connector 64 (thereby locking the sprayer 10 onto the top of the bottle 60).

It should be understood that other embodiments have been contemplated, where additional physical stops 46 may be included on the connector 14 of the sprayer, and where additional depressions and/or ribs 66 may be included on a male connector 64 of a bottle. Additionally, it is noted that any of a great variety of bottles may be used, where the dual chamber bottle 60 (shown in FIG. 3) is just one example of a bottle with more than one chamber. Furthermore, while the female connector 14 of the sprayer 10 and the male connector 64 of the bottle 60 have been depicted with a circular cross-section, it should be understood that example embodiments allow for other cross-sectional shapes may instead be implemented. In particular, square or rectangular connectors may be implemented (or, square or rectangular connectors with rounded-corners may be implemented).

FIG. 6 is an illustration of internals of the main housing 12 of a dual sprayer 10, in accordance with an example embodiment. The housing may include a socket (chamber) 42 that may contain the rotatable cylinder (valve) 40 of the sprayer 10. The housing 12 may also include a central passage 50 that may exist between the socket 42 and the inlet end 22 of the sprayer 10 (in order to allow the working fluid to traverse through the inside of the housing 12). Near a bottom of the socket 42 (at a location above the connector 14), the housing may include air ports 47*b* in fluid communication with the air return ports 47. The air ports 47*b* may allow air to enter into the bottle 60 while fluid is displaced from the bottle 60 while the sprayer 10 is in use. The bottom of the socket 42 may also include two or more ports, such as a "chemical 1" port 72*b* and "chemical 2" port 74*b*, that may allow fluid from the bottle 60 to be drawn into the sprayer 10.

An inner surface of the socket 42 may also include ribs 48 that may run longitudinally within the socket 42. The ribs 48 may support the cylinder 40 (shown in detail in FIG. 7), and allow the cylinder 40 to rotate within the socket 42.

Figure 7:
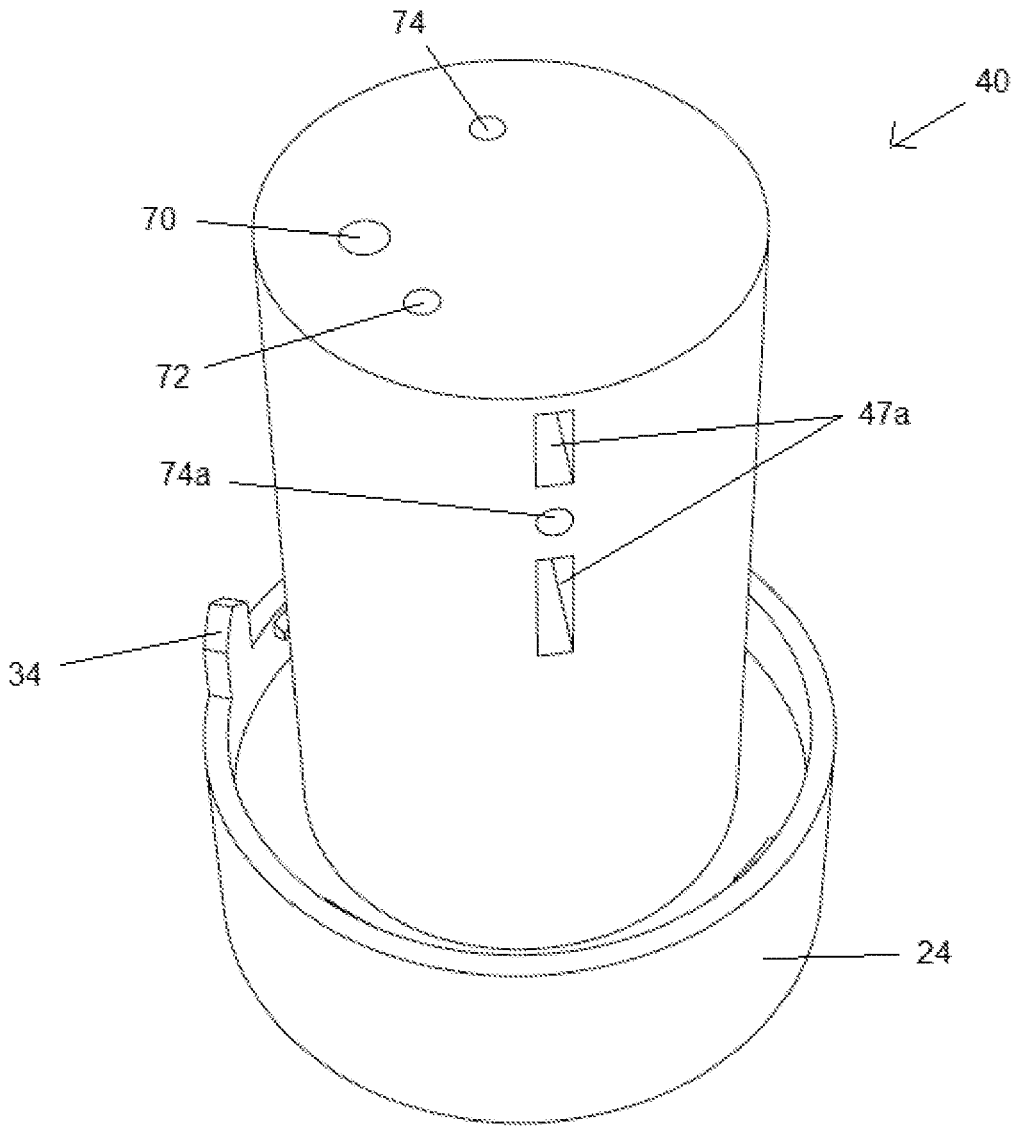
FIG. 7 is an illustration of an end-view of a cylinder of a dual sprayer, in accordance with an example embodiment.

FIG. 7 is an illustration of an end-view of the cylinder 40 of the dual sprayer 10, in accordance with an example embodiment. The cylinder 40 may include a relatively large diameter water discharge line (port) 70 that may run through a longitudinal length of the cylinder 40 and may be in fluid communication with the water discharge tube 80 on the other side of the cylinder 40 (see FIG. 8). This water discharge line 70 may allow the working fluid to pass through the sprayer 10 during a rinse mode.

Figure 8:
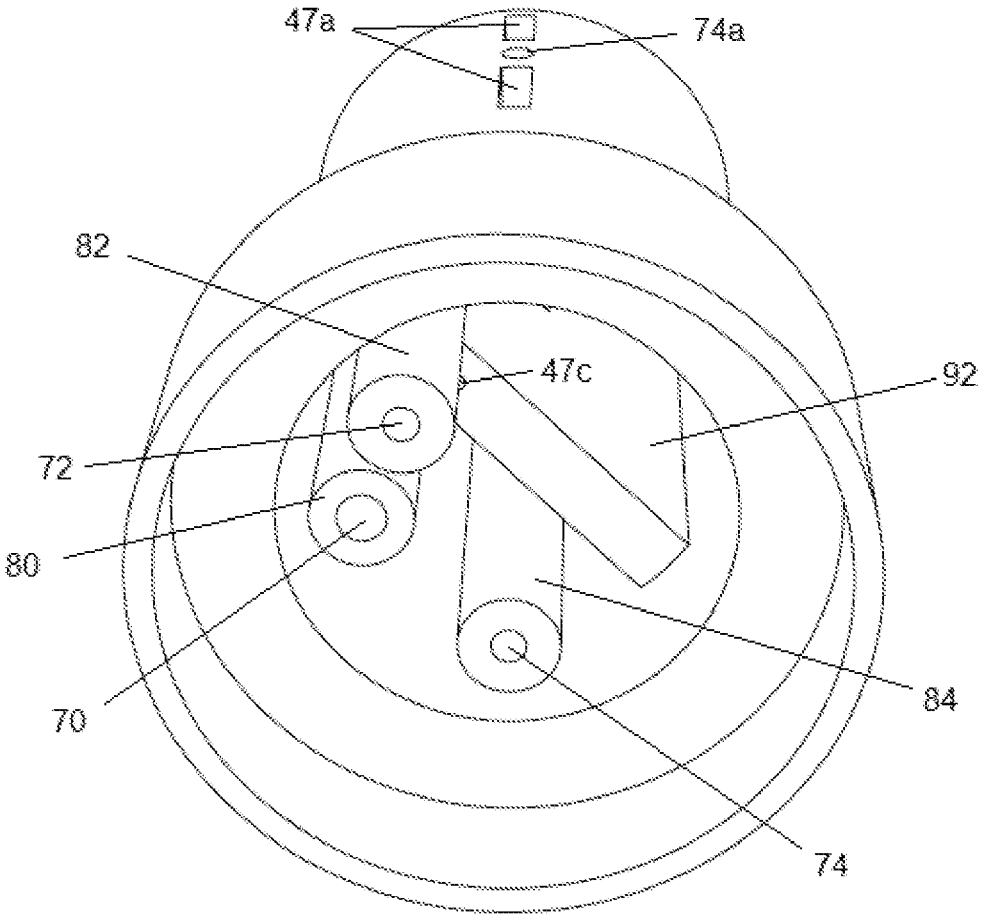
FIG. 8 is an illustration of another end-view of a cylinder of a dual sprayer, in accordance with an example embodiment.

The cylinder 40 may also include a relatively smaller diameter "chemical 2" discharge line 74 that may run through a longitudinal length of the cylinder 40 and may be in fluid communication with the "chemical 2" discharge tube 84 on the other side of the cylinder 40 (see FIG. 8). This "chemical 2" discharge line 74 may allow the working fluid to mix with a fluid that may be drawn from a chamber of the bottle 60. Specifically, the working fluid flowing through the "chemical 2" discharge line 74 may cause a vacuum force within a "chemical 2" suction channel 74*a* that is in fluid communication with the "chemical 2" discharge line 74, allowing the cylinder 40 to act as an injector in order to draw a fluid from a chamber of the bottle 60 when the "chemical 2" suction channel 74*a* is aligned with the "chemical 2" port 74*b* (FIG. 6) in the "chem 2" mode of the sprayer 10. In this mode, one or more air return vents 47*a* may also be aligned with the air ports 47*b* in the housing (FIG. 6) in order to allow air to flow into the bottle as a fluid is discharged from the bottle 60.

Figure 9:
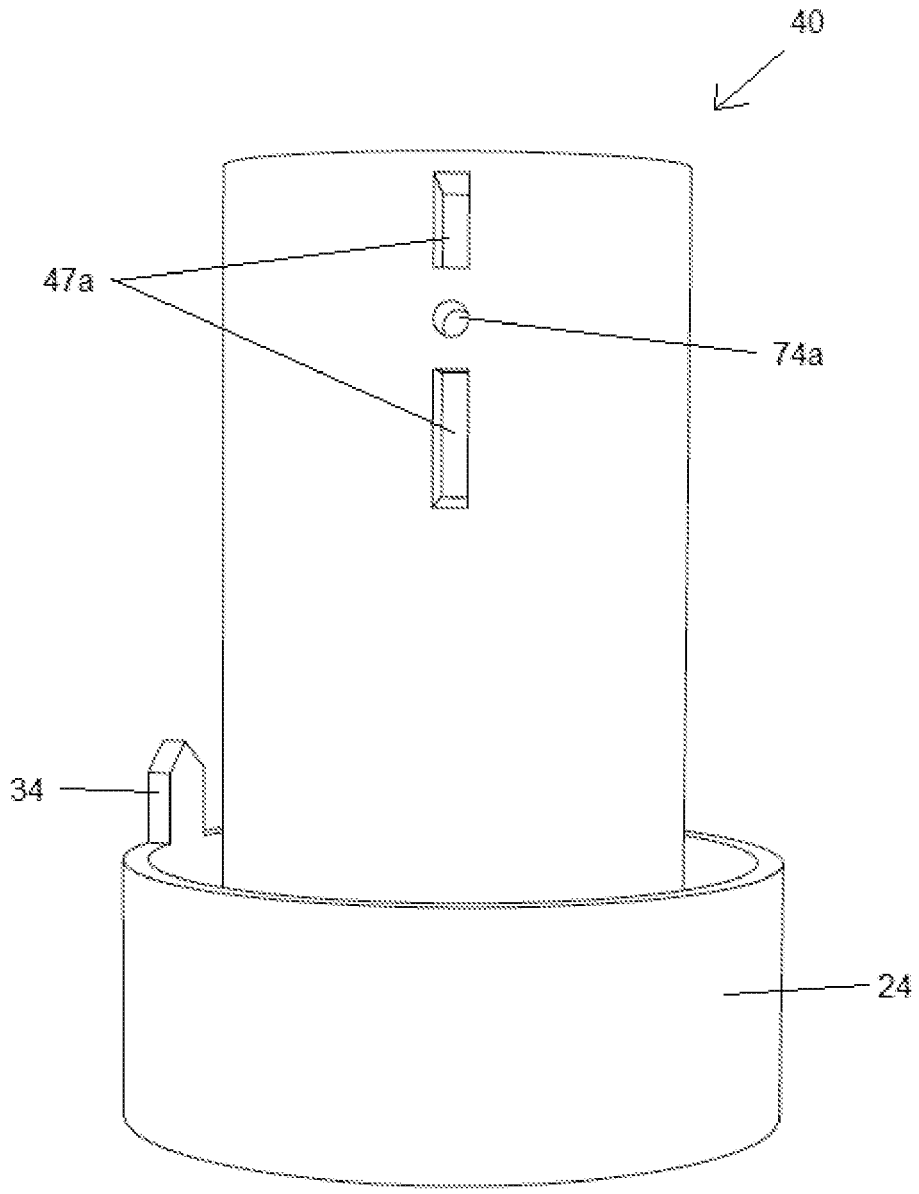
FIG. 9 is an illustration of a side-view of a cylinder of a dual sprayer, in accordance with an example embodiment.

The cylinder 40 may also include a "chemical 1" discharge line 72 in fluid communication with the "chemical 1" discharge tube (FIG. 8), where the function of this line 72 is described in greater detail in association with FIG. 9.

FIG. 8 is an illustration of another end-view of the cylinder 40 of the dual sprayer 10, in accordance with an example embodiment. Note that this drawing depicts a "chemical 1" suction housing 92 (also shown in FIG. 13). This housing 92 may define the "chemical 1" suction channel 72*a* and the air return vents 47*a* (shown in better detail in FIG. 9). The air return vents 47*a* may be in fluid communication with the air inlet 47*c* of the "chemical 1" suction housing 92 (see FIG. 13) in order to provide a reverse flow-path of air back into the bottle 60 as fluid is discharged from the bottle 60.

Figure 10:
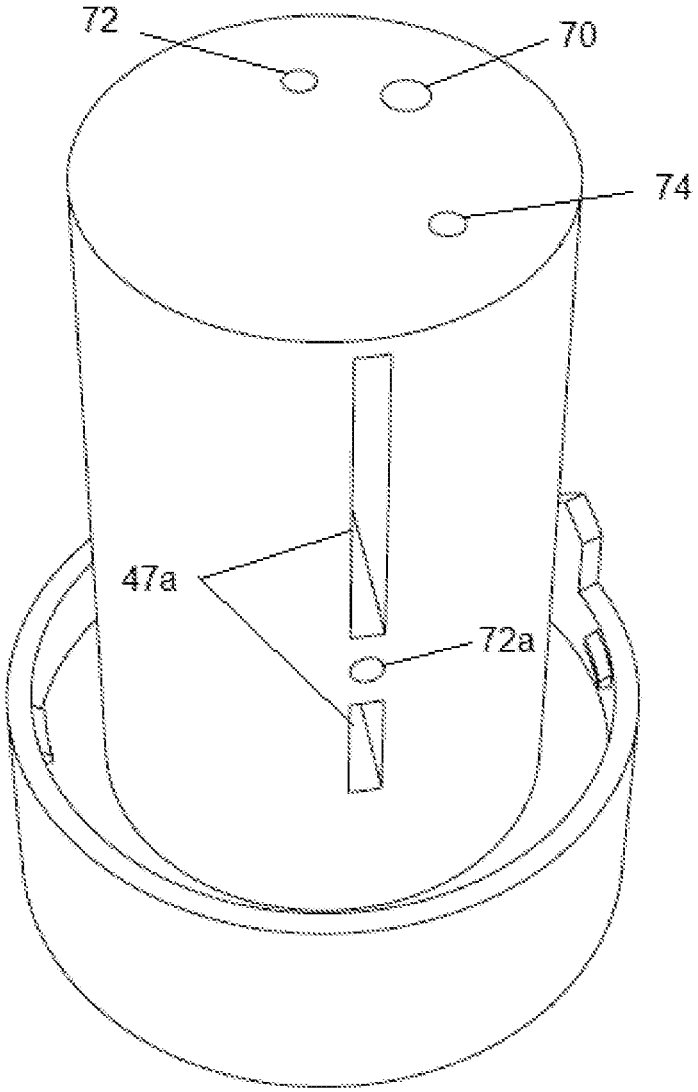
FIG. 10 is an illustration of an end-view of a cylinder of a dual sprayer, in accordance with an example embodiment.
Figure 11:
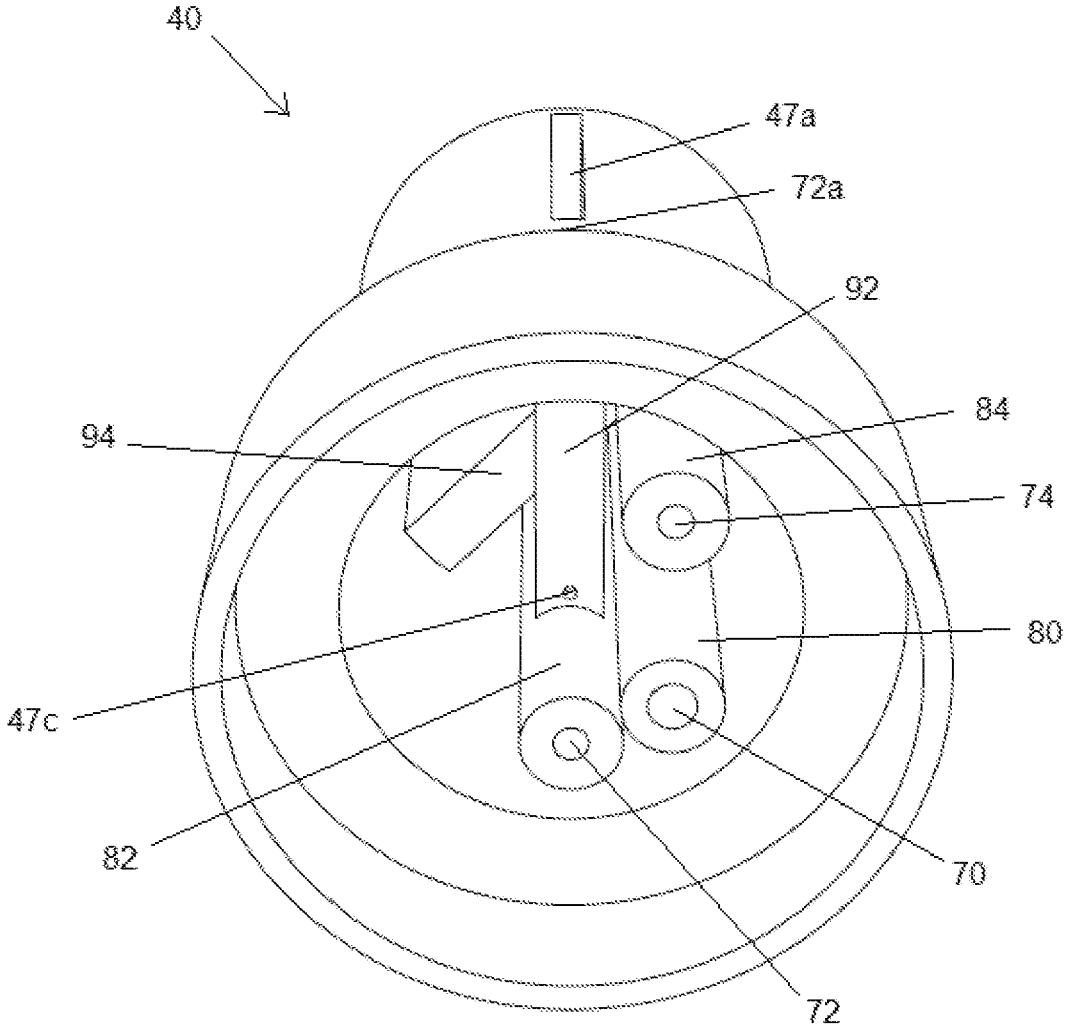
FIG. 11 is an illustration of another end-view of a cylinder of a dual sprayer, in accordance with an example embodiment.

FIG. 10 is an illustration of an end-view of the cylinder 40 of the dual sprayer 10, in accordance with an example embodiment. In particular, FIG. 10 depicts the "chemical 1" suction channel 72*a* that is in fluid communication with the "chemical 1" discharge line 72 that traverses through a longitudinal length of the cylinder 40. The "chemical 1" discharge line 72 is also in fluid communication with the "chemical 1" discharge tube 82 (FIG. 11). When sprayer 10 is discharging fluid from the bottle 60 through the "chemical 1" discharge line 72, the cylinder is rotated within the housing 12 so that the "chemical 1" discharge line 72 is aligned with the central passage 50 (FIG. 6). Note that one or more air return vents 47*a* are also near the "chemical 1" suction channel 72*a*, as these vents 47*a* may be aligned with the air ports 47*b* of the housing 12 (see FIG. 6) in order to allow a reverse air flow to enter the bottle 60 as fluid is being displaced from the bottle.

FIG. 11 is an illustration of another end-view of the cylinder 40 of the dual sprayer 10, in accordance with an example embodiment. This perspective view of the cylinder 40 shows the alignment of a "chemical 1" suction housing 92 with the "chemical 1" suction channel 72*a* and air return vents 47*a* (as both the channel 72 and vents 47*a* are included in the "chemical 1" suction housing 92). It should be understood that the air inlet 47*c* shown exiting the "chemical 1" suction housing 92 is in fluid communication with the air return vents 47*a* in order to provide a reverse flow path of air into the bottle 60 as the sprayer 10 displaces fluid from the bottle 60.

FIG. 11 also depicts the "chemical 2" suction housing 94 that houses the "chemical 2" suction channel 74*a* and the air return vents 47*a* bracketing the "chemical 2" suction channel 74*a* (shown in FIG. 9). The "chemical 2" suction channel 74*a* is in fluid communication with the "chemical 2" discharge tube 84 (also shown in FIG. 13), whereas the air return vents 47*a* adjacent to the "chemical 2" suction channel 74*a* are in fluid communication with the air inlet 47*c* exiting the "chemical 2" suction housing 94 (as shown in FIG. 13).

Figure 12:
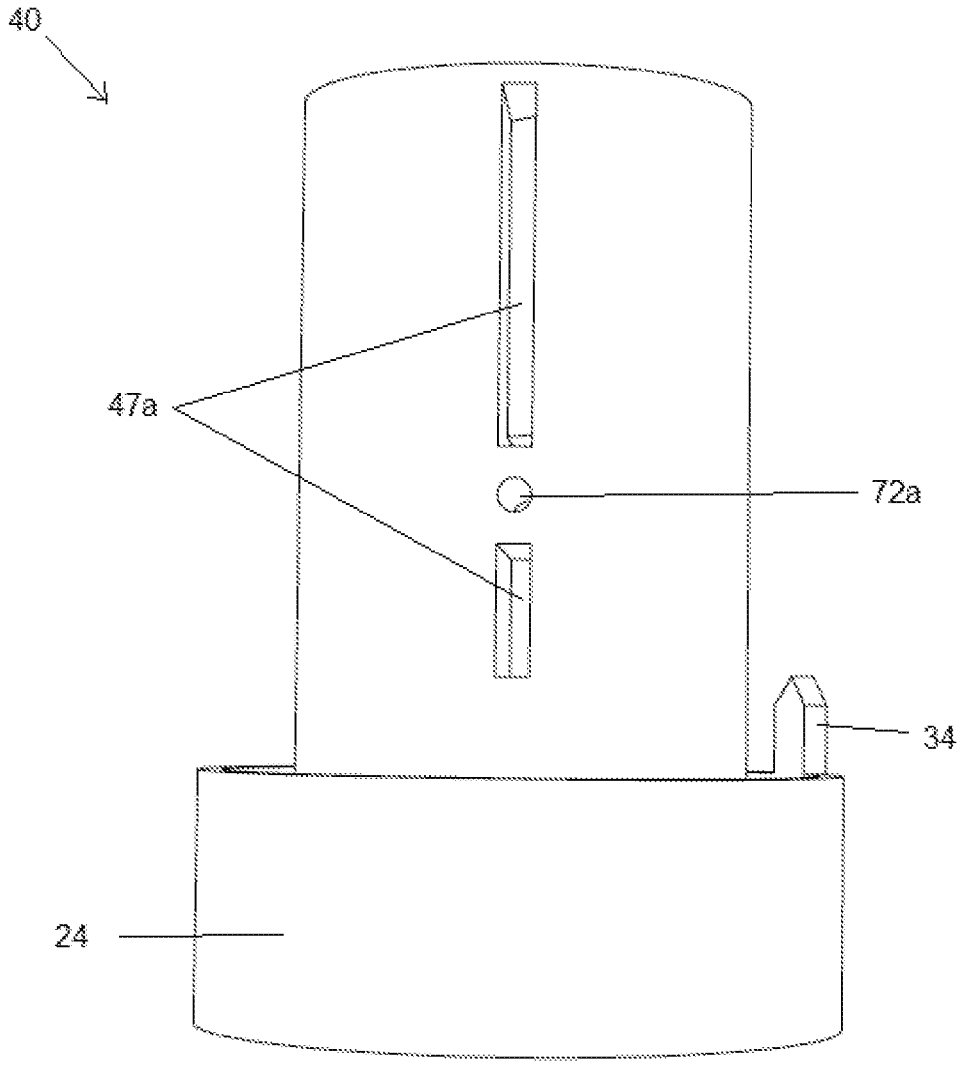
FIG. 12 is an illustration of a side-view of a cylinder of a dual sprayer, in accordance with an example embodiment.

FIG. 12 is an illustration of a side-view of the cylinder 40 of the dual sprayer 10, in accordance with an example embodiment. In particular, FIG. 12 depicts the placement of the "chemical 1" suction channel 72*a* and air return vents 47*a* positioned along the side of the cylinder 40.

Figure 13:
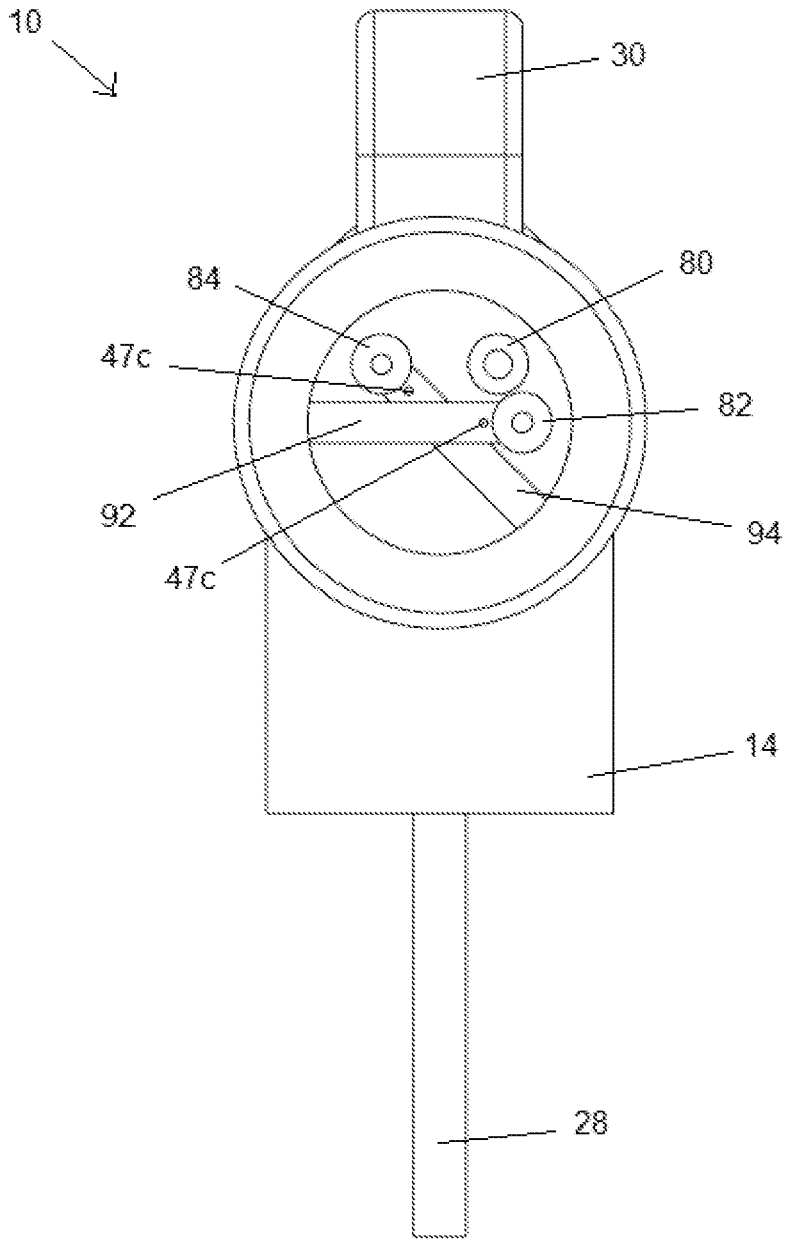
FIG. 13 is an illustration of a discharge end of a dual sprayer, in accordance with an example embodiment.

FIG. 13 is an illustration of a discharge end of the dual sprayer, in accordance with an example embodiment. In particular, FIG. 13 depicts the sprayer 10 in the "off" mode, where the sprayer 10 is unable to discharge either a fluid from the bottle 60, or a working fluid entering from inlet 22. This is because neither the water discharge tube 80, nor the "chemical 1" discharge tube 82 and "chemical 2" discharge tube 84 are aligned with the central passage 50 within the housing (see FIG. 6).

Figure 14:
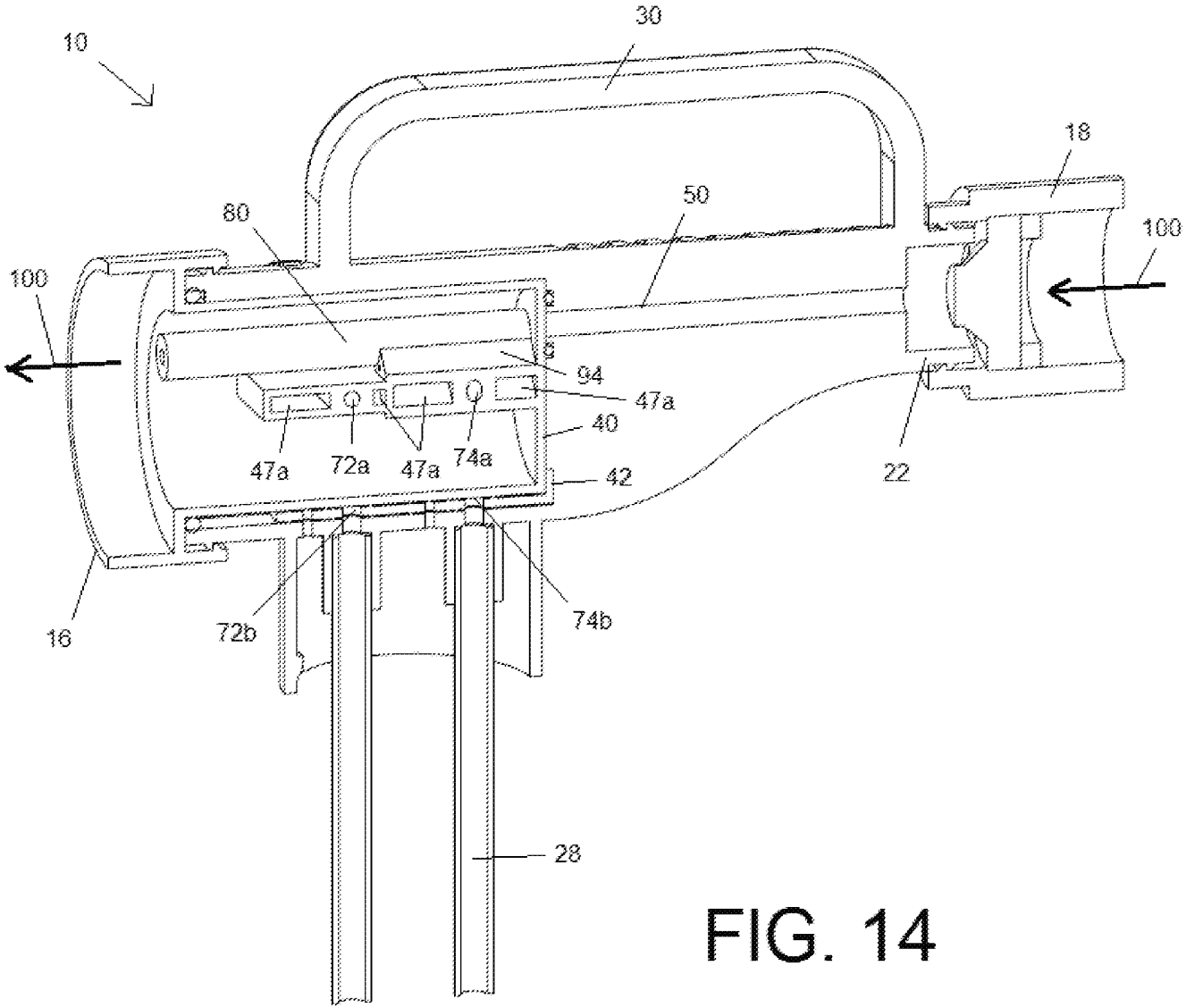
FIG. 14 is an illustration of a cross-section side-view of a dual sprayer in a rinse mode, in accordance with an example embodiment.

FIG. 14 is an illustration of a cross-section side-view of the dual sprayer 10 in a "rinse" mode, in accordance with an example embodiment. Notice that in this mode, the water discharge tube 80 of the cylinder 40 is aligned with the central passage 50 (also shown in FIG. 6), thereby allowing a working fluid 100 to enter the inlet 22 of the sprayer and flow through the sprayer 10 to be discharged at the outlet 16. Notice that in this mode, neither the "chemical 1" suction channel 72*a* nor the "chemical 2" suction channel 74*a* are aligned with the respective "chemical 1"/"chemical 2" ports 72/74*b* (also shown in FIG. 6) that would otherwise allow the sprayer 10 to draw fluid from the suction lines 28.

Figure 15:
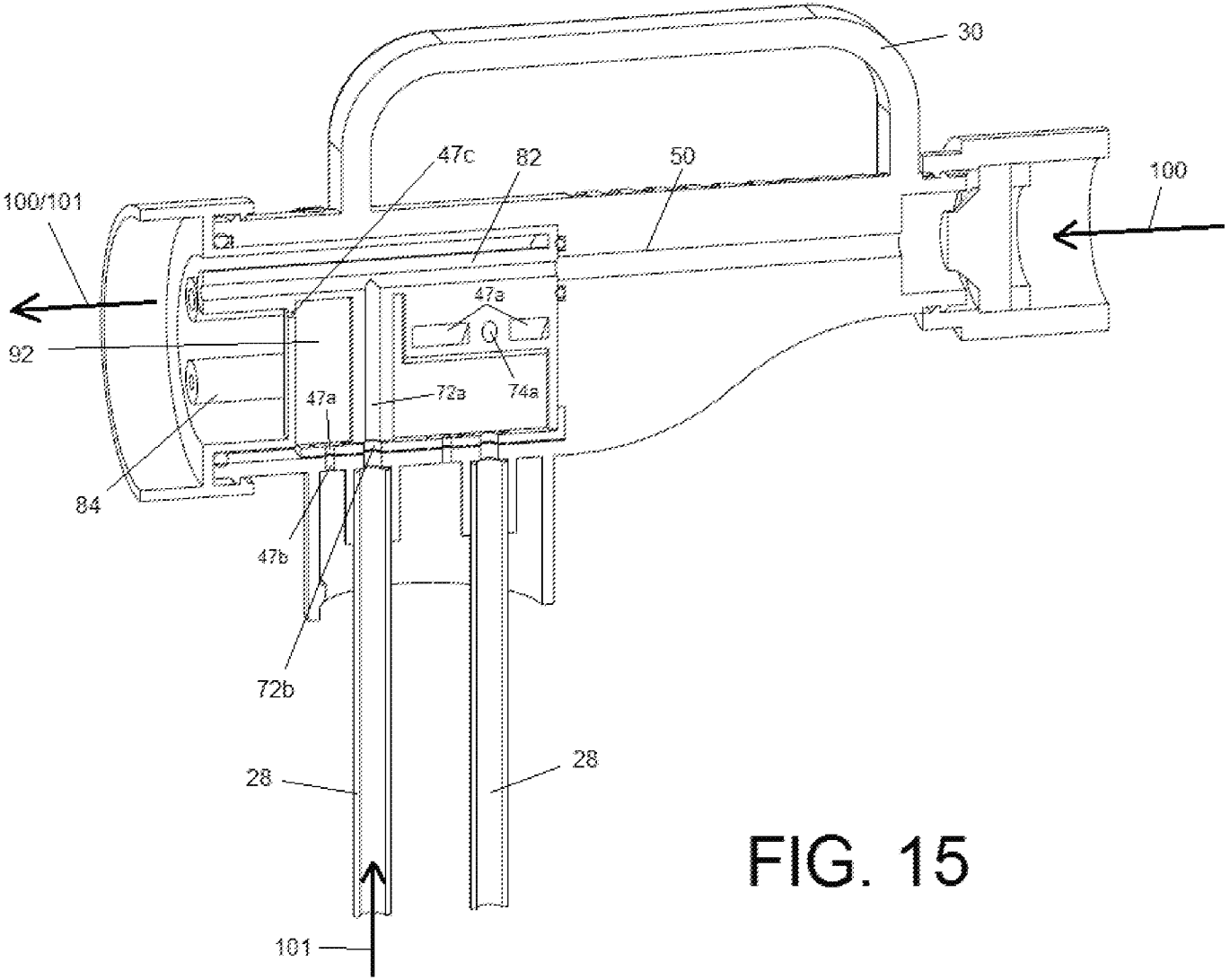
FIG. 15 is an illustration of a cross-section side-view of a dual sprayer discharging a first fluid, in accordance with an example embodiment.

FIG. 15 is an illustration of a cross-section side-view of the dual sprayer 10 discharging a first fluid, in accordance with an example embodiment. Specifically, this drawing depicts a "chem 1" mode, where the "chemical 1" suction channel 72*a* may be aligned with the "chemical 1" discharge tube 82. In this mode, the working fluid 100 may flow through the central passage 50 and the "chemical 1" discharge tube 82, thereby creating a vacuum force (similar to an injector) that allows a fluid 101 to be drawn through one of the suction lines 28 and through "chemical 1" port 72*b* prior to entering "chemical 1" suction channel 72*a* and mixing with the working fluid 100 before being discharged from the sprayer 10. Notice that in this mode, at least one air port 47*b* is aligned with at least one air inlet 47*c* in order to allow a reverse flow of air to travel from air return vent 47*a* into the bottle 60 when the sprayer 10 is locked onto the top of a bottle 60 and the sprayer 10 is in use.

Figure 16:
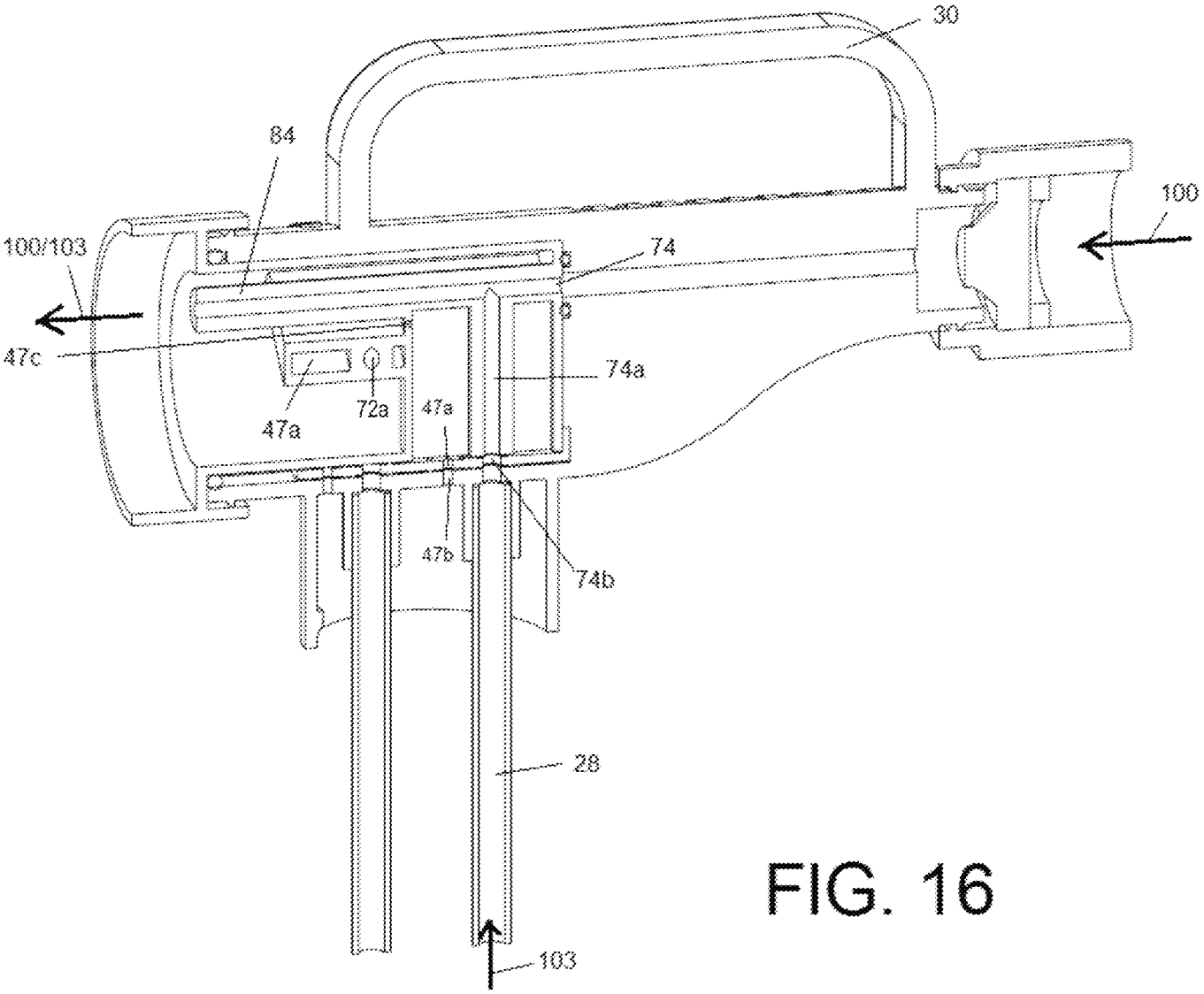
FIG. 16 is an illustration of a cross-section side-view of a dual sprayer discharging a second fluid, in accordance with an example embodiment.

FIG. 16 is an illustration of a cross-section side-view of the dual sprayer 10 discharging a second fluid 103, in accordance with an example embodiment. Specifically, this drawing depicts a "chem 2" mode, where the "chemical 2" suction channel 74*a* may be aligned with the "chemical 2" discharge tube 84. In this mode, the working fluid 100 may flow through the central passage 50 and the "chemical 2" discharge tube 84, thereby creating a vacuum force (similar to an injector) that allows a fluid 103 to be drawn through one of the suction lines 28 and through "chemical 2" port 74*b* prior to entering "chemical 2" suction channel 74*a* and mixing with the working fluid 100 before being discharged from the sprayer 10. Notice that in this mode, at least one air port 47*b* is aligned with at least one air inlet 47*c* in order to allow a reverse flow of air to travel from air return vent 47*a* into the bottle 60 when the sprayer 10 is locked onto the top of a bottle 60 and the sprayer 10 is in use.

Figure 17A:
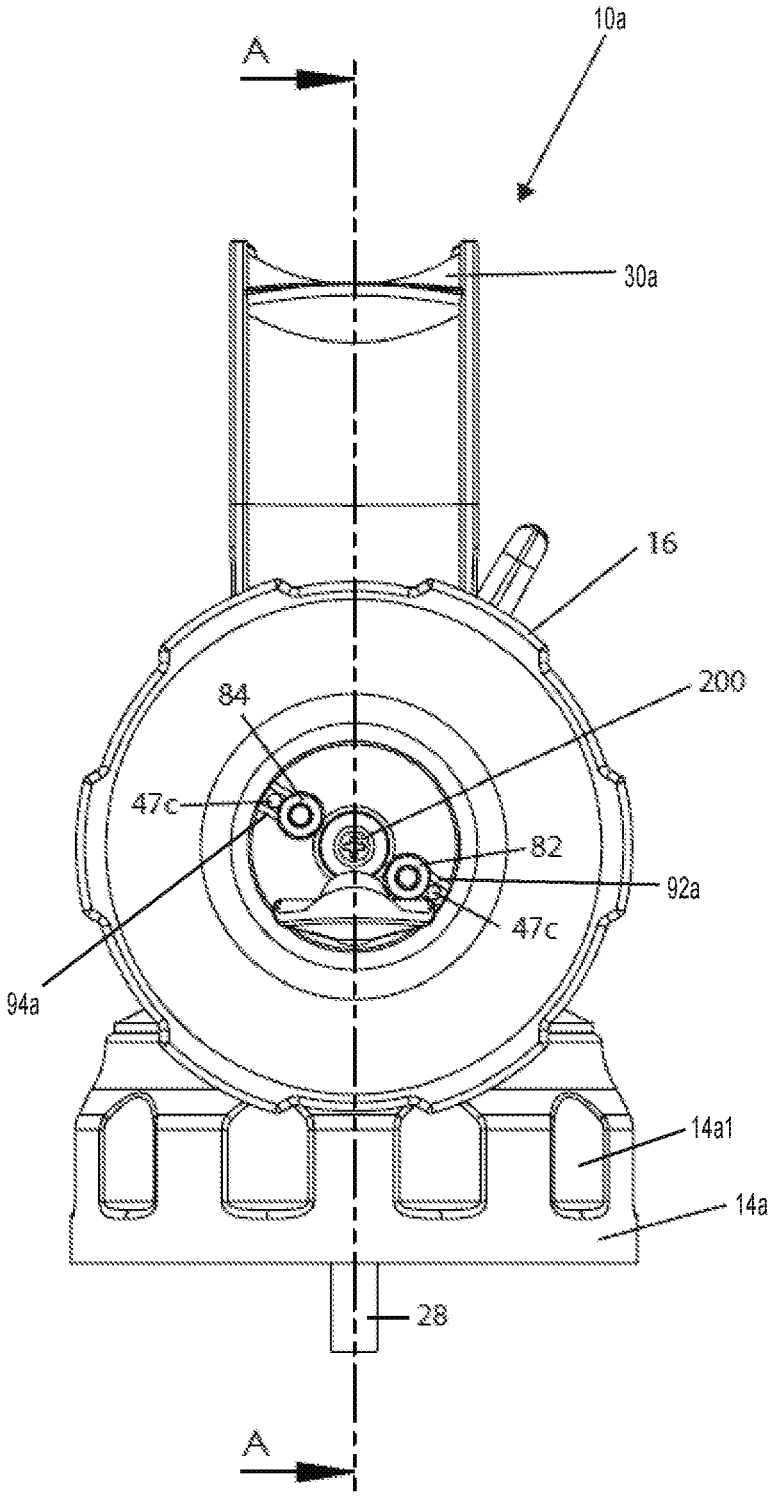
FIG. 17A is an illustration of a discharge end of a dual sprayer with screw connection, in accordance with an example embodiment.
Figure 17B:
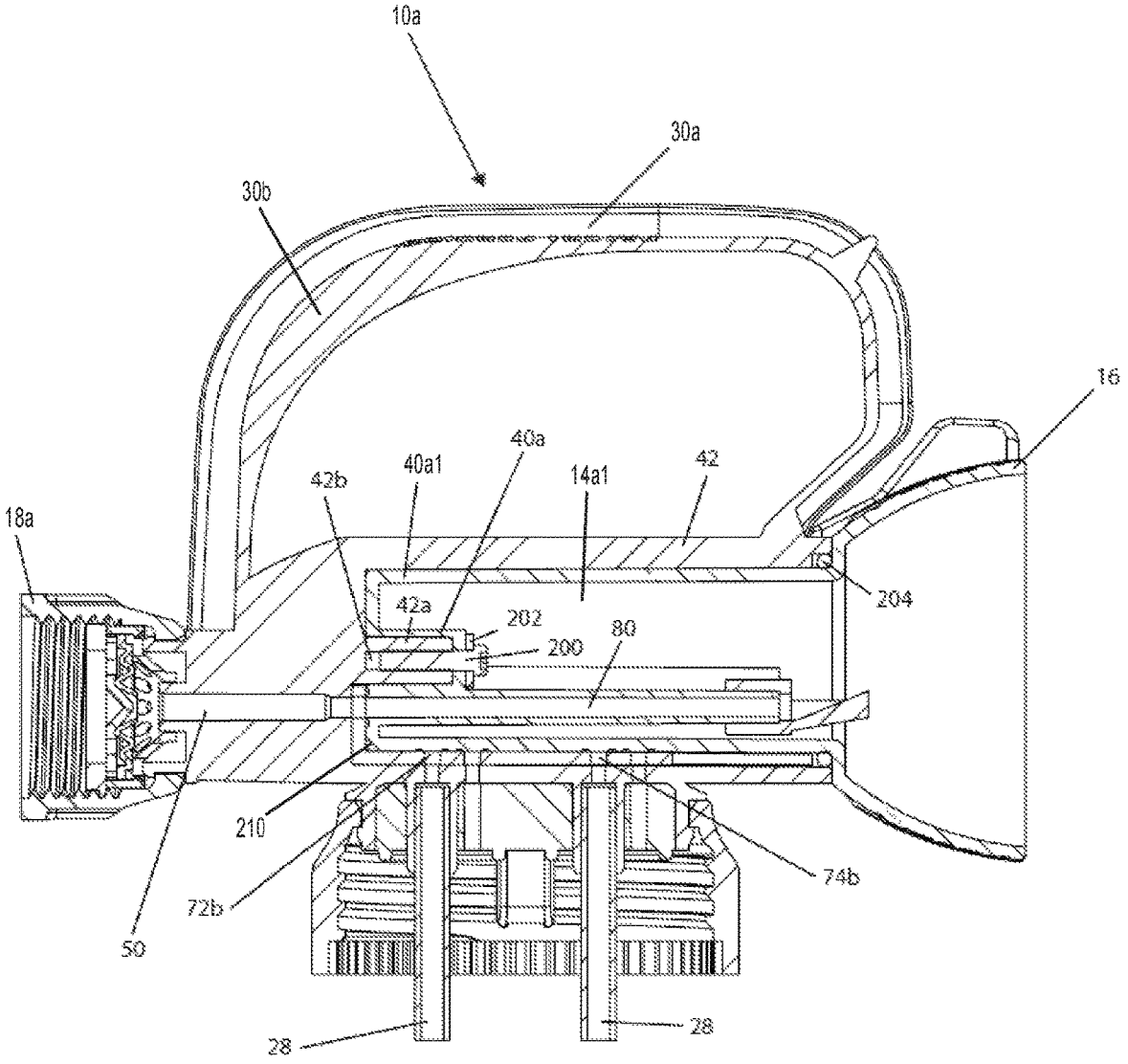
FIG. 17B is an illustration of a cross-section side-view of the dual sprayer with screw connection in a rinse mode, in accordance with an example embodiment.

FIG. 17A is an illustration of a discharge end of a dual sprayer 10*a* with a screw 200 connection (i.e., a screw 200 may be used to connect the cylinder 40*a*1, as also shown in FIG. 17B), in accordance with an example embodiment. This view depicts the sprayer 10 in a "rinse" mode. In this embodiment, the screw 200 may be used to hold the cylinder 40*a*1 within the socket (cavity) 42 of the housing 12 of the sprayer 10. The screw 200 may be positioned to be centrally located within the cylinder 40 in order for the screw 200 to remain stationary as the cylinder 40 may rotate to change modes. Notice that in this embodiment, the "chem 1" suction housing 92*a* and the "chem 2" suction housing 94*a* may be significantly smaller (as compared to the embodiment shown in FIG. 13), in order to accommodate the location for the screw 200.

Figure 20:
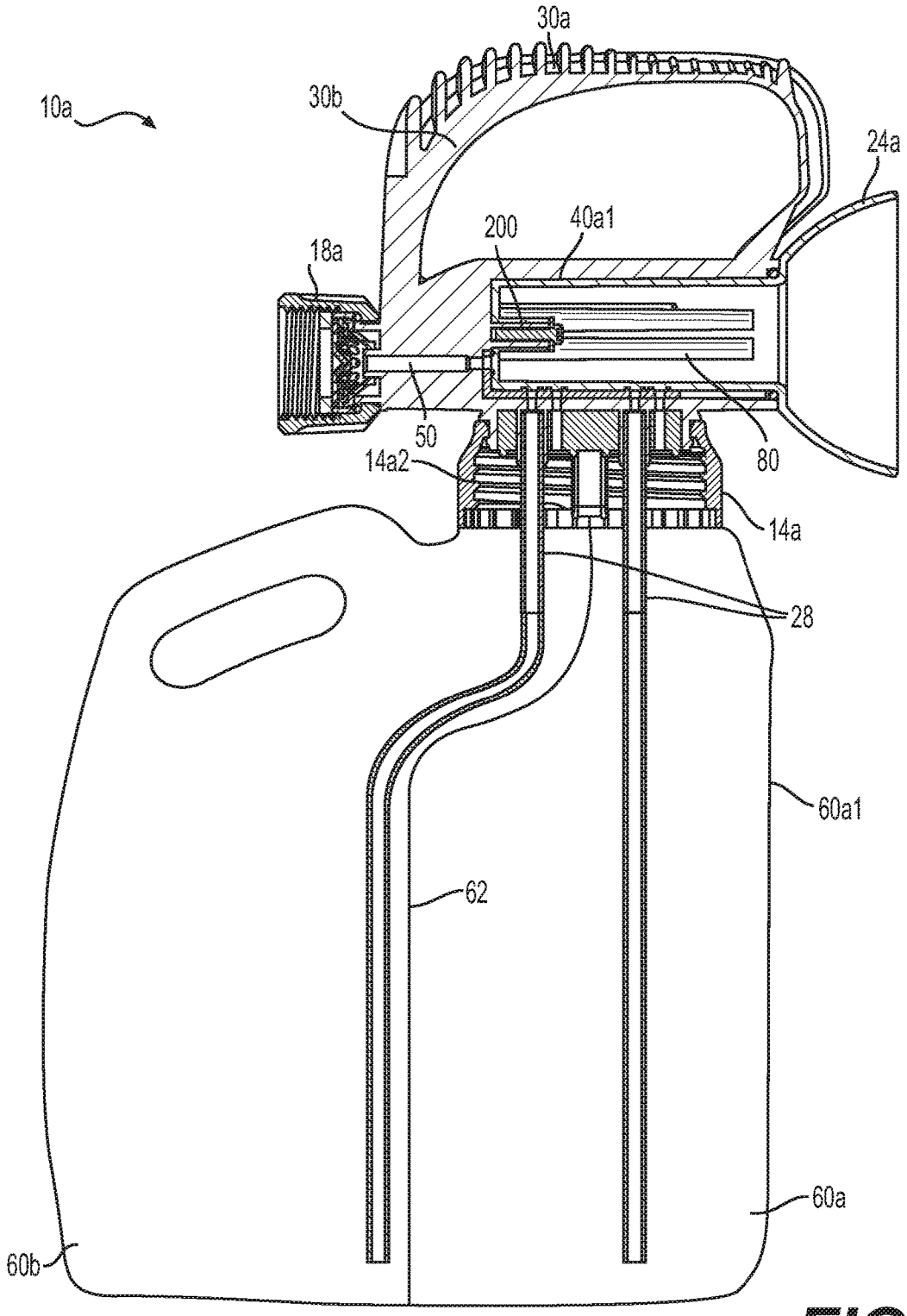
FIG. 20 is an illustration of a cross-sectional side-view of the dual sprayer with screw connection connected to a dual chamber bottle, in accordance with an example embodiment.

In an embodiment, the connector 14*a* may include knurled grooves 14*a*1 to facilitate attachment of the sprayer 10*a* to a bottle (such as the dual chamber bottle 60*a*1 shown in FIG. 20).

FIG. 17B is an illustration of a cross-section side-view of a dual sprayer 10*a* with screw 200 connection in a rinse mode, in accordance with an example embodiment. Reference numbers shown in FIG. 17A (as well as FIGS. 17B-35), that are common to the embodiment shown in FIGS. 1-16, are not all described in detail again, for the sake of brevity. In an embodiment, the socket (chamber) 42 of the housing 12 may include a cylindrical extension 42*a* that may define a screw-hole 42*b*. The screw-hole 42*b* may accept the screw 200. The screw 200 may remain stationary, while the cylinder 40*a*1 is capable of rotating within the socket 42, in order to allow the sprayer 10 to switch between modes. To this end, the cylinder 40*a*1 may include a cylindrically-shaped extension 40*a* that may be conformed to the shape of the cylindrical extension 42*a* of the socket 42. A washer 202 may be positioned between a head of the screw 200 and the cylindrically-shaped extension 40*a* of the cylinder 40 in order to reduce a friction-force between the head of the screw 200 and the distal-end of the extension 40*a*. The screw 200 may represent the lone structure that may be capable and necessary to maintain the cylinder 40 within the socket 42 during assembly and during an operational use of the sprayer 10. Alternatively to a screw 200, the sprayer 10*a* may instead utilize a pin, or an insert, or other structure that may penetrate the cylindrically-shaped extension 40*a* and fit into the hole 42*b* to retain the cylinder 40*a*1 with in the socket 42.

A gasket (o-ring) 204 may be fitted between the end of the cylinder 40*a*1 and the socket 42 (near the outlet 16) in order to reduce potential leakage of the sprayer 10, as the sprayer 10 is in operational use. A seal 210 with penetration holes 210*a* (also shown in FIG. 33) may be positioned at least in part along a lower floor of the socket 42, where the seal 210 may fit between ribs 42*c* (see FIG. 23) and help seal the central passage 50, the air ports 47*b* and the "chem 1/2" ports 72*b*/74*b* from side-leakage within the socket 42. In other words, the seal 210 may reduce leakage between fluid passage holes in the cylinder 40*a*1 and the socket 42.

Notice that the handle 30*a* of the sprayer 10*a* may include a thickened-portion 30*b* of the handle, on the end of the handle that is closer to the adapter 18*a* end of the sprayer 10*a* (i.e., opposite to the outlet 16), to allow a better grip on the sprayer 10*a*, especially when the sprayer 10*a* is in use with high-velocity fluids traveling through the sprayer 10*a*.

Figure 18:
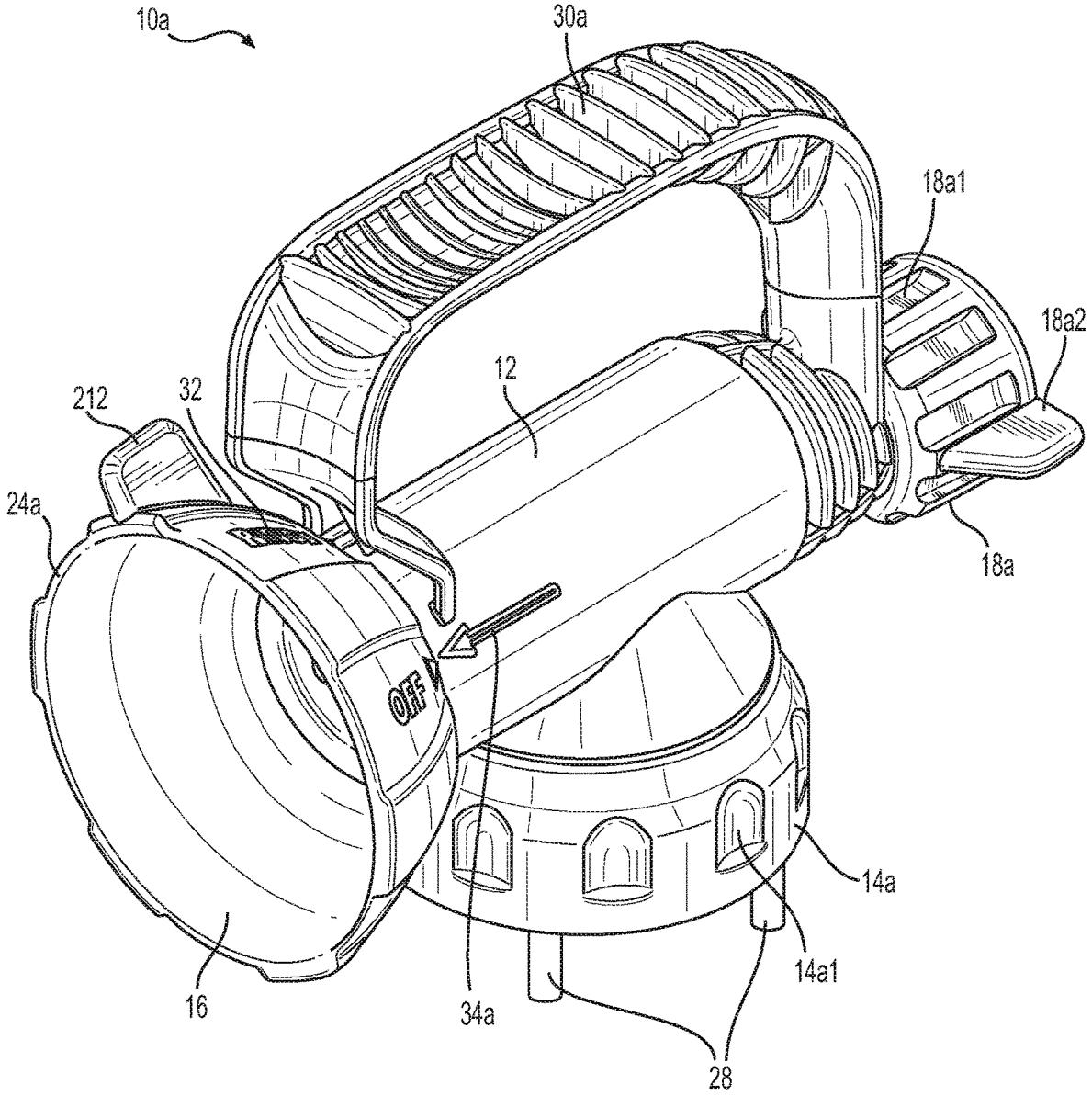
FIG. 18 is an illustration of a perspective view of the dual sprayer with screw connection, in accordance with an example embodiment.

FIG. 18 is an illustration of a perspective view of the dual sprayer with screw connection, in accordance with an example embodiment. In an embodiment, the rotating dial 24*a* may have a flared outlet 16 to provide a greater distribution of fluid exiting the sprayer 10*a*. The rotating dial 24*a* is a discharge connection of the sprayer 10*a* that may include a tab 212 that may facilitate rotation of the dial 24*a*. The adapter 18*a* may include knurled grooves 18*a*1 and tabs 18*a*2 to allow for a better grip on the outer surface of the adapter 18*a* in order to facilitate attachment of the sprayer 10*a* to a working fluid source (such as a garden hose, as an example).

In an embodiment, a marker 34*a* may be included on the housing 12, and may point towards the indicia 32 on the rotating dial 24*a*, in order to indicate the mode of the sprayer 10*a*.

Figure 19:
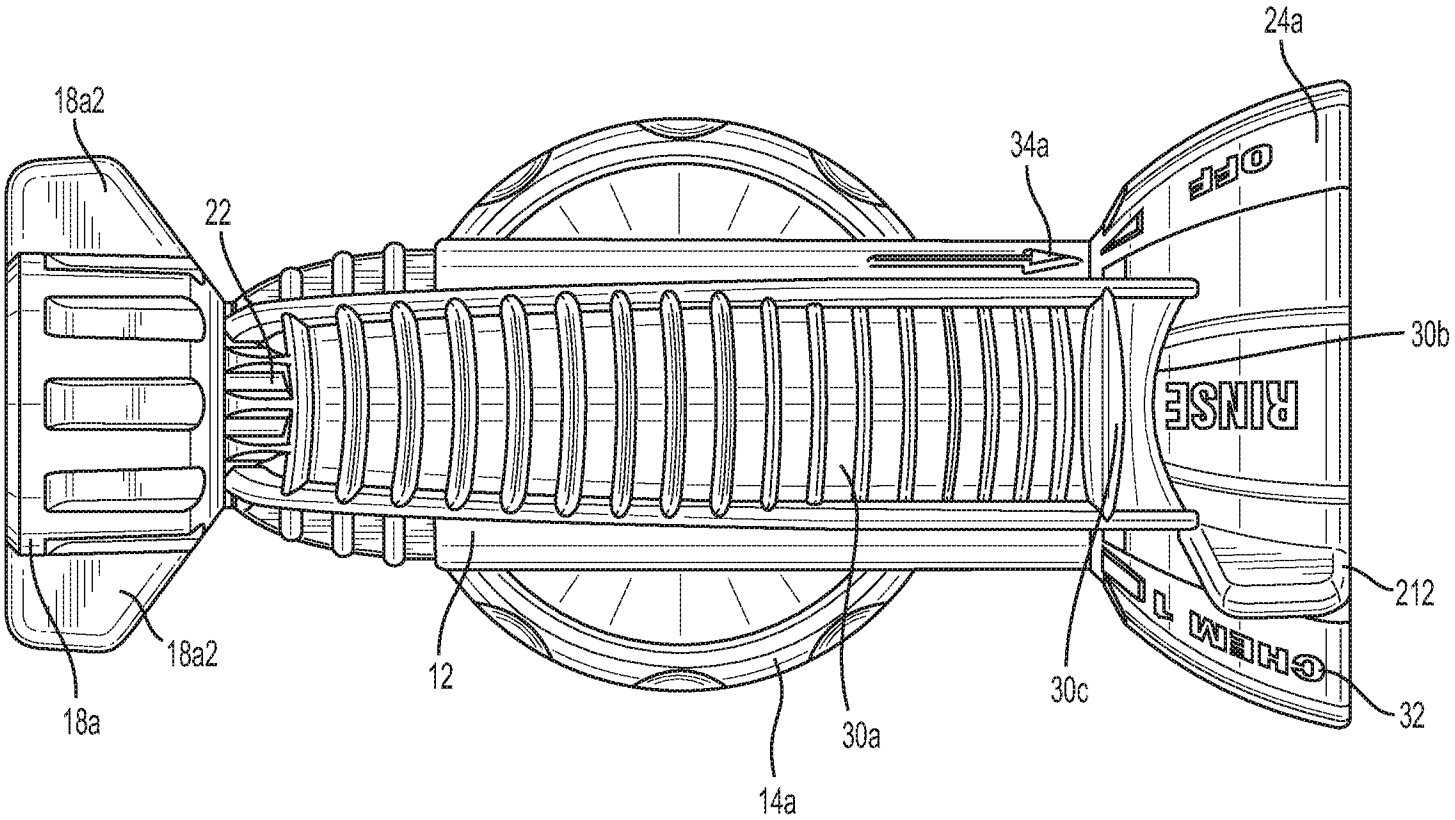
FIG. 19 is an illustration of an overhead view of the dual sprayer with screw connection, in accordance with an example embodiment.

FIG. 19 is an illustration of an overhead view of the dual sprayer with screw connection, in accordance with an example embodiment. In an embodiment, an arcuate indentation (an "impression") 30*b* in the handle 30*a* may be provided (also shown in at least FIG. 23), where the indentation may help a user stabilize their hands on the sprayer (i.e., a user's thumb may be stabilized within the indentation 30*b*). A physical stop 30*c* on the handle 30*a* may also be provided to further assist a user in holding the sprayer 10*a*.

FIG. 20 is an illustration of a cross-sectional side-view of the dual sprayer 10*a* with screw connection connected to a dual chamber bottle 60*a*1, in accordance with an example embodiment. The sprayer 10*a* may be connected to the bottle 60*a*1 via the use of threads 14*a*2 (also shown in FIG. 21) that may mate with threads 64*c*1 on a male connector 64*c* of the bottle (see FIG. 22A).

Figure 21:
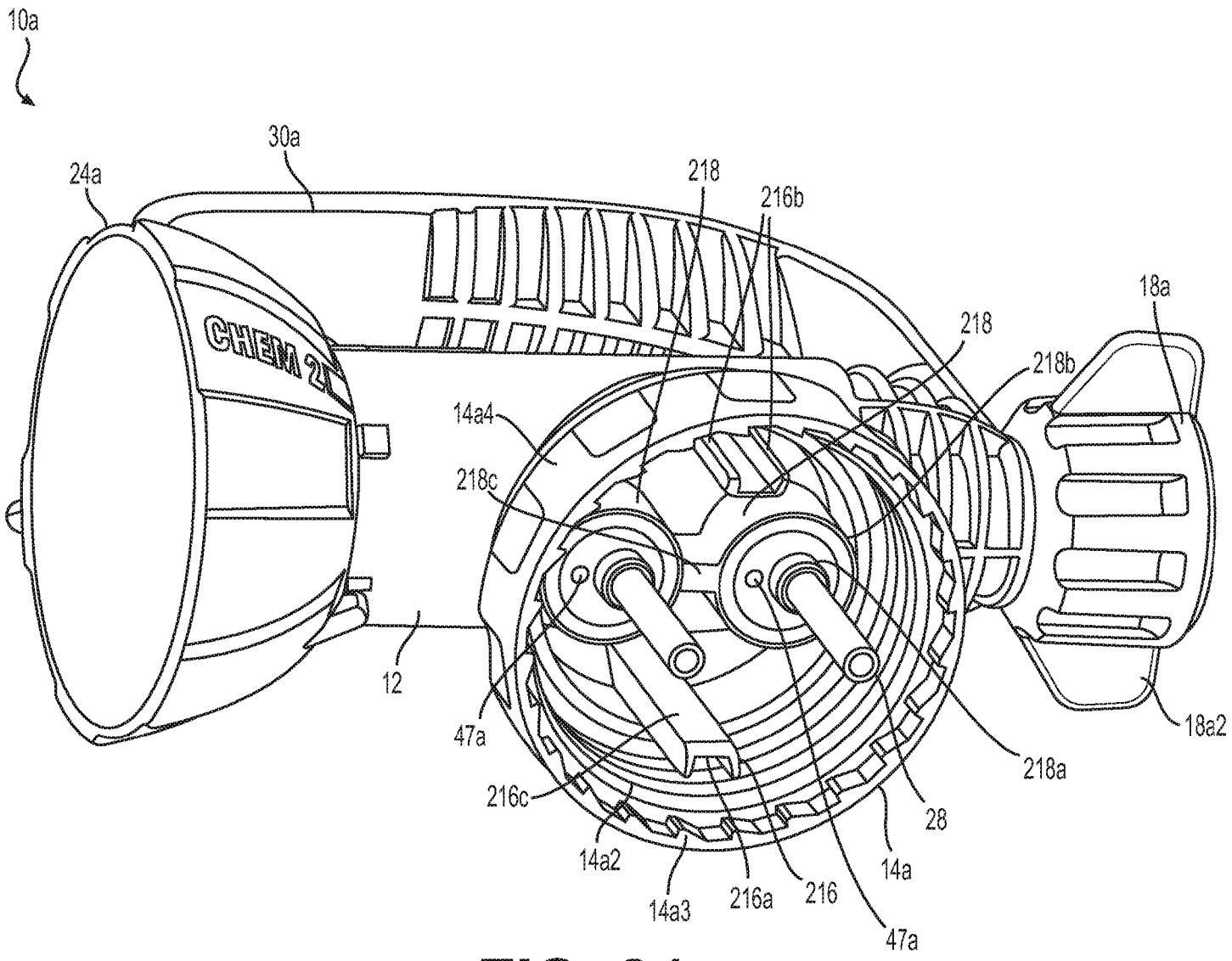
FIG. 21 is an illustration of a perspective view, from a bottom view, of the dual sprayer with screw connection, in accordance with an example embodiment.

FIG. 21 is an illustration of a perspective view, from a bottom view, of the dual sprayer 10*a* with screw connection, in accordance with an example embodiment. The female connector 14*a* may include a housing 14*a*4 (also shown in detail in at least FIG. 30) on a lower portion of the sprayer 10*a*, where an inner surface of the housing 14*a*4 may define threads 14*a*2 that may mate with threads 64*c*1 on the bottle 60*a*1 (see at least FIG. 22A). In an embodiment, a distal end of the connector housing 14*a*4 may include ratchet spurs 14*a*3 that may slide over and become interlocked with locking spurs 64*c*2 (FIG. 22A) on the bottle 60*a*1, in order to fully lock the sprayer 10*a* onto the bottle 60*a*1 to ensure a fully stabilized and secure connection between the sprayer 10*a* and the bottle 601*a*.

A suction line housing 218 may be contained within the connector 14*a*, where the housing 218 may have openings 218*a* for the suction lines (tubes) 28. The suction line housing 218 may include individual cylindrical suction line housings 218*b* for each suction line 28, where the individual cylindrical suction line housings 218*b* may be joined together with a connection piece 218*c*. Each cylindrical suction line housing 218*b* may include an air return port 47*a*, near the opening 218*a* for the suction line 28, that may allow air to enter the bottle 60*a*1 in order to replace a volume of fluid that is discharged from the bottle 60*a*1 during use of the sprayer 10*a*. The suction lines 28 may be in respective communication with the "chem 1" port 72*b* and the "chem 1" port 74*b* within the base of the socket 42 (see FIG. 23).

In an embodiment, vertical extensions 216 may be connected to the inside of the connector 14*a*. The extensions 216 may have outwardly-facing grooves 216*a*, on an outer surfaces of the connectors 216, where the grooves 216*a* may be defined by a lips 216*b* running along the longitudinal length of the vertical extensions 216. The vertical extensions 216 may be positioned on either side of the housing 218 contained within the connector 14*a*.

Figure 22A:
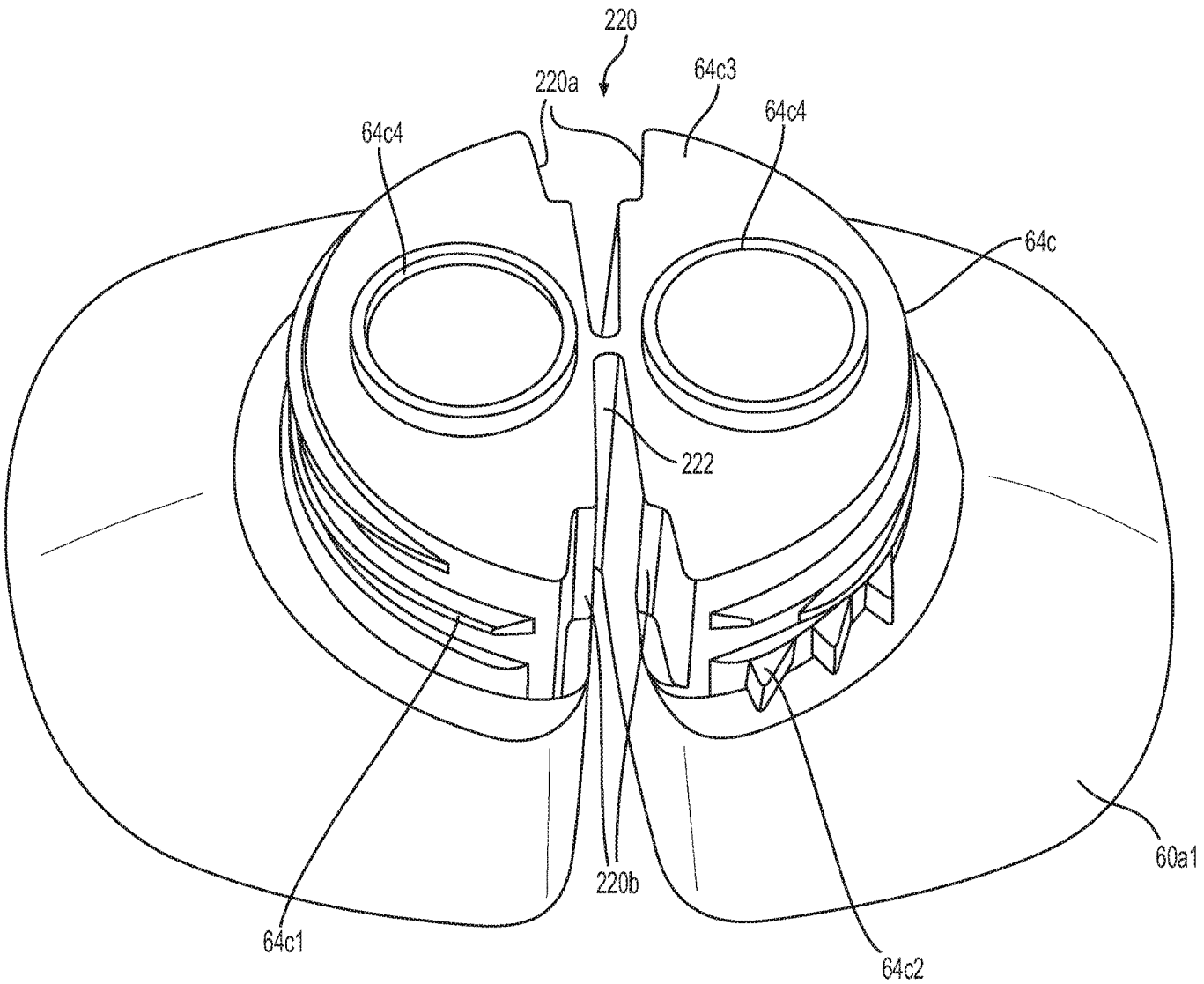
FIG. 22A is an illustration of a male connector at the top of the dual chamber bottle, in accordance with an example embodiment.

FIG. 22A is an illustration of a male connector 64*c* at the top of the dual chamber bottle 60*a*1, in accordance with an example embodiment. The connector 64*c* may include a flat upper surface 64*c*3 that includes two ports 64*c*4, where the ports 64*c*4 may be capable of accepting the suction lines 28 from the sprayer 10*a*. The connector 64*c* may define cut-outs 220, where the cut-outs 220 may include gradually-sloping sidewalls 220*a*. The connector may further define slits 222 (also shown in FIG. 22B), that also include gradually-sloping sidewalls 222*a*, where the slits 222 open into the cut-out 220 portion of the connector 64*c*.

The sprayer 10*a* may attach to the connector 64*c* of the bottle 60*a*1 by first inserting the suction lines 28 into the ports 64*c*4 of the connector 64*c*, and then second aligning the vertical extensions 216 within the cutouts 220, so that the lips 216*b* of the extensions 216 can mate with the sloping sidewalls 220*a* of the cutouts 220. The lips 216*b* of the extensions 216 may be outwardly-flared (i.e., flared in an outward direction relative to an imaginary centerline that runs through a longitudinal length of the housing 14*a*4 of the connector 14*a*) to conform the lips 216*b* to the slightly-sloped sidewalls 220*a* of the cutouts 220. A back-wall 216*c* of the extensions 216 (see FIG. 21) may then contact the end-walls 220*b* of the cut-outs 220 to firmly secure the extensions 216 within the cut-outs 220. Once the extensions 216 are firmly secured within the cut-outs 220, the threads 14*a*2 of the connector 14*a* may then be rotated onto the threads 64*c*1 of the connectors 64*c* without the suction lines 28 contacting or being damaged by the walls of ports 64*c*4. In order to facilitate this attachment of the sprayer connector 14*a* to the connector 64*c* of the bottle 60*a*1, it is also important to note that the connector housing 14*a*4 must be freely-rotatable on the bottom of the house 12 (see FIG. 30 and the associated description below), whereas the suction housing 218, vertical extensions 216 and the suction lines 28 shall remain stationary relative to the sprayer housing 12 (i.e., the suction housing 218, the vertical extensions 216, and the suction lines 28 do not rotate with the connector housing 14*a*).

Figure 22B:
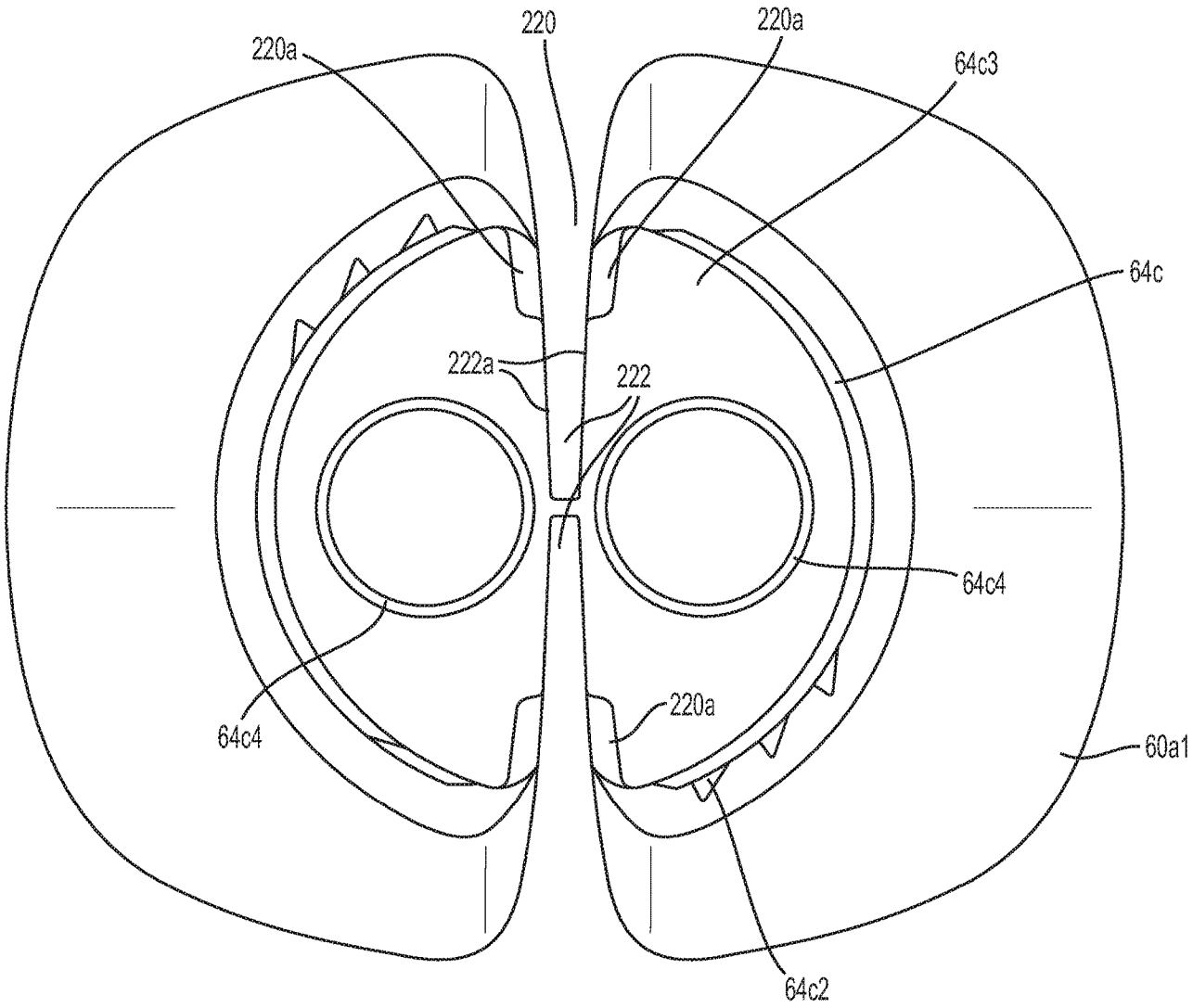
FIG. 22B is an illustration of an overhead view of the male connector at the top of the dual chamber bottle, in accordance with an example embodiment.

FIG. 22B is an illustration of an overhead view of the male connector 64*c* at the top of the dual chamber bottle 60*a*1, in accordance with an example embodiment. From this perspective, the gradual slope of the side-walls 220*a* of the cut-outs 220, and the gradual slope of the side-walls 222*a* of the slits 222, can be seen in better detail.

Figure 23:
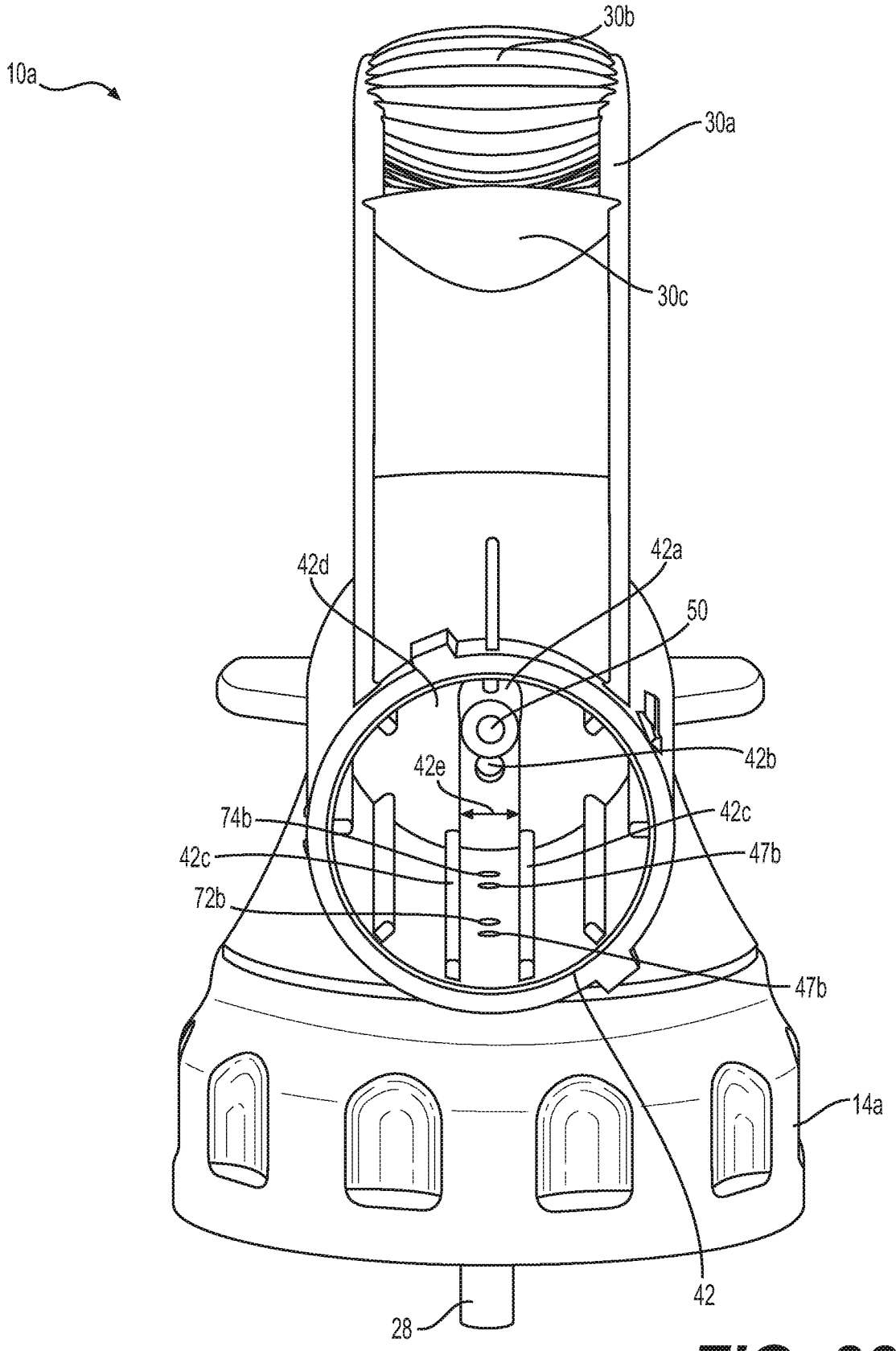
FIG. 23 is an illustration of internals of a main housing of the dual sprayer with screw connection, in accordance with an example embodiment.

FIG. 23 is an illustration of internals of a main housing of the dual sprayer 10*a* with screw connection, in accordance with an example embodiment. The screw hole 42*b* may be centered on the back-wall 42*d* of the socket 42. The central passage 50 is positioned to be adjacent to the screw hole 42*b*. Ribs 42*c* may be positioned lengthwise along the interior of the socket 42, where the ribs 42*c* allow the cylinder 40*a*1 to rotate within the socket 42. A groove 42*e* on the back-wall 42*d* of the socket 42, and the lowest pair of ribs 42*c*, may accept the seal 210 (see FIGS. 17B and 30), and hold the seal 210 in place during use of the sprayer 10*a*.

Figure 24:
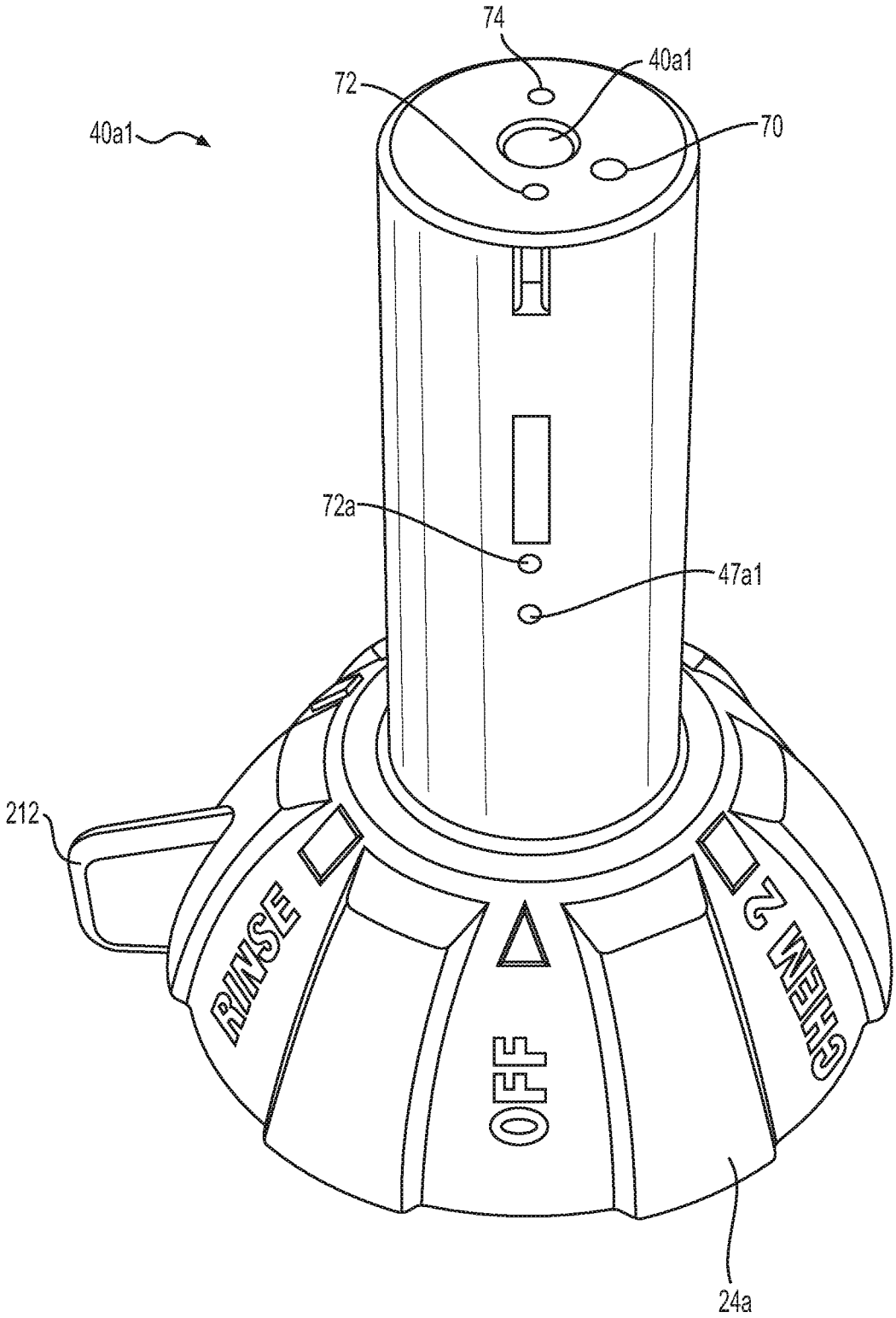
FIG. 24 is an illustration of an end-view of a cylinder of the dual sprayer with screw connection, in accordance with an example embodiment.

FIG. 24 is an illustration of an end-view of the cylinder 40*a*1 of the dual sprayer 10*a* with screw connection, in accordance with an example embodiment. The "chem 1" suction channel 72*a* is in fluid communication with the "chem 1" port 72 on an end of the cylinder 40*a*1. In a "chem 1" discharge mode (shown in FIG. 31), the "chem 1" suction channel 72*a* is also in fluid communication with the "chem 1" port 72*b* (see FIGS. 23 and 31)—while the air return vent 47*a*1 is in fluid communication with both the air port (FIGS. 23 and 31) and the air inlets 47*c* (FIG. 17*a*).

Figure 28:
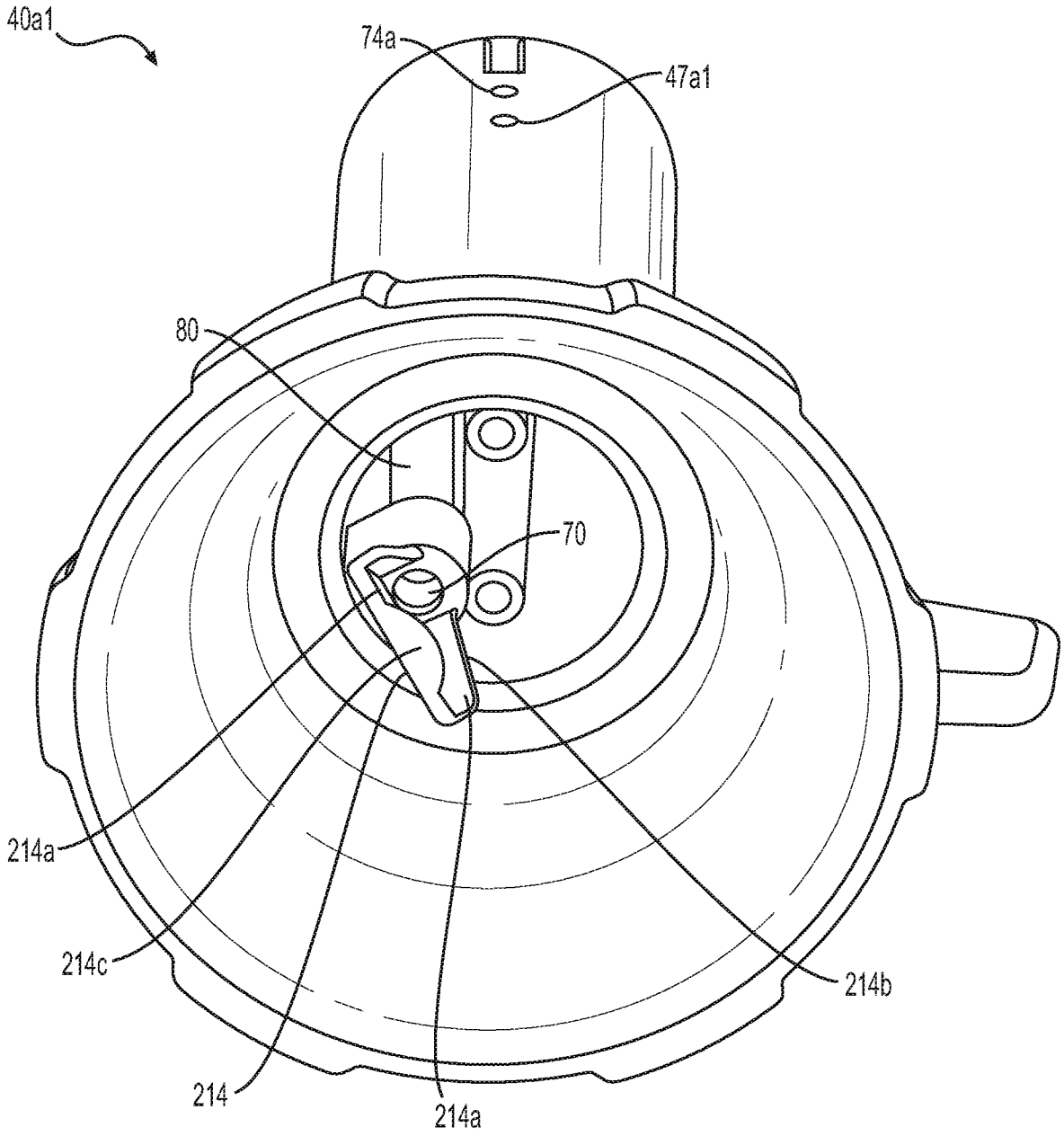
FIG. 28 is an illustration of another end-view of the cylinder of the dual sprayer with screw connection, in accordance with an example embodiment.

The water discharge line/port 70 is in fluid communication with the water discharge tube 80 (FIG. 28). From this perspective, the screw hole 40*a*1 can be seen centered on an end of the cylinder 40*a*1.

Figure 25:
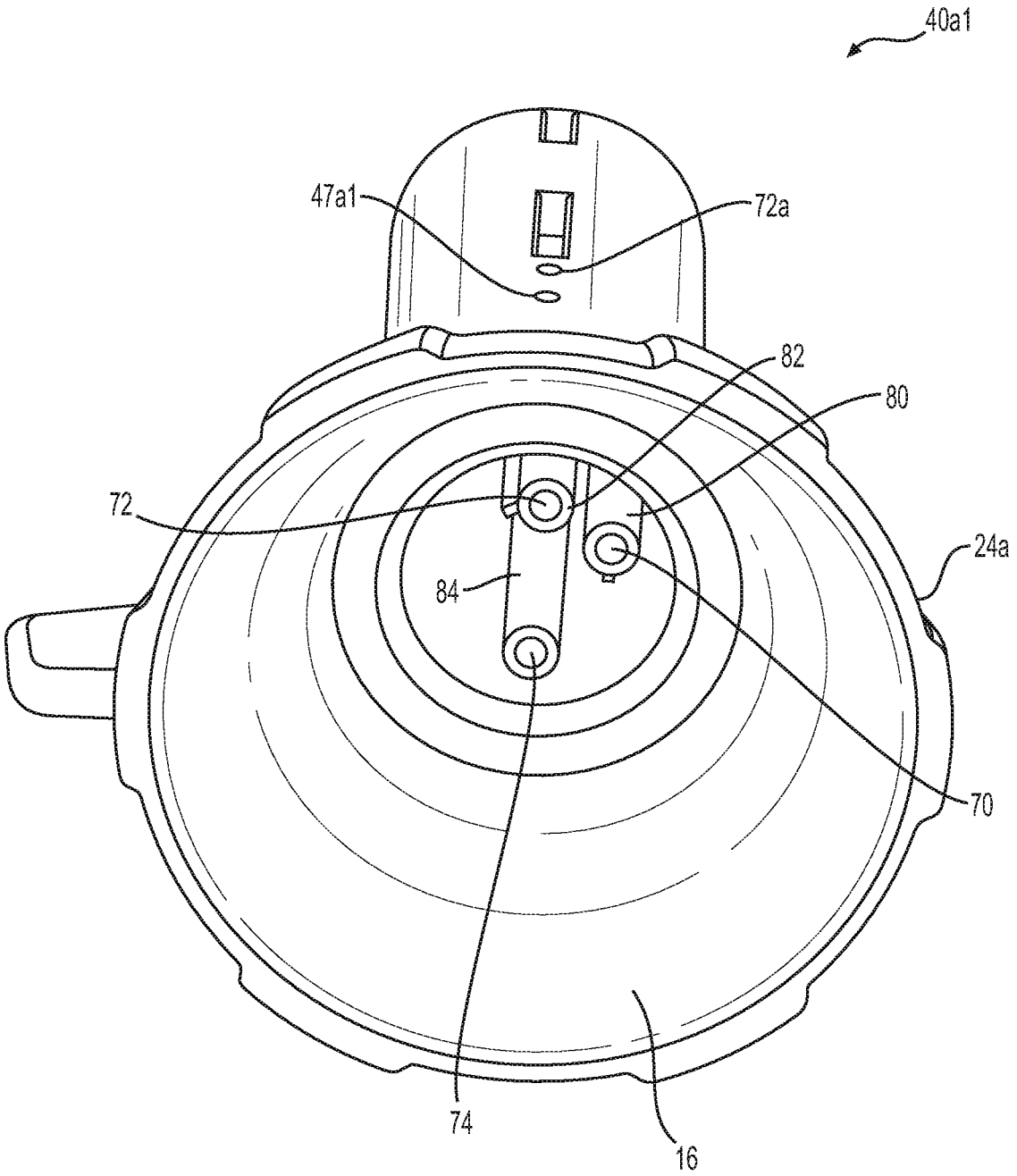
FIG. 25 is an illustration of another end-view of the cylinder of the dual sprayer with screw connection, in accordance with an example embodiment.

FIG. 25 is an illustration of another end-view of the cylinder 40*a*1 of the dual sprayer with screw connection, in accordance with an example embodiment. The "chem 1" suction channel 72*a* is in fluid communication with the "chem 1" port 72.

Figure 26:
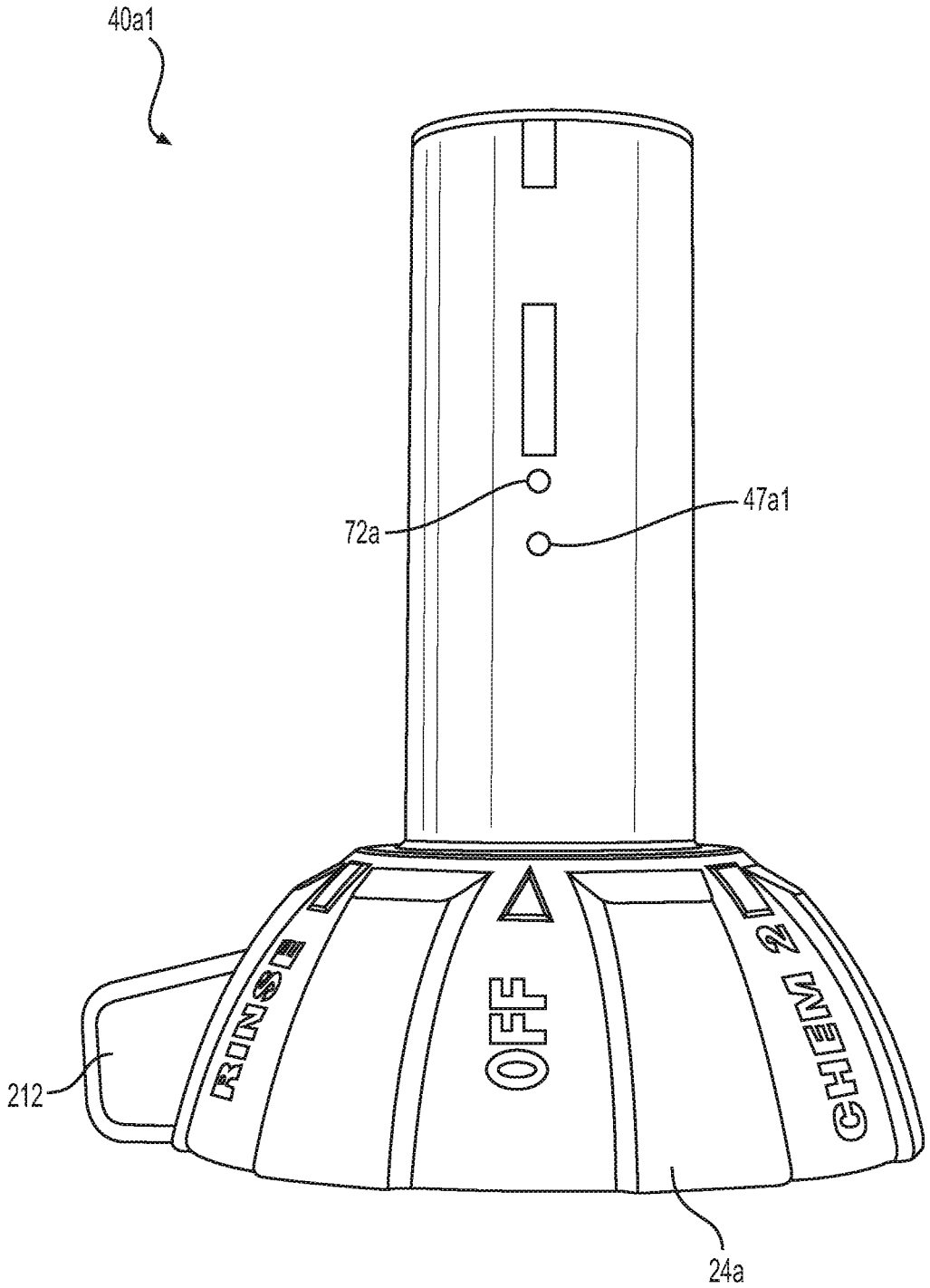
FIG. 26 is an illustration of a side-view of the cylinder of the dual sprayer with screw connection, in accordance with an example embodiment.

FIG. 26 is an illustration of a side-view of the cylinder 40*a*1 of the dual sprayer 10*a* with screw connection, in accordance with an example embodiment. From this perspective, the spacing of the air return vent 47*a*1 and "chem 1" suction channel 72*a* along a central portion of the longitudinal length of the cylinder 40*a*1 can be seen.

Figure 27:
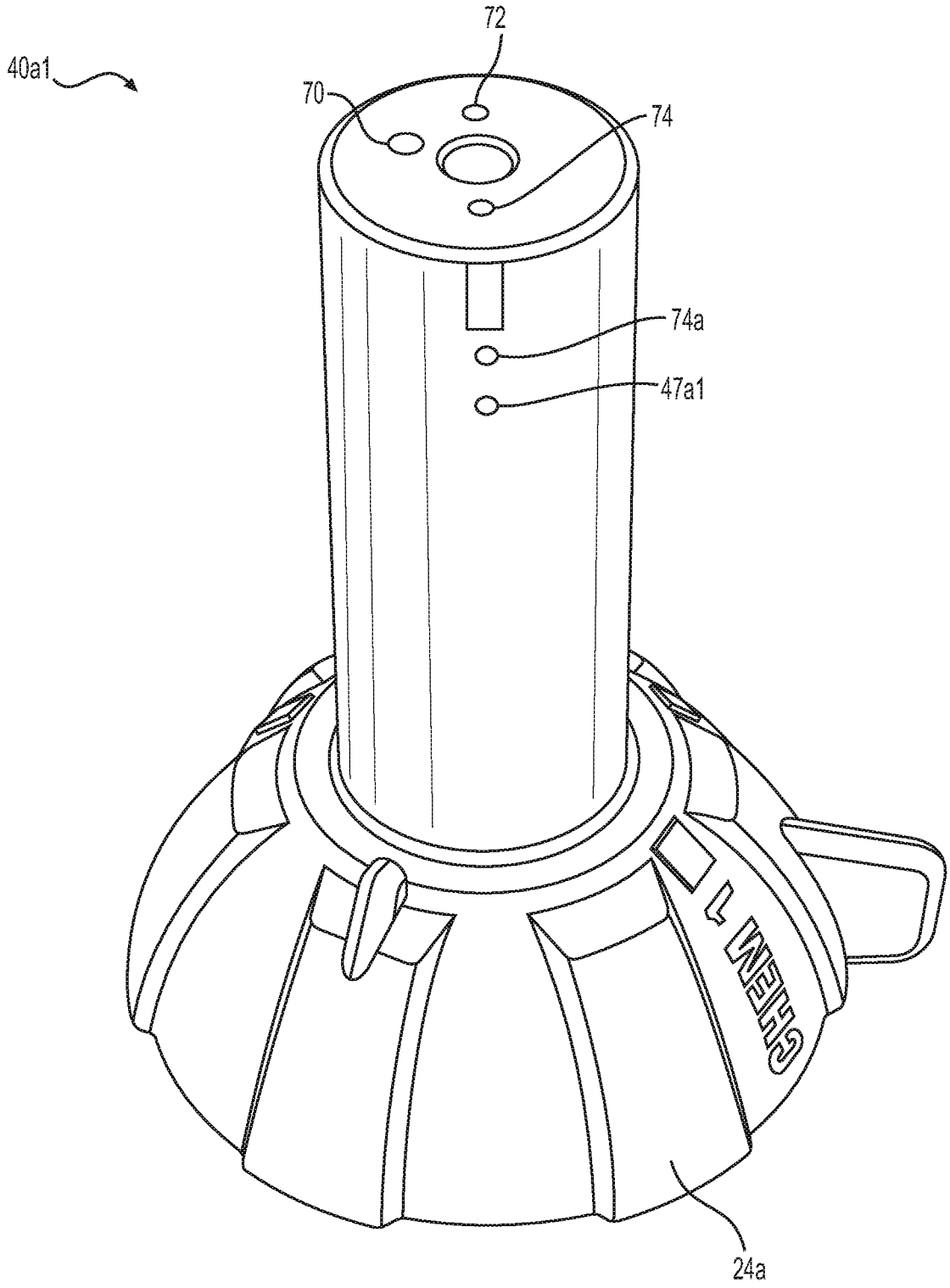
FIG. 27 is an illustration of an end-view of the cylinder of the dual sprayer with screw connection, in accordance with an example embodiment.

FIG. 27 is an illustration of an end-view of the cylinder 40*a*1 of the dual sprayer 10*a* with screw connection, in accordance with an example embodiment. The "chem 2" suction channel 74*a* is in fluid communication with the "chem 2" discharge line/port 74. In a "chem 2" discharge mode (shown in FIG. 32), the "chem 2" suction channel 74*a* is also in fluid communication with the "chem 2 port" 74*b* (see FIGS. 23 and 32)—while the air return vent 47*a*1 is in fluid communication with both the air port (FIGS. 23 and 32) and the air inlets 47*c* (FIG. 17A).

FIG. 28 is an illustration of another end-view of the cylinder 40*a*1 of the dual sprayer with screw connection, in accordance with an example embodiment. In an embodiment, a diverter 214 may optionally be connected to an end of the water discharge tube 80, in order to increase a coverage area of fluid being discharged by the sprayer 10*a*. From this perspective, the end of the diverter 214 is shown—where the diverter 214 may include two diverging channels 214*a* that are at least partially defined by the diverter sidewalls 214*b* and a backstop 214*c*. The backstop 214*c* may be positioned at the center of the diverter 214, causing fluid being discharged from water discharge line 70 to contact the backstop 214*c* and be deflected through the channels 214*a*.

Figure 29:
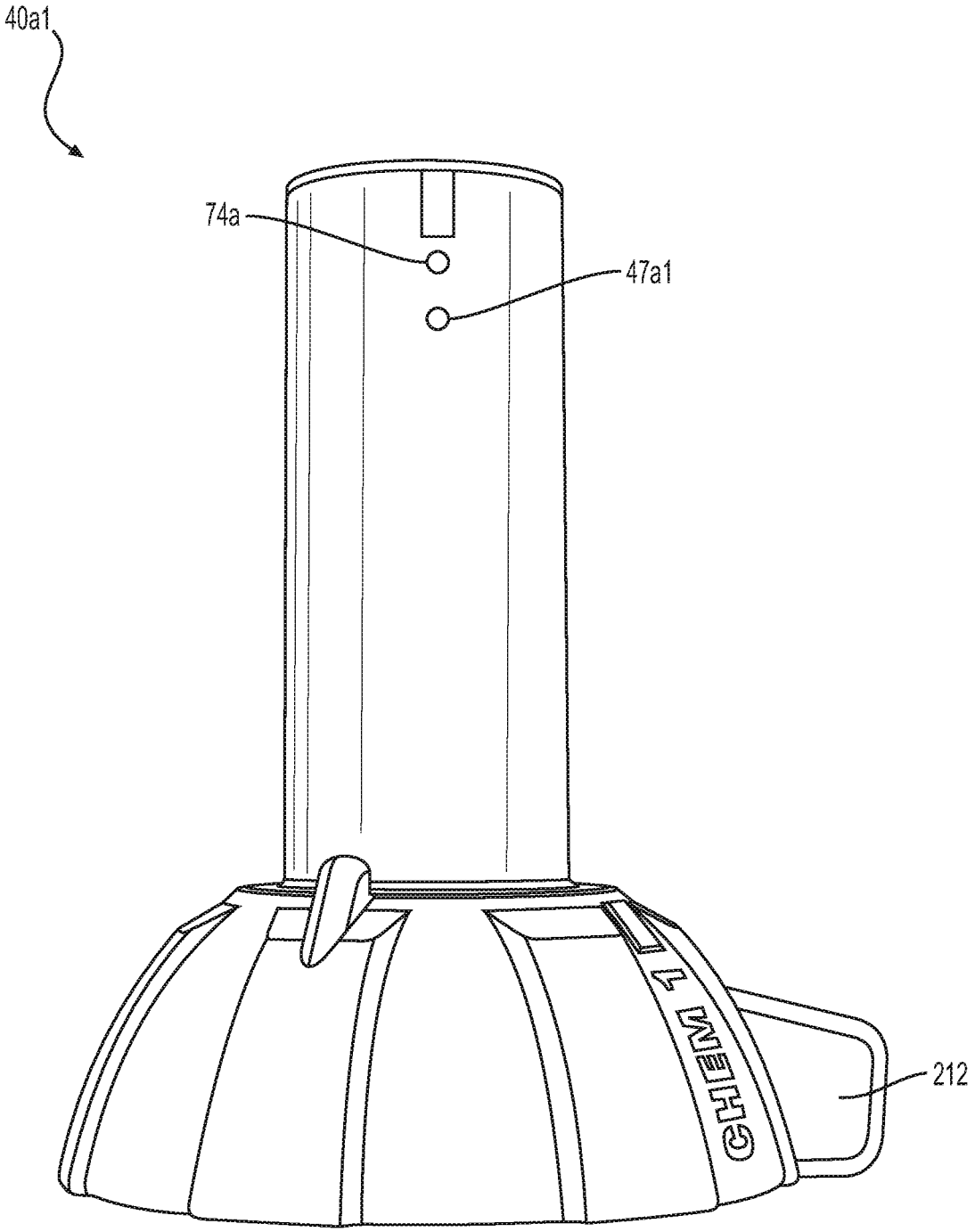
FIG. 29 is an illustration of a side-view of the cylinder of the dual sprayer with screw connection, in accordance with an example embodiment.

FIG. 29 is an illustration of a side-view of the cylinder 40*a*1 of the dual sprayer with screw connection, in accordance with an example embodiment. This perspective shows the spacing of the "chem 2" suction 74*a* and the air return vent 47*a*1 along the longitudinal length of the cylinder 40*a*1.

Figure 30:
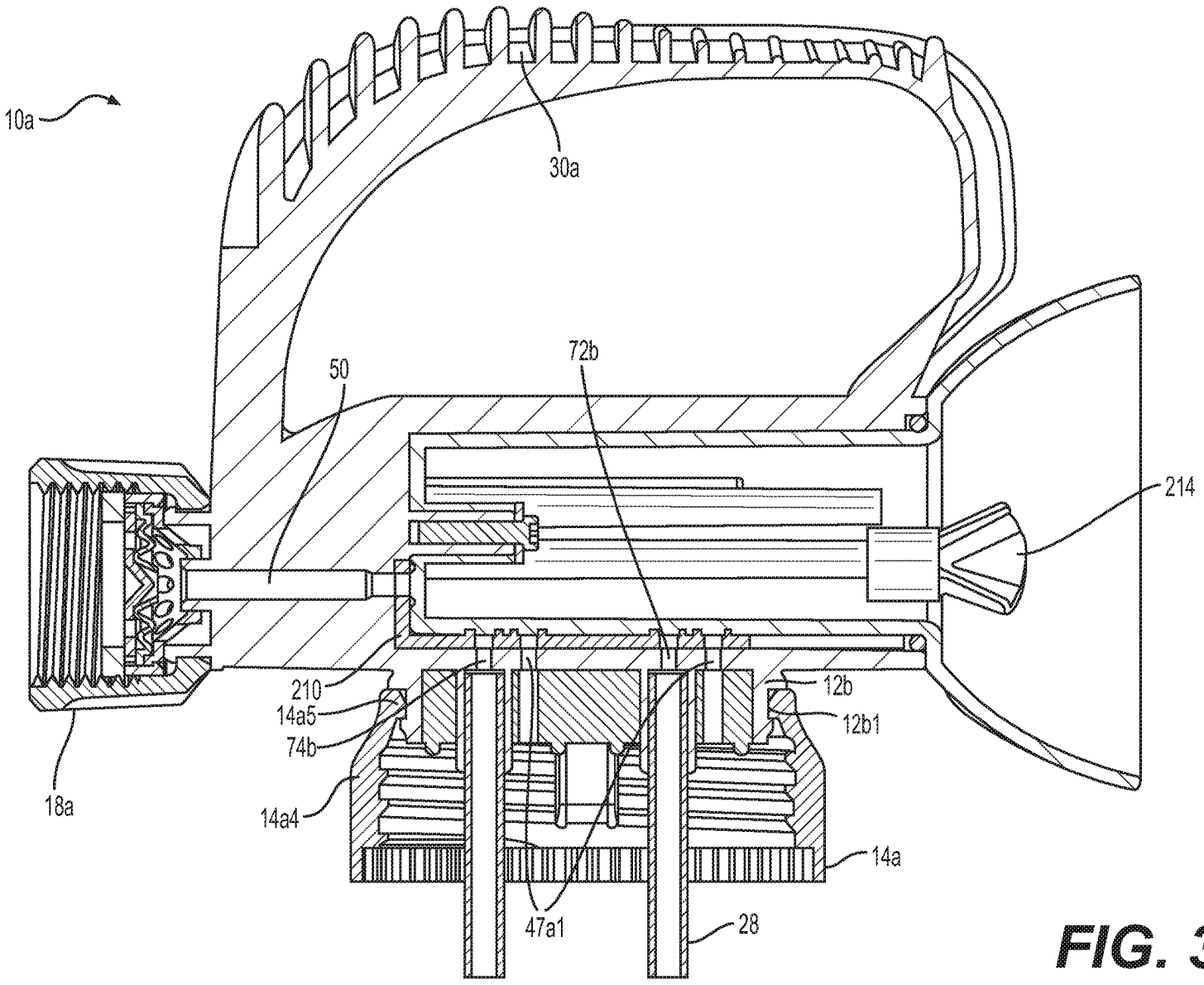
FIG. 30 is an illustration of a cross-section side-view of the dual sprayer with screw connection in an "off" mode, in accordance with an example embodiment.

FIG. 30 is an illustration of a cross-section side-view of the dual sprayer 10*a* with screw connection in an "off" mode, in accordance with an example embodiment. In this mode, neither the water discharge line 70, nor the "chem 1/2" discharge lines 72/74 of the cylinder 40*a*1 (shown in at least FIG. 27) are aligned with the central passage 50. Therefore, in this mode, the sprayer 10*a* is not capable of discharging any fluid.

The housing 14*a*4 of the female connector 14*a* may be somewhat cylindrical in shape, and may rotate on the bottom of the housing of the sprayer 12. In an embodiment, the rotation may be accomplished with an annular rib 14*a*5 on an inner surface of the housing 14*a*4 being fitted into an annular groove 12*b*1 defined by an outer surface of an annular extension 12*b* positioned on the bottom of the housing 12 of the sprayer 10*a*. The free-rotation of the connector housing 14*a*4 allows the connector 14*a* to be fitted onto the connector 64*c* of the bottle 60*a*1 (see FIG. 22A), while the suction line 28, the extensions 216 and the housing 218 (FIG. 21) contained within the connector housing 14*a*4 remain stationary and aligned with the respective ports 64*c*4 and cut-outs 220 (FIG. 22A) on the top of the connector 64*c*.

Figure 31:
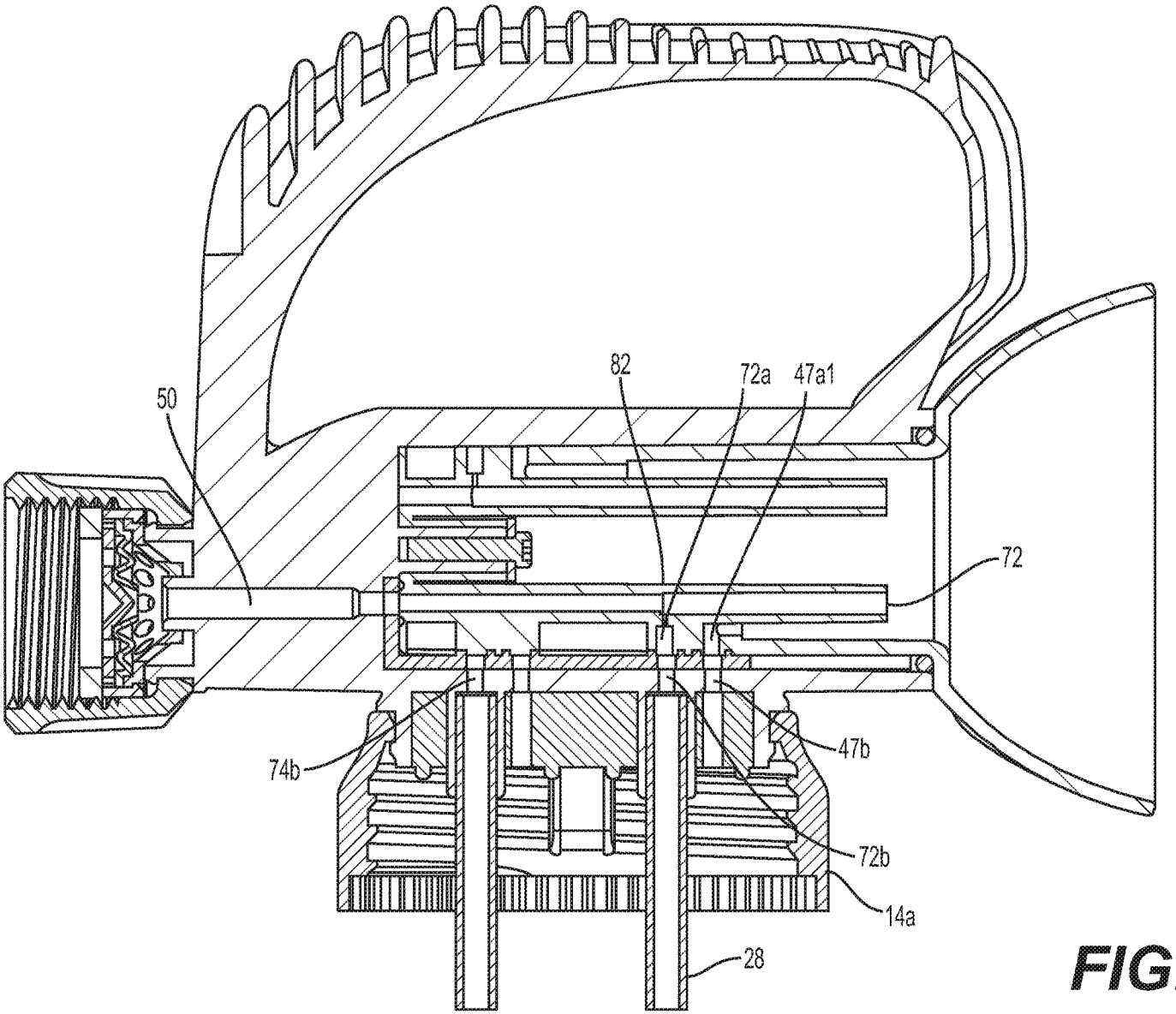
FIG. 31 is an illustration of a cross-section side-view of the dual sprayer with screw connection discharging a first fluid, in accordance with an example embodiment.

FIG. 31 is an illustration of a cross-section side-view of the dual sprayer 10 with screw connection discharging a first ("chem 1") fluid, in accordance with an example embodiment. In this mode, the central passage 50 is aligned with the "chem 1" discharge line 72 (see FIG. 27) and the "chem 1" discharge tube 82 (see FIG. 25)—where a working fluid flowing through the central passage 50 and "chem 1" discharge tube 82 also causes a suction force to draw fluid through suction line 28 (via "chemical 1" suction channel 72*a* and "chemical 1" port 72*b*) in order to discharge a fluid from the bottle 60*a*1 along with the working fluid.

Figure 32:
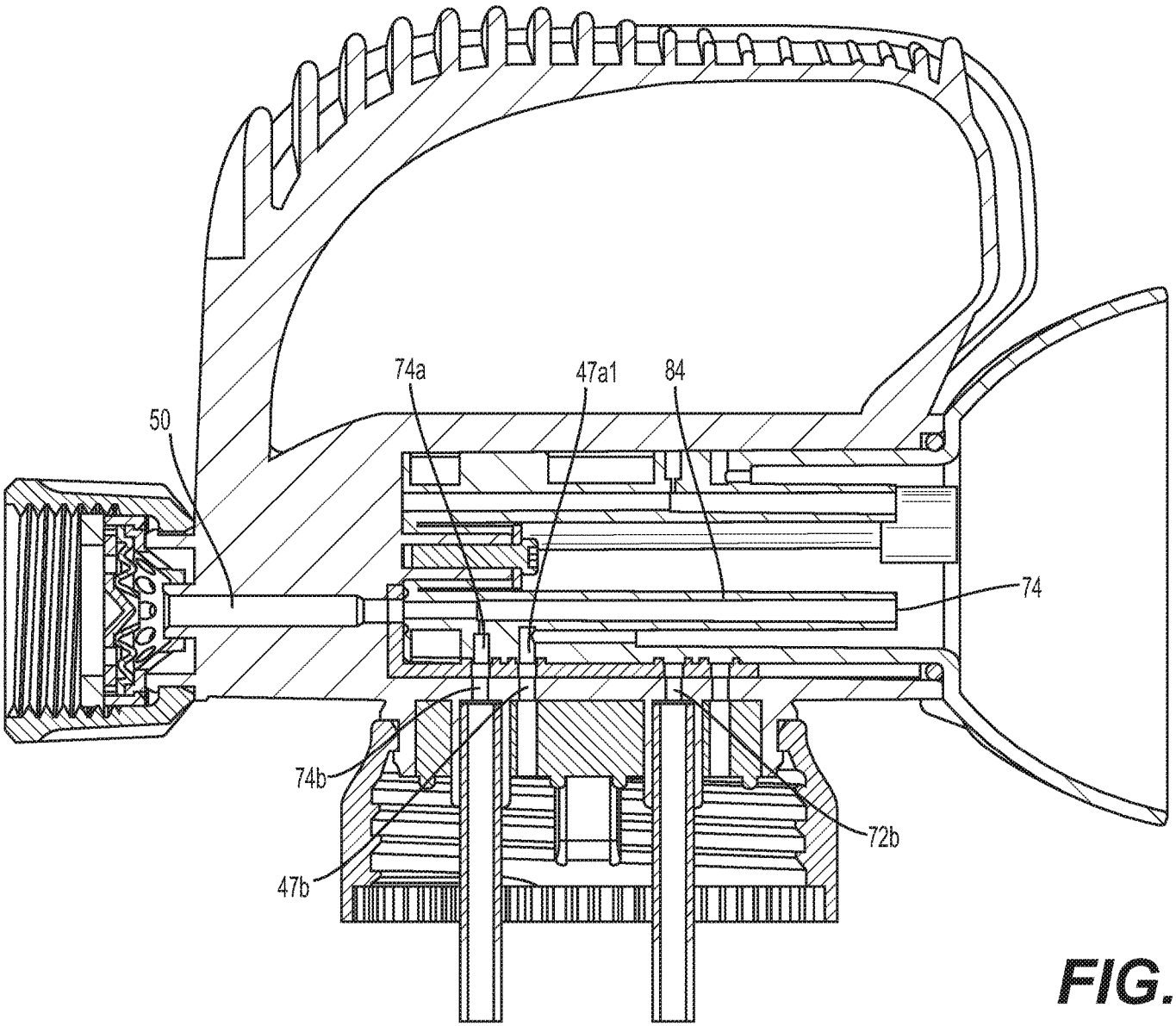
FIG. 32 is an illustration of a cross-section side-view of the dual sprayer with screw connection discharging a second fluid, in accordance with an example embodiment.

FIG. 32 is an illustration of a cross-section side-view of the dual sprayer with screw connection discharging a second fluid, in accordance with an example embodiment. In this mode, the central passage 50 is aligned with the "chem 2" discharge line 74 (see FIG. 27) and the "chem 2" discharge tube 84 (see FIG. 25)—where a working fluid flowing through the central passage 50 and "chem 2" discharge tube 84 also causes a suction force to draw fluid through suction line 28 (via "chemical 2" suction channel 74*a* and "chemical 2" port 74*b*) in order to discharge a fluid from the bottle 60*a*1 along with the working fluid.

Figure 33:
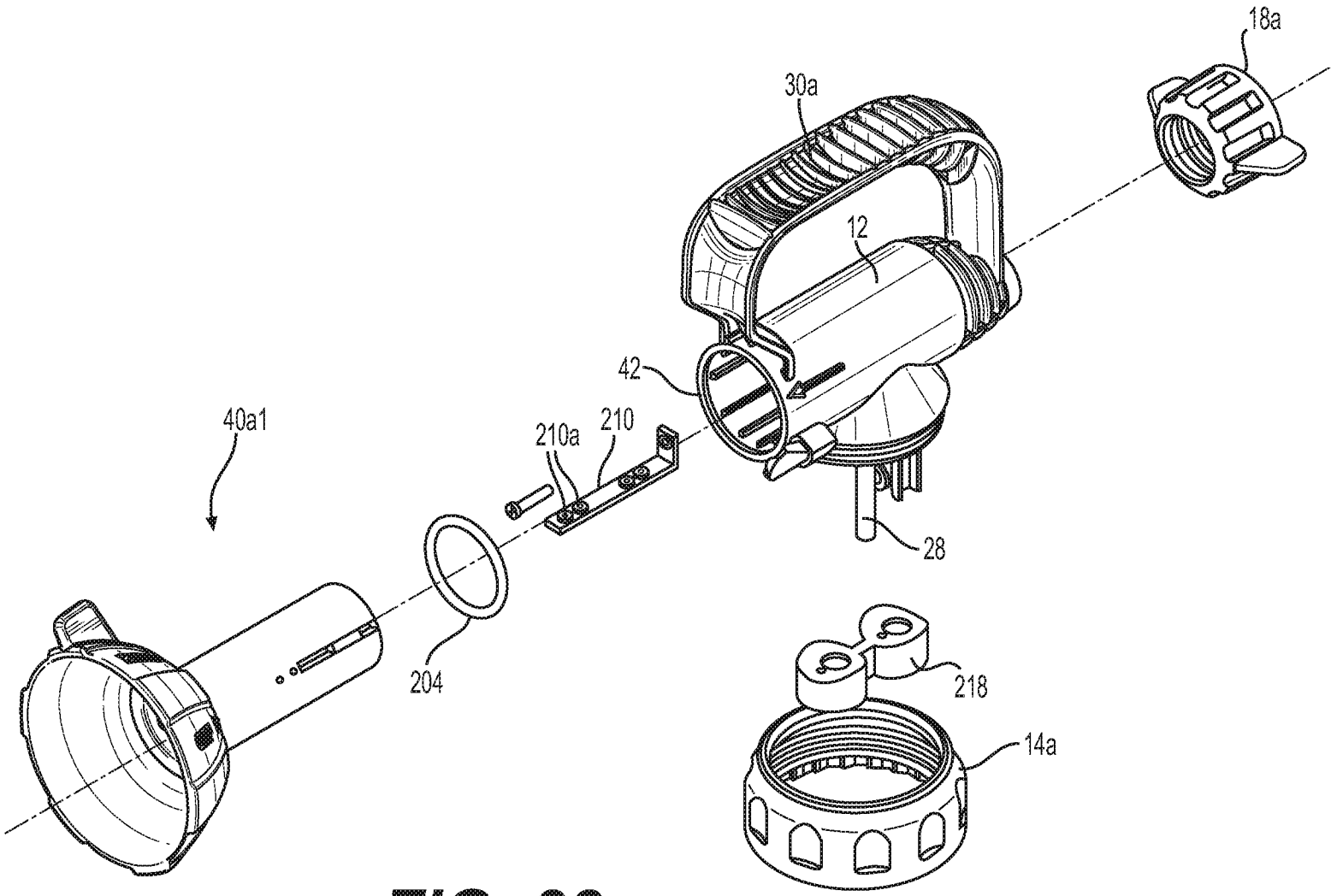
FIG. 33 is an illustration of an exploded view of the dual sprayer with screw connection, in accordance with an example embodiment.

FIG. 33 is an illustration of an exploded view of the dual sprayer with screw connection, in accordance with an example embodiment. In this view, ports 210*a* in the seal 210 are shown, where the seal 210 may slide into the socket 42, and fit within groove 42*e* and between ribs 42*c* (as shown in FIG. 23), prior to the o-ring 204 being placed in the socket 42, followed by the cylinder 40*a*1 sliding into the socket 42. The screw 200 retains the cylinder 40*a*1 within the socket 42.

Figure 34:
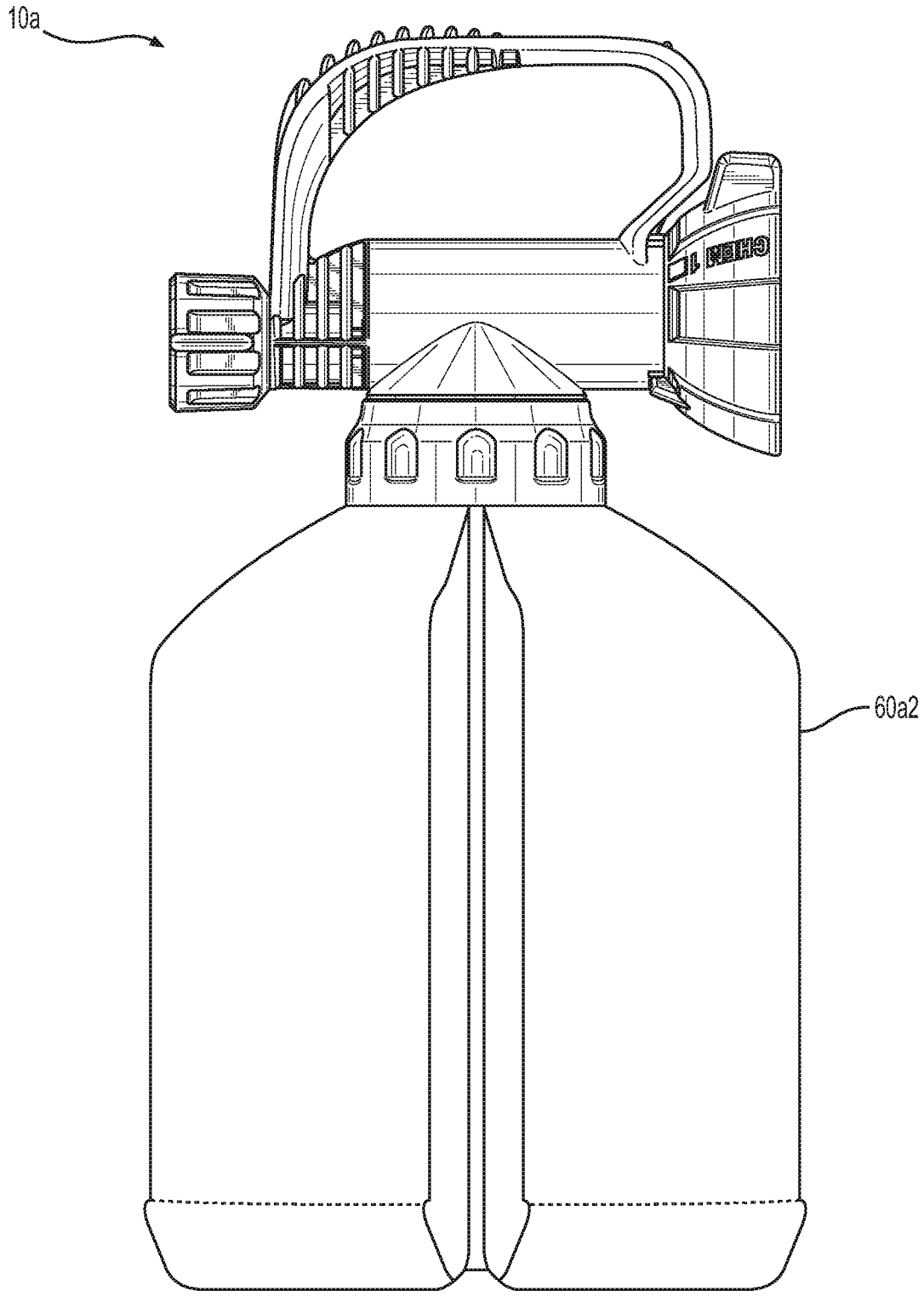
FIG. 34 is an illustration of the dual sprayer with screw connection on a dual chamber bottle, in accordance with an example embodiment.

FIG. 34 is an illustration of the dual sprayer 10*a* with screw connection on a dual chamber bottle 60*a*2, in accordance with an example embodiment.

Figure 35:
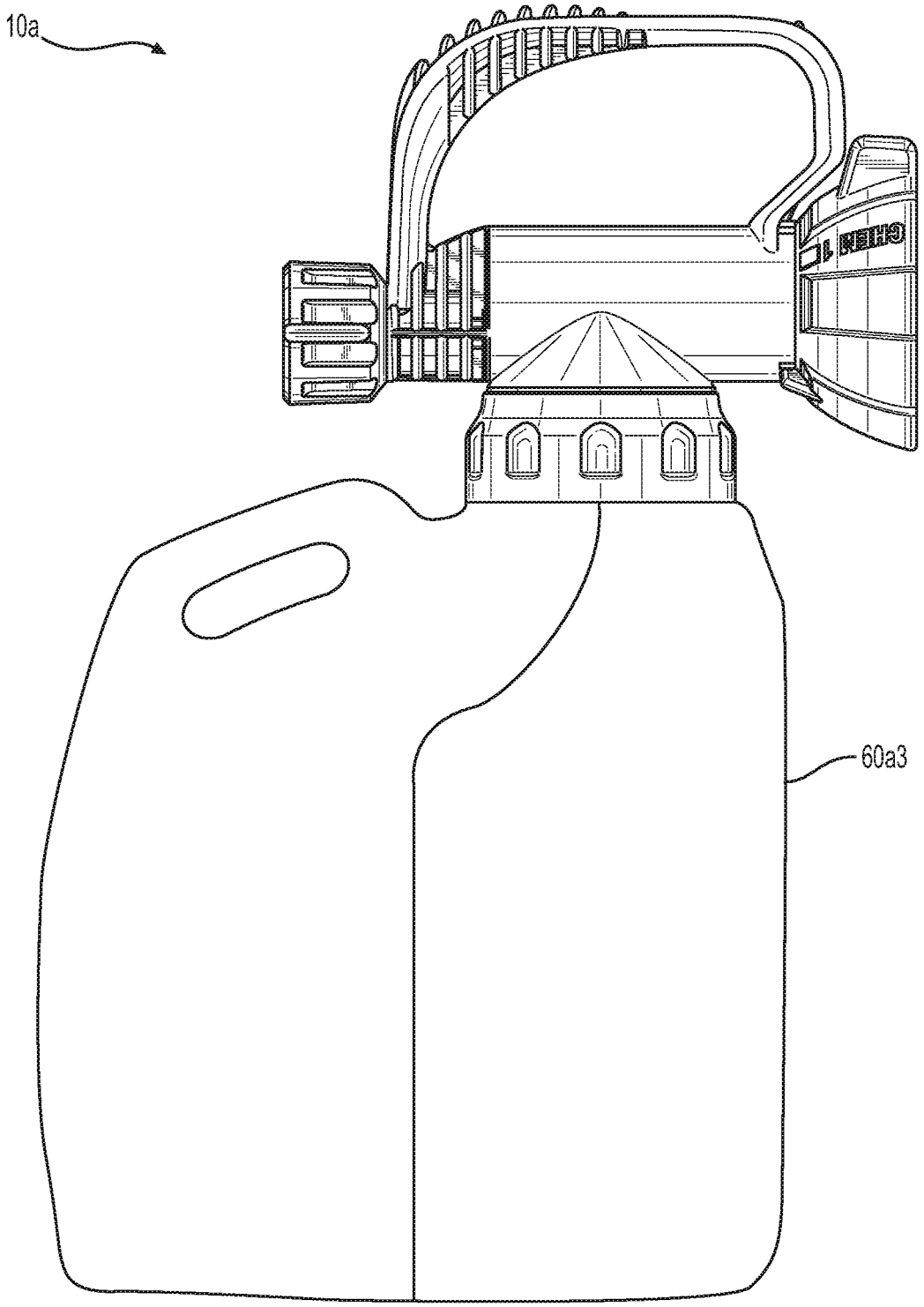
FIG. 35 is an illustration of the dual sprayer with screw connection on another dual chamber bottle, in accordance with an example embodiment.

FIG. 35 is an illustration of the dual sprayer 10 with screw connection on another configuration of a dual chamber bottle 60*a*3, in accordance with an example embodiment.

Figure 36:
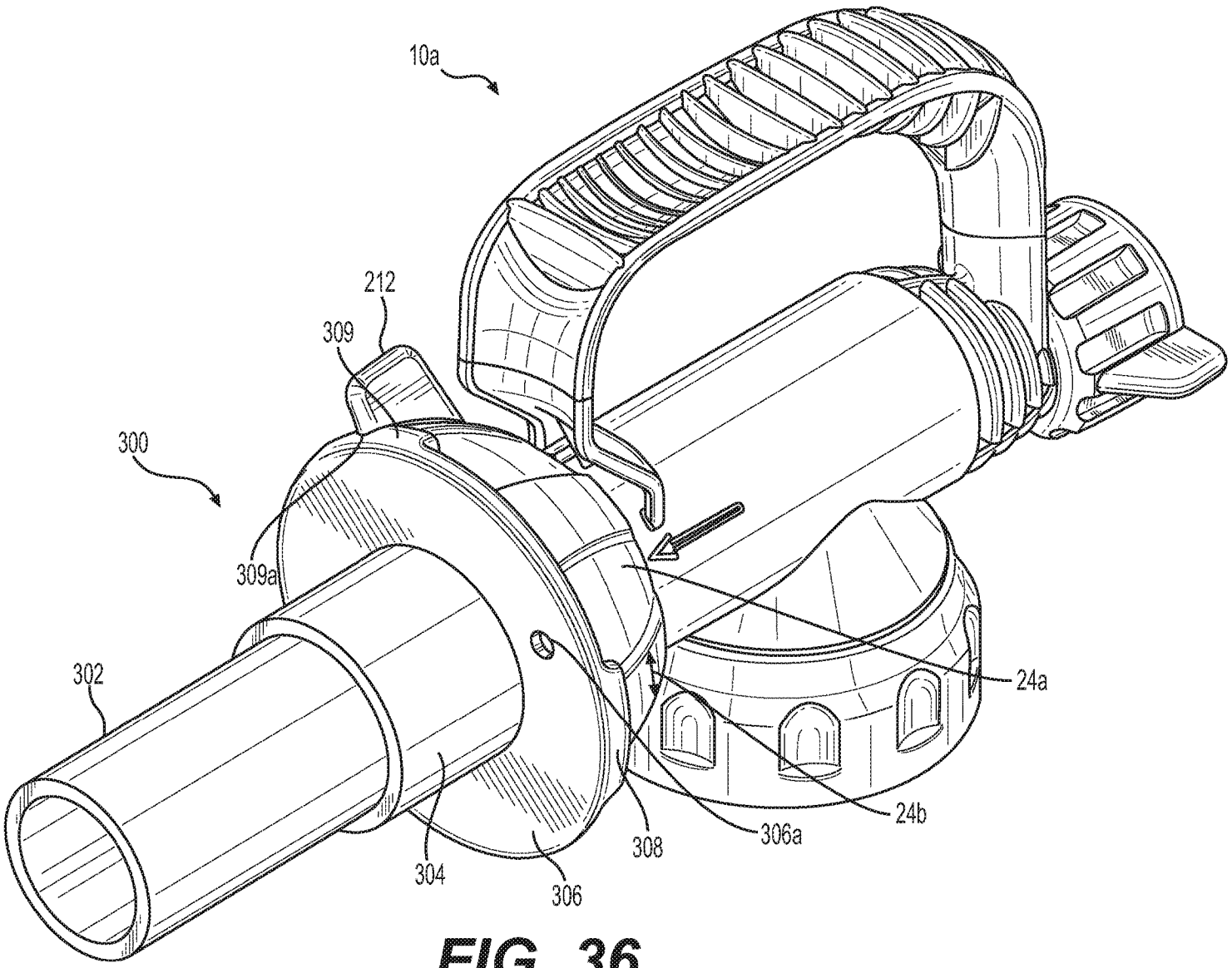
FIG. 36 is an illustration of a side perspective view of the dual sprayer with a foam sprayer attachment.

FIG. 36 is an illustration of a side perspective view of the dual sprayer 10*a* with a foam sprayer attachment 300. The attachment is configured to fit onto the rotating dial 24*a* of the sprayer 10*a*. In particular, a base 306 of the attachment 300 fits over the front facing portion of the dial 24*a*. The base 306 may include an air hole 306*a* that may relieve a potential build-up of pressure between an outer surface of an inner extension 312 of the attachment and an inner surface of the dial 24*a*, as shown and described in more detail in relation to FIG. 43. The base includes an outer extension 304 that supports a discharge barrel 302. Raised lips 308/309 may extend from the base 306, where the lips 308/309 may fit over raised ridges 24*b* on the dial 24*a* to hold the attachment 300 on the dial 24*a* (as shown in better detail in FIGS. 37, 39 and 41). One of the raised lips 309 may include a notch 309*a* that may accept a distal end 212*a* of the tab 212 (shown in better detail in FIG. 39), in order to further allow the attachment 300 to fit on the dial 24*a* and rotate with the dial 24*a*.

Figure 37:
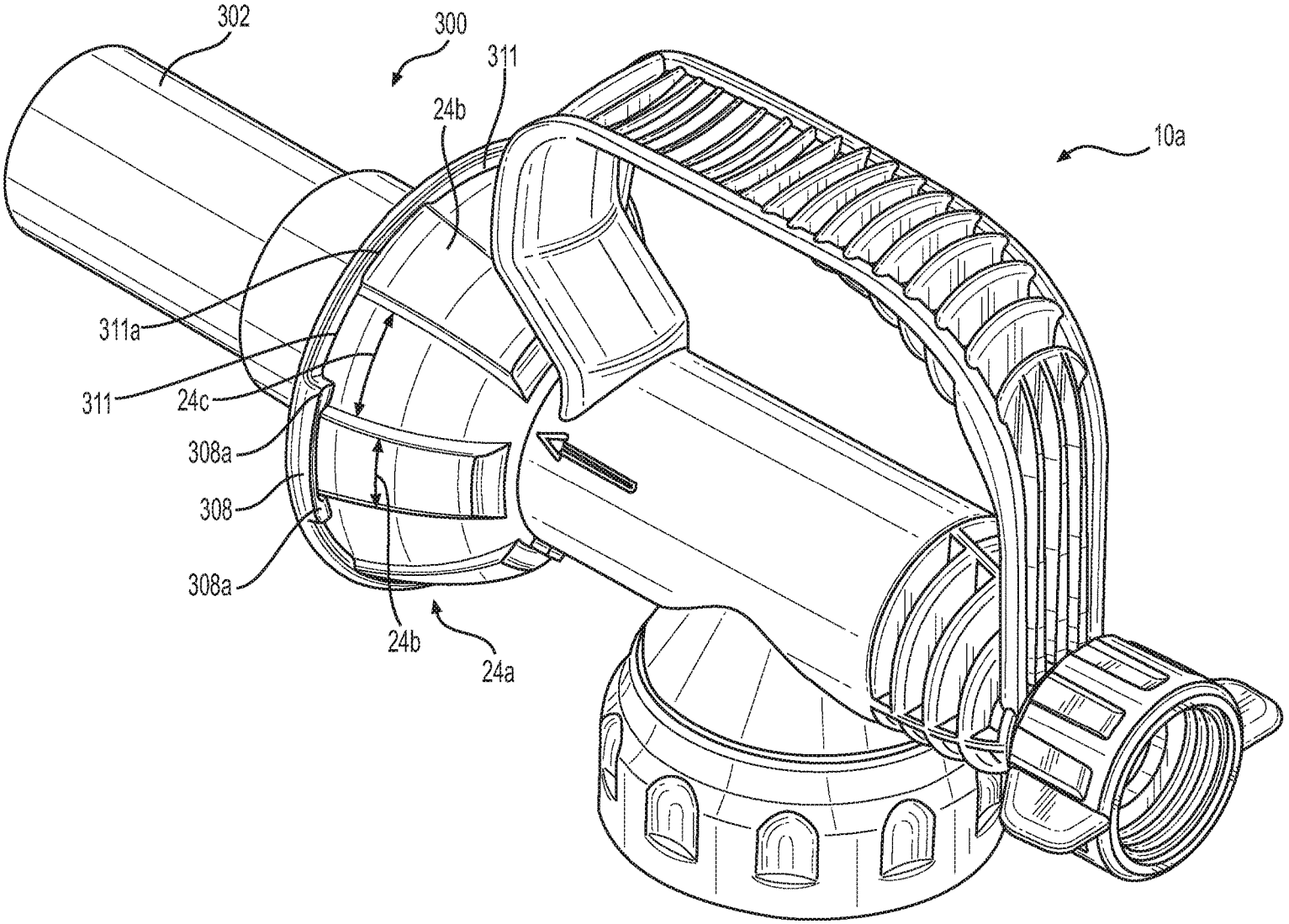
FIG. 37 is an illustration of another side perspective view of the dual sprayer with the foam sprayer attachment.

FIG. 37 is an illustration of another side perspective view of the dual sprayer 10*a* with the foam sprayer attachment 300. This perspective view depicts teeth 308*a* that may be positioned on sides of the raised lip 308 of the attachment 300, where the teeth 308*a* cause the lip 308 to further conform to an outer surface of the raised ridge 24*b* of the rotating dial 24*a*. Specifically, the teeth 308*a* may press against the outer surface 24*c* of the dial 24*a* (the non-raised ridge portion of the dial 24*a*), in order to conform the lip 308 to the dial 24*a*. The based 306 may include non-raised lips 311 that are conformed to the outer surface 24*c* of the dial, where a cut-out area 311*a* of the non-raised lip 311 may also be used to conform the base 306 of the attachment 300 to the raised ridges 24*b* of the dial 24*a* (see FIG. 41, in particular).

Figure 41:
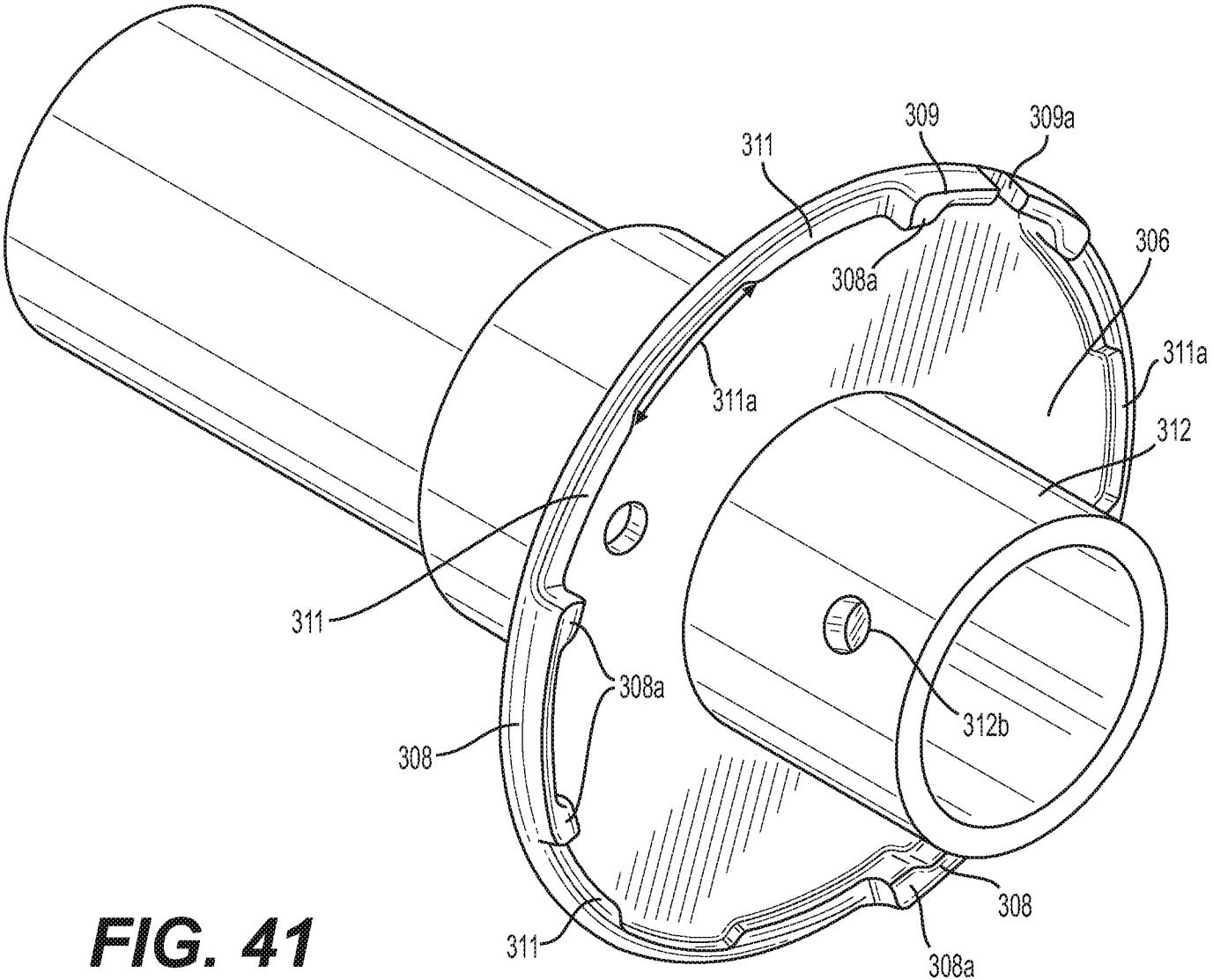
FIG. 41 is an illustration of another perspective view of the foam sprayer attachment.

It should be understood that the dial 24*a* of the sprayer 10*a* can include one, or a pair, or a number of raised ridges 24*b* that may run longitudinally along the surface 24*c* of the attachment 300. The ridges 24*b* may facilitate connecting the attachment 300 to the dial 24*a*. In an embodiment, six raised ridges 24*b* may be utilized on the outer surface of the dial 24*a*. In an embodiment, the attachment 300 may include a same number of cut-outs 311*a* and/or raised lips 308 as compared to the number of raised ridges 24*b* on the dial 24*a* (see a configuration of cut-outs 311*a* and raised lips 308, as shown in FIG. 41).

Figure 38:
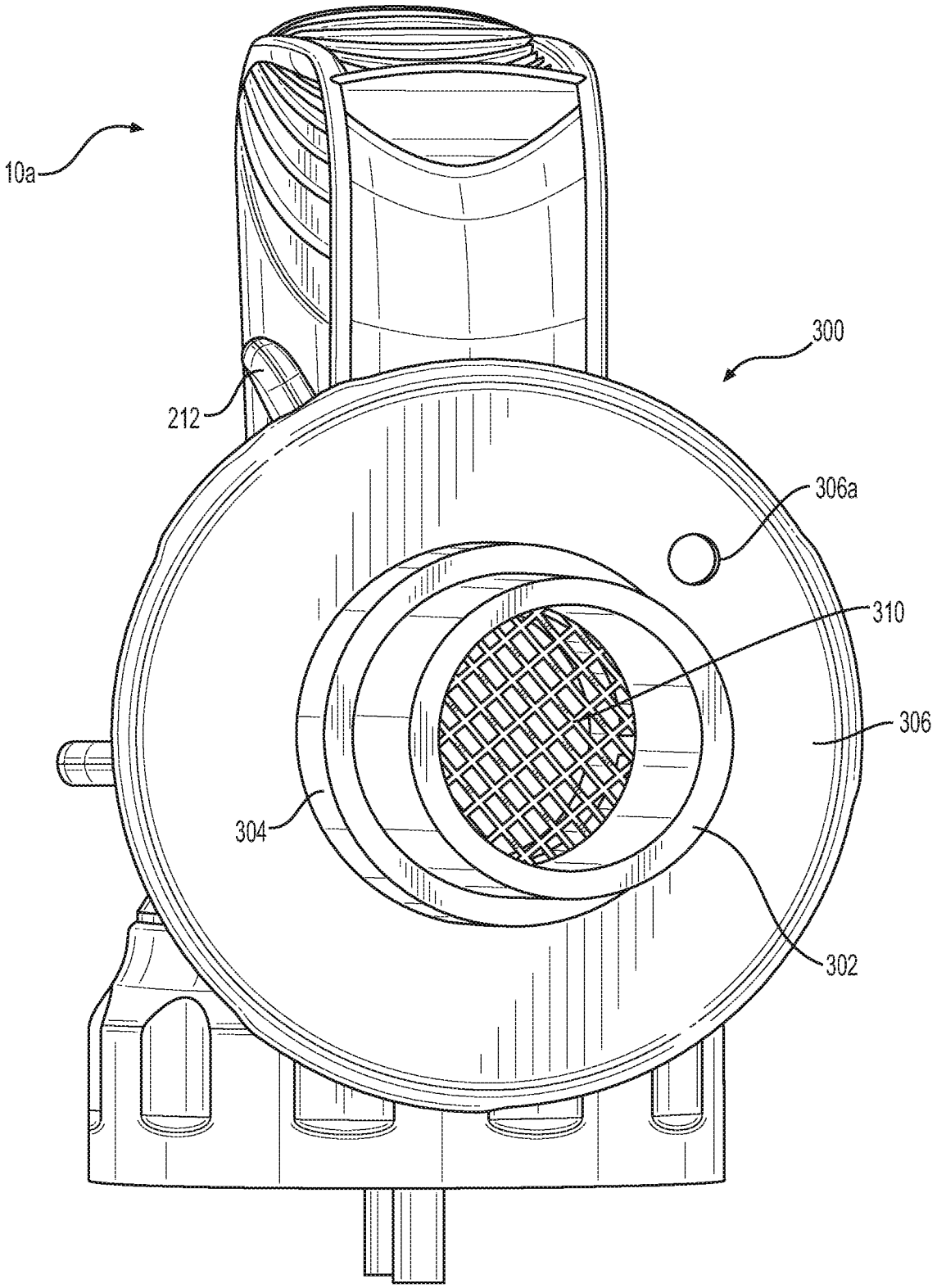
FIG. 38 is an illustration of a front perspective view of the dual sprayer with the foam sprayer attachment.
Figure 40:
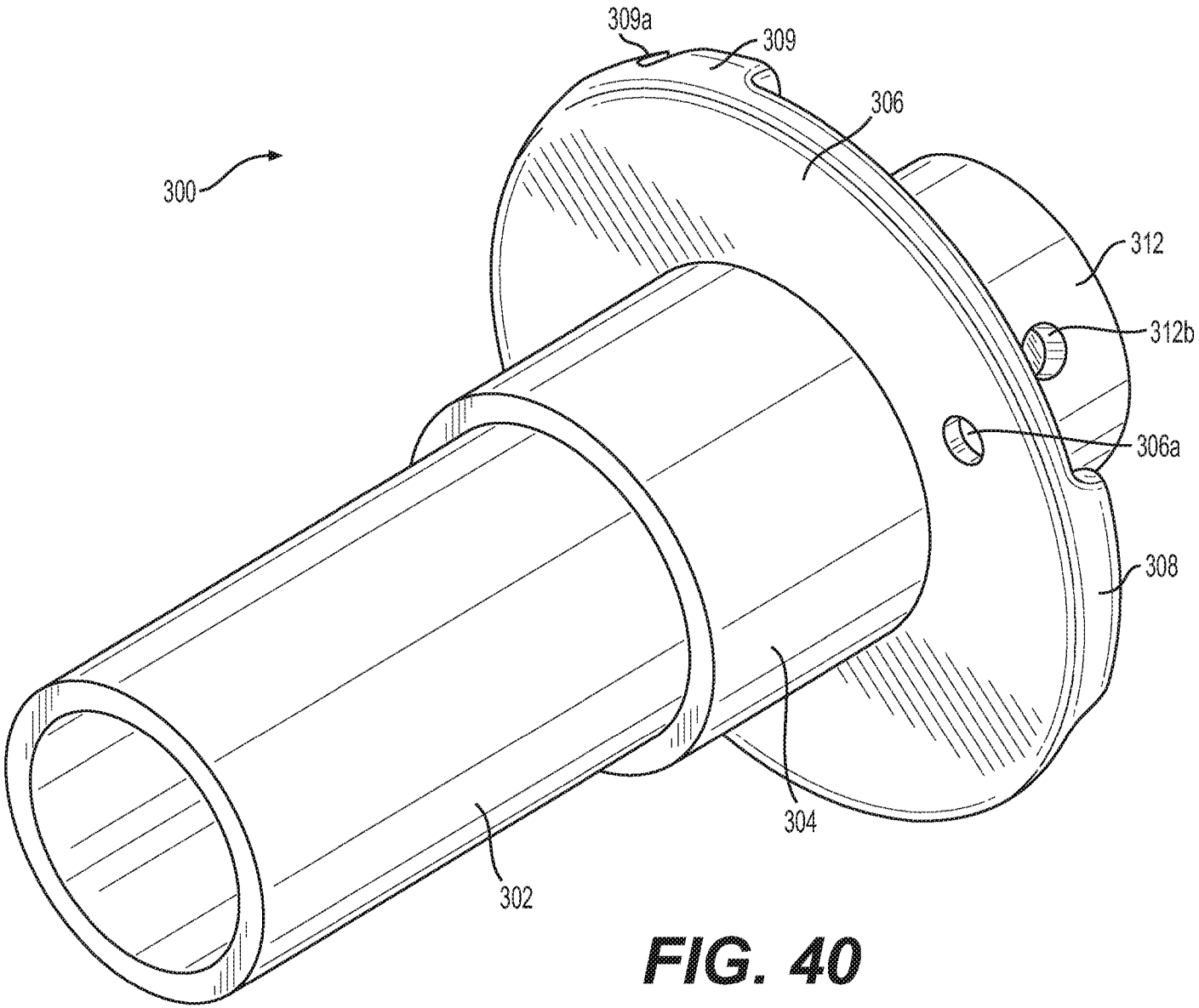
FIG. 40 is an illustration of a perspective view of the foam sprayer attachment.

FIG. 38 is an illustration of a front perspective view of the dual sprayer 10*a* with the foam sprayer attachment 300. The attachment 310 may include a screen 310. Specifically, the attachment 300 defines a channel (formed by the base 306, the outer extension 304, the discharge barrel 302 and inner extension 312, as shown in FIG. 40), where the screen 310 traverses the channel within the attachment 300. The screen 310 may be removable and replaceable within the attachment 300, where the attachment 300 may accommodate screens 310 of varying sizes. That is to say, different opening sizes may be provided by the various screens 310 may be accommodated within the attachment 300.

Figure 39:
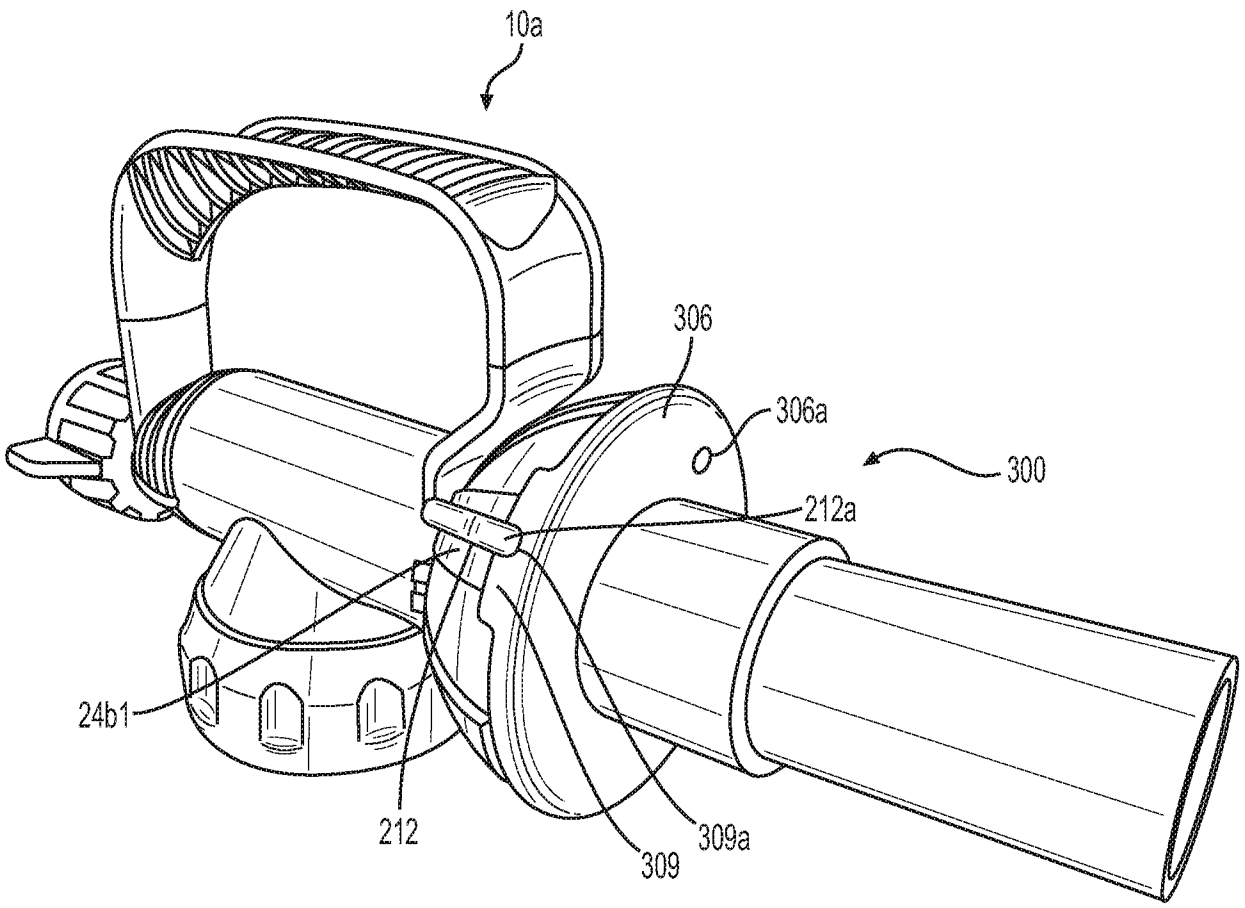
FIG. 39 is an illustration of another side perspective view the dual sprayer with the foam sprayer attachment.

FIG. 39 is an illustration of another side perspective view the dual sprayer 10*a* with the foam sprayer attachment 300. From this perspective, the notch 309*a* of the raised lip 309 is shown conforming to the shape of the distal end 212*a* of the tab 212.

FIG. 40 is an illustration of a perspective view of the foam sprayer attachment 300. The attachment 300 includes an inner extension 312 projecting away from a back surface of the base 306. The inner extension 312 may include a circular divot 312*b* which is formed during the manufacturing process, for convenience during the manufacturing.

FIG. 41 is an illustration of another perspective view of the foam sprayer attachment 300. As discussed above, the back surface of the base 306 of the attachment 300 includes a "connecting structure" that may include raised lips 308/309 and/or cut-out areas 311*a* that may conform the base 306 to the outer surface of the rotating dial 24*a* of the sprayer 10*a*. In an embodiment, and as shown in FIG. 41, the attachment 300 includes alternating cut-outs 311*a* and raised lips 308 that each fit the raised ridges 24*b* of the dial 24*a*. The cut-out areas 311*a* and the raised lips 308 may each be bracketed by non-raised lips 311, where the non-raised lips 311 may be conformed to the surface 24*b* of the dial 24*a* (see FIG. 37). In an embodiment, and as shown in FIG. 41, the number of cut-out areas 311*a* may total three in number, and the number of raised lips 308/309 may also total three in number. In another embodiment, only raised lips 308 (and not cut-out areas 311*a*) may be used to conform the attachment 300 to the dial 24*a*. In another embodiment, only cut-out areas 311*a* (and not raised lips 308/309) may be used to conform the attachment 300 to the dial 24*a*.

Figure 42:
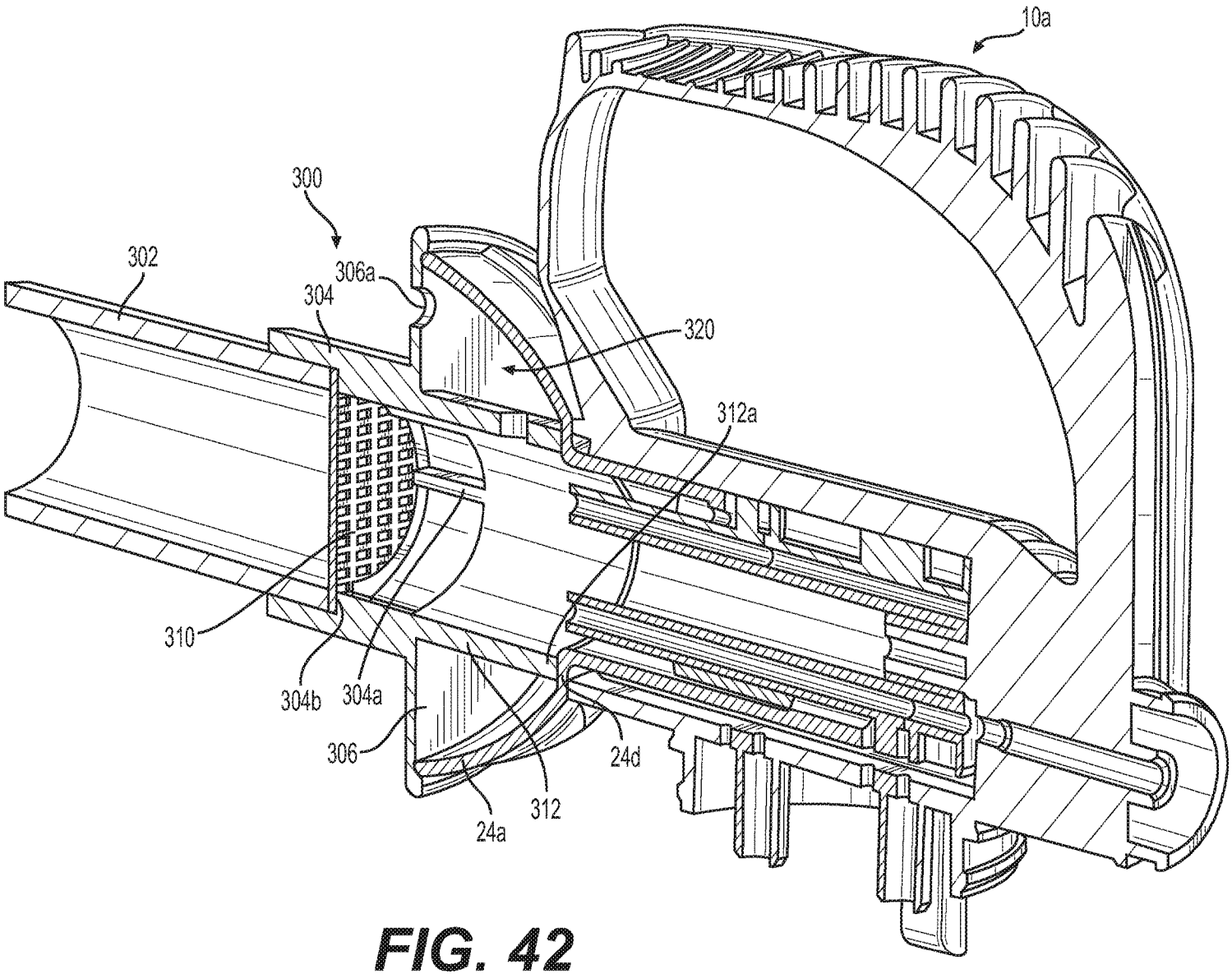
FIG. 42 is an illustration of a side perspective cross-sectional view of the dual sprayer with the foam sprayer attachment.

FIG. 42 is an illustration of a side perspective cross-sectional view of the dual sprayer 10*a* with the foam sprayer attachment 300. The screen 310 is positioned against a step 304*b* on an inner surface of the outer extension 304. The attachment 300 may be configured to allow the discharge barrel 302 to be removed to allow the screen 310 to be replaced. Ribs 304*a* along an inner surface of the outer extension 304 may facilitate holding the screen 310 in place against a distal end of the barrel 302. A distal end 312*a* of the inner extension 312 may press against an inner/annular vertical surface 24*d* of the dial 24*a* to form a liquid-tight seal between the inner extension 312 and the dial 24*a*. As explained above, the air hole 306*a* may relieve a potential build-up of pressure that may exist in the area 320 between the base 306 of the attachment 300 and the inner surface of the dial 24*a* during use of the sprayer 10*a* with the foam sprayer attachment 300.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A sprayer, comprising:

a sprayer housing defining a chamber;

a cylinder within the chamber, the cylinder defining at least two discharge tubes positioned in a longitudinal direction within the sprayer housing, the cylinder being selectively rotatable within the chamber; and at least two suction tubes extending from a lower portion of the sprayer housing, the lower portion of the sprayer housing being configured to connect to a multi-chamber bottle so that the at least two suction tubes can extend into the multi-chamber bottle, the at least two suction tubes being in selective fluid communication with the at least two discharge tubes of the cylinder as the cylinder is rotated within the chamber, the sprayer being configured to operate while being portable;

at least two suction housings within the cylinder, each of the at least two suction housings including, one of the at least two discharge tubes, and one suction channel intersecting a respective one of the at least two discharge tubes, the one suction channel being in selective fluid communication with one of the at least one of the two suction tubes; and a screw penetrating a back-wall of the cylinder and a back-wall of the chamber, the screw being configured to retain the cylinder within the chamber during an operational use of the sprayer, the sprayer housing defining an inlet, and a central passage in fluid communication with the inlet, each of the at least two discharge tubes being configured to be individually and selectively aligned to be in fluid communication with the central passage as the cylinder is rotated within the chamber, the back-wall of the chamber defining a first cylindrical extension, the back-wall of the cylinder defining a second cylindrical extension, the first cylindrical extension being insertable into the second cylindrical extension, and the screw penetrating the first and second cylindrical extensions, the screw being configured to remain in a stationary position as the cylinder is rotated within the chamber.

2. A sprayer, comprising:

a sprayer housing defining a chamber;

a cylinder within the chamber, the cylinder defining at least two discharge tubes positioned in a longitudinal direction within the sprayer housing, the cylinder being selectively rotatable within the chamber;

at least two suction tubes extending from a lower portion of the sprayer housing, the lower portion of the sprayer housing being configured to connect to a multi-chamber bottle so that the at least two suction tubes can extend into the multi-chamber bottle, the at least two suction tubes being in selective fluid communication with the at least two discharge tubes of the cylinder as the cylinder is rotated within the chamber;

a screw penetrating a back-wall of the cylinder and a back-wall of the chamber, the screw being configured to retain the cylinder within the chamber during an operational use of the sprayer, at least two suction housings within the cylinder, each of the at least two suction housings including, one of the at least two discharge tubes, and one suction channel intersecting a respective one of the at least two discharge tubes, the one suction channel being in selective fluid communication with one of the at least one of the two suction tubes;

the sprayer housing defining an inlet, and a central passage in fluid communication with the inlet, each of the at least two discharge tubes being configured to be individually and selectively aligned to be in fluid communication with the central passage as the cylinder is rotated within the chamber, the sprayer being configured to operate while being portable, the at least two discharge tubes includes a first discharge tube, a second discharge tube, and a third discharge tube, and the at least two suction housings including, a first suction housing including the first discharge tube in fluid communication with a first suction channel, the first suction channel being in selective fluid communication with a first suction tube, of the at least two suction tubes, and a second suction housing including the second discharge tube in fluid communication with a second suction channel, the second suction channel being in selective fluid communication with a second suction tube, of the at least two suction tubes, the third discharge tube not including a suction housing.

3. The sprayer of claim 2, wherein each suction housing, of the at least two suction housings, further defines at least one air return vent located adjacent to a respective suction channels of each suction housing of the least two suction housings, each of the at least one air return vent being in fluid communication with an air inlet that penetrates an end of each suction housing of the at least two suction housings, each of the at least one air return vents being in selective fluid communication with a respective air port positioned adjacent to the at least two suction tubes on the lower portion of the sprayer housing.

4. The sprayer of claim 2, wherein, the first suction channel is about perpendicular to the first discharge tube, the second suction channel is about perpendicular to the second discharge tube, a longitudinal length of the central passage is about parallel to the longitudinal direction of the at least two discharge tubes within the sprayer housing.

5. The sprayer of claim 2, wherein the sprayer includes multiple operational modes depending on the rotation of the cylinder within the chamber, the multiple operational modes including, a first mode where the first discharge tube is aligned with the central passage and is in fluid communication with the first suction tube, in order to allow the sprayer to accept a pressurized working fluid to enter the inlet of the sprayer housing and pass through the first discharge tube to also draw a first liquid fluid into the first discharge tube from the first suction tube, and a second mode where the second discharge tube is aligned with the central passage and is in fluid communication with the second suction tube, in order to allow the sprayer to accept the pressurized working fluid to enter the inlet of the sprayer housing and pass through the second discharge tube to also draw a second liquid fluid into the second discharge tube from the second suction tube.

6. The sprayer of claim 5, wherein the multiple operational modes further include, a third mode where the third discharge tube is aligned with the central passage, in order to allow the sprayer to accept the pressurized working fluid to enter the inlet of the sprayer housing and pass through the third discharge tube so that the pressurized working fluid may be discharged from the sprayer without being mixed with another liquid fluid, and a fourth mode that does not allow any fluid to travel through the sprayer.

7. The sprayer of claim 6, further comprising:

a rotatable dial on an end of the cylinder, an end of the rotatable dial extending from the chamber of the sprayer housing, the rotatable dial being capable of manual manipulation to cause the cylinder to rotate within the chamber; and indicia on an outer surface of the dial, the indicia indicating which one of the multiple operational modes the sprayer is in.

8. The sprayer of claim 1, further comprising:

the multi-chamber bottle connected to the lower portion of the sprayer housing, each of the at least two suction tubes extending into one respective chamber of the multi-chamber bottle, a number of chambers of the multi-chamber bottle equaling a number of the at least two suction housings within the cylinder of the sprayer.

9. The sprayer of claim 2, further comprising:

the multi-chamber bottle, the multi-chamber bottle being a dual-chamber bottle connected to the lower portion of the sprayer housing, the first suction tube extending into a first chamber of the dual-chamber bottle and the second suction tube extending into a second chamber of the dual-chamber bottle.

10. A sprayer, comprising:

a sprayer housing defining a chamber;

a cylinder within the chamber, the cylinder defining at least two discharge tubes positioned in a longitudinal direction within the sprayer housing, the cylinder being selectively rotatable within the chamber;

at least two suction tubes extending from a lower portion of the sprayer housing, the at least two suction tubes being in selective fluid communication with the at least two discharge tubes of the cylinder as the cylinder is rotated within the chamber a female connector on the lower portion of the sprayer housing, the female connector including a connector housing that is freely rotatable relative to the sprayer housing, an inner surface of the connector housing defining threads;

at least two vertical extensions extending away from the sprayer housing, the at least two vertical extensions being configured to insert into cut-out portions of a male connector of a bottle that is attachable to the sprayer, the at least two vertical extensions being configured to align the male connector with the female connector as the sprayer is being attached to the bottle; and a suction tube housing joining the at least two suction tubes to the lower portion of the sprayer housing, the suction tube housing including a cylindrical suction tube housing for each of the at least two suction tubes, the cylindrical suction tube housing including an air return port configured to allow air to enter the bottle to replace a volume of fluid that is discharged from the bottle during operational use of the sprayer.

11. The sprayer of claim 10, wherein the at least two vertical extensions include sidewalls that are flared-outward relative to an imaginary centerline running through a longitudinal length of the connector housing.

12. The sprayer of claim 10, wherein a first distal end of the inner surface of the connector housing further defines ratchet spurs configured to interlock with locking spurs on the male connector of the bottle to fully lock the sprayer onto the bottle.

13. A sprayer, comprising:

a sprayer housing defining a chamber;

a cylinder within the chamber, the cylinder defining at least two discharge tubes positioned in a longitudinal direction within the sprayer housing, the cylinder being selectively rotatable within the chamber;

at least two suction tubes extending from a lower portion of the sprayer housing, the at least two suction tubes being in selective fluid communication with the at least two discharge tubes of the cylinder as the cylinder is rotated within the chamber; and a rotatable dial on an end of the cylinder, an end of the rotatable dial extending from the chamber of the sprayer housing; and a foam sprayer attachment defining a discharge channel, the foam sprayer attachment including, a screen traversing the discharge channel, and a base configured to connect to an end of the rotatable dial so that the discharge channel is in fluid communication with the at least two discharge tubes, wherein the foam sprayer attachment further includes, a discharge barrel on a first distal end of the foam sprayer attachment, and a first inner extension on a proximal end of the foam sprayer attachment, the first inner extension extending from an inner surface of the base, a second distal end of the first inner extension being configured to contact an inner annular vertical surface on an inner surface of the rotatable dial to form a liquid-tight seal between the first inner extension and the rotatable dial.

14. The sprayer of claim 13, wherein, an outer surface of the rotatable dial defines at least one first raised ridge running longitudinally along the rotatable dial, and the base of the foam sprayer attachment includes at least one of a raised lip or a cut-out area that conforms the inner surface of the base to the raised ridge.

15. The sprayer of claim 14, wherein, the outer surface of the rotatable dial includes a tab, the tab having a third distal end, and the at least one of the raised lip or the cut-out area includes a first raised lip with a notch that is conformed to the third distal end.

16. The sprayer of claim 14, wherein the foam sprayer attachment further includes, a major body defining the discharge channel, the major body including, the base, the base including at least one first connecting structure on a first side of the base, the at least one first connecting structure being the at least one of the raised lip or the cut-out area that is configured to conform the first side of the base to at least one surface on a discharge connection of the sprayer, wherein the at least one first connecting structure further includes a pair of non-raised lips on sides of the at least one first connecting structure.

17. The sprayer of claim 16, wherein the pair of non-raised lips conform the first side of the base to an outer surface of the discharge connection of the sprayer, the major body of the foam sprayer attachment further comprising:

a discharge barrel connected to a second side of the base, and a second inner extension on the first side of the base, a fourth distal end of the second inner extension being configured to contact and form a liquid-tight seal with an inner annular vertical surface on an inner surface of the discharge connection.

18. The sprayer of claim 16, wherein the base defines an air hole configured to relieve pressure between the first side of the base and an interior of the discharge connection if the foam sprayer attachment is connected to the sprayer.

19. The sprayer of claim 16, wherein the at least one first connecting structure includes, the at least one raised lip, the at least one raised lip including a pair of teeth on sides of the at least one raised lip, and the at least one cut-out area, wherein the at least one first raised lip defines a notch configured to accept a tab on the discharge connection of the sprayer in order to allow the foam sprayer attachment and the discharge connection to rotate together if the foam sprayer attachment is connected to the sprayer.

* * * * *